US007985321B2

(12) United States Patent
Sumnicht et al.

(10) Patent No.: US 7,985,321 B2
(45) Date of Patent: Jul. 26, 2011

(54) ABSORBENT SHEET HAVING REGENERATED CELLULOSE MICROFIBER NETWORK

(75) Inventors: Daniel W. Sumnicht, Hobart, WI (US); Bruce J. Kokko, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/661,956

(22) Filed: Mar. 26, 2010

(65) Prior Publication Data

US 2010/0212850 A1 Aug. 26, 2010

Related U.S. Application Data

(62) Division of application No. 11/725,253, filed on Mar. 19, 2007, now Pat. No. 7,718,036.

(60) Provisional application No. 60/784,228, filed on Mar. 21, 2006, provisional application No. 60/850,467, filed on Oct. 10, 2006, provisional application No. 60/850,681, filed on Oct. 10, 2006, provisional application No. 60/881,310, filed on Jan. 19, 2007.

(51) Int. Cl.
*D21H 13/08* (2006.01)
*D21C 9/00* (2006.01)
*D02G 3/00* (2006.01)

(52) U.S. Cl. ..... 162/146; 162/157.6; 162/179; 162/182; 162/109; 162/158; 241/21

(58) Field of Classification Search ..... 162/109, 162/41, 146, 149–150, 157.1, 157.6, 157.7, 162/158, 164.1, 168.1, 179, 182–184; 428/359, 428/391, 393, 304.4, 311.11, 311.51, 311.71; 241/21

See application file for complete search history.

(56) References Cited

U.S. PATENT DOCUMENTS

| | | | | |
|---|---|---|---|---|
| 3,337,671 | A | 8/1967 | Herrbach et al. | |
| 3,556,932 | A | 1/1971 | Coscia et al. | 162/166 |
| 3,556,933 | A | 1/1971 | Wiliams et al. | 162/167 |
| 3,700,623 | A | 10/1972 | Keim | 260/80.3 R |
| 3,772,076 | A | 11/1973 | Keim | 177/155 R |
| 3,785,918 | A | 1/1974 | Kawai et al. | |
| 4,100,324 | A | 7/1978 | Anderson et al. | 428/280 |
| 4,145,532 | A | 3/1979 | Franks et al. | |
| 4,196,282 | A | 4/1980 | Franks et al. | |
| 4,246,221 | A | 1/1981 | McCorsley, III | 264/203 |
| 4,307,143 | A | 12/1981 | Meitner | 252/91 |
| 4,374,702 | A | 2/1983 | Turbak et al. | |
| 4,426,417 | A | 1/1984 | Meitner et al. | 428/195 |
| 4,441,962 | A | 4/1984 | Osborn, III | 162/111 |
| 4,481,076 | A | 11/1984 | Herrick | |
| 4,481,077 | A | 11/1984 | Herrick | |
| 4,483,743 | A | 11/1984 | Turbak et al. | |
| 4,528,316 | A | 7/1985 | Sorens | 524/503 |
| 4,529,480 | A | 7/1985 | Trokhan | 162/109 |
| 4,720,383 | A | 1/1988 | Drach et al. | 424/70 |
| 4,906,513 | A | 3/1990 | Kebbell et al. | 428/198 |
| 4,908,097 | A | 3/1990 | Box | |
| 4,931,201 | A | 6/1990 | Julemont | 252/91 |
| 5,223,096 | A | 6/1993 | Phan et al. | 162/158 |
| 5,262,007 | A | 11/1993 | Phan et al. | 162/158 |
| 5,264,082 | A | 11/1993 | Phan et al. | 162/158 |
| 5,269,470 | A | 12/1993 | Ishikawa et al. | |
| 5,312,522 | A | 5/1994 | Phan et al. | 162/111 |
| 5,354,524 | A * | 10/1994 | Sellars et al. | 264/37.2 |
| 5,385,640 | A | 1/1995 | Weibel et al. | |
| 5,415,737 | A | 5/1995 | Phan et al. | 162/111 |
| 5,505,768 | A | 4/1996 | Altadonna | 96/108 |
| 5,562,739 | A * | 10/1996 | Urben | 8/116.4 |
| 5,580,356 | A * | 12/1996 | Taylor | 8/116.1 |

(Continued)

FOREIGN PATENT DOCUMENTS

GB 978953 1/1965

(Continued)

OTHER PUBLICATIONS

Espy, Chapter 2: Alkaline-Curing Polymeric Amine-Epichlorohydrin, Wet Strength Resins and Their Application (L. Chan, Editor, 1994); Trivedi et al., J.Am. Oil Chemist's Soc., Jun. 1981, pp. 754-756 Westfelt, Cellulose Chemistry and Technology, vol. 1, p. 813,1979.

(Continued)

*Primary Examiner* — José A Fortuna
(74) *Attorney, Agent, or Firm* — Laura L. Bozek

(57) ABSTRACT

An absorbent paper sheet for tissue or towel includes from about 99 percent to about 70 percent by weight of cellulosic papermaking fiber and from about 1 percent to about 30 percent by weight fibrillated regenerated cellulose microfiber which was regenerated form a cellulosic dope utilizing a tertiary amine N-oxide solvent or an ionic liquid. Fibrillation of the microfiber is controlled such that it has a reduced coarseness and a reduced freeness as compared with unfibrillated regenerated cellulose microfiber from which it is made and provides at least one of the following attributes to the absorbent sheet: (a) the absorbent sheet exhibits an elevated SAT value and an elevated wet tensile value as compared with a like sheet prepared without fibrillated regenerated cellulose microfiber; (b) the absorbent sheet exhibits an elevated wet/dry CD tensile ratio as compared with a like sheet prepared without fibrillated regenerated cellulose microfiber; (c) the absorbent sheet exhibits a lower GM Break Modulus than a like sheet having like tensile values prepared without fibrillated regenerated cellulose microfiber; or (d) the absorbent sheet exhibits an elevated bulk as compared with a like sheet having like tensile values prepared without fibrillated regenerated cellulose microfiber. In some embodiments, the pulp is pre-treated with debonder to enhance the wet/dry CD tensile ratio of the sheet.

27 Claims, 25 Drawing Sheets

U.S. PATENT DOCUMENTS 5,582,681 A 12/1996 Back et al.
5,607,551 A 3/1997 Farrington, Jr. et al. ..... 162/109
5,725,821 A 3/1998 Gannon et al. ..... 264/203
5,759,210 A * 6/1998 Potter et al. ..... 8/181
5,779,737 A * 7/1998 Potter et al. ..... 8/194
5,785,813 A 7/1998 Smith et al. ..... 162/158
5,863,652 A 1/1999 Matsumura et al.
5,935,880 A 8/1999 Wang et al. ..... 442/65
5,964,983 A 10/1999 Dinand et al.
6,001,218 A 12/1999 Hsu et al. ..... 162/5
6,042,769 A 3/2000 Gannon et al. ..... 264/203
6,074,527 A 6/2000 Hsu et al. ..... 162/111
6,117,545 A 9/2000 Cavaille et al.
6,146,494 A 11/2000 Seger et al. ..... 162/9
6,153,136 A 11/2000 Collier et al.
6,183,596 B1 2/2001 Matsuda et al.
6,214,163 B1 4/2001 Matsuda et al.
6,221,487 B1 4/2001 Luo et al.
6,235,392 B1 5/2001 Luo et al. ..... 428/369
6,245,197 B1 6/2001 Oriaran et al. ..... 162/112
6,258,304 B1 7/2001 Bahia
6,273,995 B1 8/2001 Ikeda et al. ..... 162/111
6,344,109 B1 2/2002 Gross ..... 162/100
6,432,267 B1 8/2002 Watson ..... 162/111
6,447,640 B1 9/2002 Watson et al. ..... 162/101
6,461,476 B1 10/2002 Goulet et al. ..... 162/158
6,471,727 B2 10/2002 Luo et al.
6,511,746 B1 1/2003 Collier et al. ..... 428/359
6,573,204 B1 6/2003 Philipp et al. ..... 442/346
6,582,560 B2 6/2003 Runge et al. ..... 162/182
6,596,033 B1 7/2003 Luo et al.
6,602,386 B1 8/2003 Takeuchi et al.
6,624,100 B1 9/2003 Pike ..... 442/340
6,645,618 B2 11/2003 Hobbs et al. ..... 428/359
6,692,827 B2 2/2004 Luo et al.
6,808,557 B2 10/2004 Holbrey et al. ..... 106/163.01
6,824,599 B2 11/2004 Swatloski et al. ..... 106/163.01
6,833,187 B2 12/2004 Luo et al.
6,841,038 B2 1/2005 Horenziak et al. ..... 162/129
6,849,329 B2 2/2005 Perez et al. ..... 428/359
6,890,649 B2 5/2005 Hobbs et al. ..... 428/365
6,951,895 B1 10/2005 Qin et al.
6,969,443 B1 11/2005 Kokko ..... 162/5
7,037,405 B2 5/2006 Nguyen et al.
7,083,704 B2 8/2006 Sealey et al.
7,094,317 B2 8/2006 Lundberg et al.
7,195,694 B2 3/2007 Von Drach et al.
7,241,711 B2 7/2007 Takai et al.
7,250,382 B2 7/2007 Takai et al.
7,381,294 B2 6/2008 Suzuki et al.
7,718,036 B2 * 5/2010 Sumnicht et al. ..... 162/146
2001/0028955 A1 10/2001 Luo et al. ..... 428/393
2002/0031966 A1 3/2002 Tomarchio et al. ..... 442/179
2002/0036070 A1 3/2002 Luo et al. ..... 162/100
2002/0037407 A1 3/2002 Luo et al.
2002/0041961 A1 4/2002 Sealey et al.
2002/0056916 A1 5/2002 Ichise et al. ..... 257/763
2002/0060382 A1 5/2002 Luo et al.
2002/0074009 A1 6/2002 Zhao et al.
2002/0074097 A1 6/2002 Gross ..... 162/158
2002/0088572 A1 7/2002 Sealey et al.
2002/0088575 A1 7/2002 Lonsky et al. ..... 162/72
2002/0096294 A1 7/2002 Nicholass et al. ..... 162/179
2002/0160186 A1 10/2002 Luo et al.
2002/0162635 A1 11/2002 Hsu et al. ..... 162/55
2003/0024669 A1 2/2003 Kokko ..... 162/500.25
2003/0025252 A1 2/2003 Sealey et al.
2003/0056916 A1 3/2003 Horenziak et al.
2003/0065059 A1 4/2003 Krishnaswamy
2003/0099821 A1 5/2003 Takai et al. ..... 428/292.1
2003/0100240 A1 5/2003 Takai et al.
2003/0144640 A1 7/2003 Nguyen
2003/0157351 A1 8/2003 Swatloski et al. ..... 428/500.25
2003/0159786 A1 8/2003 Runge et al. ..... 162/500.25
2003/0168401 A1 9/2003 Koslow ..... 210/500.25
2003/0177909 A1 9/2003 Koslow ..... 96/154
2003/0200991 A1 10/2003 Keck et al. ..... 134/6
2004/0038031 A1 2/2004 Holbrey et al. ..... 428/402.24
2004/0045687 A1 3/2004 Shannon et al. ..... 162/6
2004/0123962 A1 7/2004 Shannon et al. ..... 162/9
2004/0144510 A1 7/2004 Mauler
2004/0178142 A1 9/2004 Koslow
2004/0203306 A1 10/2004 Grafe et al. ..... 442/189
2004/0206463 A1 10/2004 Luo et al.
2004/0207110 A1 10/2004 Luo et al.
2004/0209078 A1 10/2004 Luo et al.
2004/0226671 A1 11/2004 Nguyen et al.
2005/0006040 A1 1/2005 Boettcher et al. ..... 162/111
2005/0011827 A1 1/2005 Koslow
2005/0051487 A1 3/2005 Koslow
2005/0074542 A1 4/2005 Lundberg et al.
2005/0148264 A1 7/2005 Varona et al. ..... 442/382
2005/0176326 A1 8/2005 Bond et al.
2005/0274469 A1 12/2005 Lundberg et al.
2005/0288484 A1 12/2005 Holbrey et al. ..... 528/480
2006/0019571 A1 1/2006 Lange et al. ..... 442/402
2006/0090271 A1 5/2006 Price et al. ..... 8/490
2006/0141881 A1 6/2006 Bergsten et al. ..... 442/149
2006/0207722 A1 9/2006 Amano et al. ..... 156/327
2006/0240727 A1 10/2006 Price et al. ..... 442/59
2006/0240728 A1 10/2006 Price et al. ..... 442/59
2006/0241287 A1 10/2006 Hecht et al. ..... 530/356
2006/0289132 A1 12/2006 Heijnesson-Hulten
2007/0224419 A1 9/2007 Sumnicht et al. ..... 428/364
2007/0232180 A1 10/2007 Polat et al.
2008/0054107 A1 3/2008 Koslow et al.
2008/0057307 A1 3/2008 Koslow et al.
2008/0083519 A1 4/2008 Kokko et al. ..... 162/6
2008/0135193 A1 6/2008 Kokko
2008/0173418 A1 7/2008 Sumnicht
2008/0173419 A1 7/2008 Sumnicht ..... 162/6
2009/0020139 A1 1/2009 Sumnicht et al. ..... 134/6
2009/0020248 A1 1/2009 Sumnicht et al. ..... 162/141
2009/0120599 A1 5/2009 Nguyen
2009/0151881 A1 6/2009 Nguyen
2009/0159224 A1 * 6/2009 Chou et al. ..... 162/111
2009/0308551 A1 * 12/2009 Kokko et al. ..... 162/146
2010/0006249 A1 1/2010 Kokko et al.
2010/0212850 A1 * 8/2010 Sumnicht et al. ..... 162/111

FOREIGN PATENT DOCUMENTS

GB 2412083 A * 9/2005
RU 2127343 C1 3/1999
RU 2144101 C1 1/2000
RU 2183648 C2 6/2002
RU 2328255 C2 7/2008
WO 95/35399 A1 12/1995
WO WO 98/07914 2/1998
WO WO 2007/109259 9/2007

OTHER PUBLICATIONS

Egan, J.Am. Oil Chemist's Soc., vol. 55 (1978), pp. 1188-1121; Evans, Chemistry and Industry, Jul. 5, 1969; pp. 893-903; Konig et al., Chem. Commun. 2005, 1170-1172.

Waterhouse, J.F., On-Line Formation Measurements and Paper Quality, IPST technical paper series 604, Institute of Paper Science and Technology (1996); and Gooding et al., "Fractionation in a Bauer-McNett Classifier", Journal of Pulp and Paper Science; vol. 27, No. 12, Dec. 2001.

* cited by examiner

ABSORBENT SHEET HAVING REGENERATED CELLULOSE MICROFIBER NETWORK

CROSS-REFERENCE TO RELATED APPLICATIONS

This application is a divisional of U.S. patent application Ser. No. 11/725,253, filed on Mar. 19, 2007, entitled "Absorbent Sheet Having Regenerated Cellulose Microfiber Network", now U.S. Pat. No. 7,718,036. U.S. patent application Ser. No. 11/725,253 was based on the following U.S. Provisional Patent Applications:

(a) U.S. Provisional Patent Application Ser. No. 60/784,228, filed Mar. 21, 2006, entitled "Absorbent Sheet Having Lyocell Microfiber Network";

(b) U.S. Provisional Patent Application Ser. No. 60/850,467, filed Oct. 10, 2006, entitled entitled "Absorbent Sheet Having Lyocell Microfiber Network";

(c) U.S. Provisional Patent Application No. 60/850,6811 filed Oct. 10, 2006, entitled "Method of Producing Absorbent Sheet with Increased Wet/Dry CD Tensile Ratio"; and (d) U.S. Provisional Patent Application No. 60/881,310, filed Jan. 19, 2007, entitled "Method of Making Regenerated Cellulose Microfibers and Absorbent Products Incorporating Same".

The priorities of U.S. patent application Ser. No. 11/725,253 and U.S. Provisional Patent Application Ser. Nos. 60/784,228; 60/850,467; 60/850,681 and 60/881,310 are hereby claimed and their disclosures incorporated by reference into this application.

TECHNICAL FIELD

The present invention relates to absorbent sheet generally, and more particularly to absorbent sheet for tissue and towel made from papermaking fiber such as softwood and hardwood cellulosic pulps incorporating regenerated cellulose microfiber.

BACKGROUND

Regenerated cellulose lyocell fiber is well known. Generally, lyocell fiber is made from reconstituted cellulose spun from aqueous amine oxide solution. An exemplary process is to spin lyocell fiber from a solution of cellulose in aqueous tertiary amine N-oxide; for example, N-methylmorpholine N-oxide (NMMO). The solution is typically extruded through a suitable die into an aqueous coagulating bath to produce an assembly of filaments. These fibers have been widely employed in textile applications. Inasmuch as lyocell fiber includes highly crystalline alpha cellulose it has a tendency to fibrillate which is undesirable in most textile applications and is considered a drawback. In this regard, U.S. Pat. No. 6,235,392 and U.S. Patent Application Publication No. 2001/0028955 to Luo et al. disclose various processes for producing lyocell fiber with a reduced tendency to fibrillate.

On the other hand, fibrillation of cellulose fibers is desired in some applications such as filtration. For example, U.S. Pat. No. 6,042,769 to Gannon et al. discloses a process for making lyocell fibers which readily fibrillate. The fibers so produced may be treated with a disintegrator as noted in Col. 5 of the '769 patent. See lines 30+. See, also, U.S. Pat. No. 5,725,821 of Gannon et al., Highly fibrillated lyocell fibers have been found useful for filter media having a very high degree of efficiency. In this regard, note U.S. Patent Application No. 2003/0168401 and U.S. Application Publication No. 2003/0177909 both to Koslow.

It is known in the manufacture of absorbent sheet to use lyocell fibers having fiber diameters and lengths similar to papermaking fibers. In this regard U.S. Pat. No. 6,841,038 to Horenziak et al. discloses a method and apparatus for making absorbent sheet incorporating lyocell fibers. Note FIG. 2 of the '038 patent which discloses a conventional through-air dried process (TAD process) for making absorbent sheet. U.S. Pat. No. 5,935,880 to Wang et al. also discloses nonwoven fibrous webs incorporating lyocell fibers. See also, U.S. Patent Application Publication No. 2006/0019571. Such fibers have a tendency to flocculate and are thus extremely difficult to employ in conventional wet-forming papermaking processes for absorbent webs. Moreover, conventional lyocell fiber is used in the '038 patent, for example, at elevated weight fractions (40% of wire side layer, Example 1) in order to impact sheet properties.

While the use of lyocell fibers in absorbent structures is known, it has not heretofore been appreciated that very fine lyocell fibers or other regenerated cellulose fibers with extremely low coarseness can provide unique combinations of properties such as wet strength, absorbency and softness even when used in papermaking furnish in limited amounts. In accordance with the present invention, it has been found that regenerated cellulose microfiber can be readily incorporated into a papermaking fiber matrix of hardwood and softwood to enhance networking characteristics and provide premium characteristics even when using less than premium papermaking fibers.

It has been disclosed in U.S. Pat. No. 6,461,476 to Goulet et al. that the wet/dry tensile of throughdried tissue and towels can be increased by treating the pulp with a debonder, a wet strength agent and a dry strength agent. Chemical debonders, also referred to as softeners, are frequently employed in the manufacture of paper tissue and towel. One preferred debonder composition includes a softener system comprising a substantially equimolar, ion-paired mixture of an anionic surfactant and a cationic quaternary ammonium compound. Details are seen in U.S. Pat. No. 6,245,197 to Oriaran et al. Typically, debonders are added to the papermaking furnish at relatively low fiber consistencies, such as are seen in a stock chest or a machine chest. In this regard, see U.S. Pat. No. 5,785,813 to Smith et al.; note FIG. 1 thereof. Note also, U.S. Pat. No. 5,501,768 to Hermans et al., Example 9, Col. 13 wherein kraft hardwood fiber is treated with debonder in a shaft disperser.

The following patents also disclose papermaking processes wherein a debonder composition is added after the fiber has been pulped: U.S. Pat. No. 6,273,995 to Ikeda et al.; U.S. Pat. No. 6,146,494 to Seger et al.; and U.S. Pat. No. 4,441,962 to Osborn, III.

It has been suggested to pre-treat high yield fiber with a combination of oil and surfactant, prior to making absorbent sheet. In this regard reference is made to U.S. Pat. No. 6,001,218 to Hsu et al. and U.S. Pat. No. 6,074,527, also to Hsu et al. According to the '218 and '527 patents, a pulp slurry is treated at elevated temperature with oil and surfactant in order to produce softer products.

It will be appreciated by one of skill in the art that the prior art is replete with pulp treatments seeking to provide a softer and/or stronger product. In this regard, the following references are noted generally: U.S. Patent Publication No. 2003/0024669 (U.S. Ser. No. 09/852,997) entitled "Use of Hydrophobically Modified Polyaminamides With Polyethylene Glycol Esters in Paper Products" of Kokko; U.S. Patent Publication No. 2002/0162635 (U.S. Ser. No. 10/143,674) entitled "Softer and Higher Strength Paper Products and Methods of Making Such Products" of Hsu; U.S. Patent Publication No. 2002/0088575 (U.S. Ser. No. 09/942,468) entitled "Enzymatic Treatment of Pulp to Increase Strength" of Lonsky et al.; U.S. Patent Publication No. 2004/0123962 (U.S. Ser. No. 10/335,133) entitled "Amino-Functionalized Pulp Fibers" of Shannon et al.; U.S. Pat. No. 6,582,560 entitled "Method for Using Water Insoluble Chemical Additives with Pulp and Products Made By Said Method" to Runge et al. See also U.S. Patent Publication No. 2003/0159786 (U.S. Ser. No. 10/389,073) entitled "Method For Using Water Insoluble Chemical Additives with Pulp and Products Made by Said Method" of Runge et al.; United States Patent Publication No. 2004/0045687 (U.S. Ser. No. 10/242,571) entitled "Method for Using Water Insoluble Chemical Additives With Pulp and Products Made by Said Method" of Shannon et al.; U.S. Pat. No. 6,344,109 entitled "Softened Comminution Pulp" to Gross; and U.S. Patent Publication No. 2002/0074097 (U.S. Ser. No. 10/017,361) entitled "Softened Comminution Pulp", also to Gross.

It has been found in accordance with the present invention that debonder pre-treatment of pulp further enhances sheet properties of regenerated cellulose microfiber containing products.

SUMMARY OF INVENTION

In one aspect of the present invention, an absorbent paper sheet for tissue or towel comprising from about 99 percent to about 70 percent by weight of cellulosic pulp-derived papermaking fiber and from about 1 percent to about 30 percent by weight fibrillated regenerated cellulose microfiber having a CSF value of less than 175 ml. The papermaking fiber is arranged in a fibrous matrix and the lyocell microfiber is sized and distributed in the fiber matrix to form a microfiber network therein as is appreciated from FIG. 1 which is a photomicrograph of creped tissue with 20% cellulose microfiber. Fibrillation of the regenerated cellulose microfiber is controlled such that it has a reduced coarseness and a reduced freeness as compared with unfibrillated regenerated cellulose fiber from which it is made, so that the microfiber provides elevated absorbency, strength or softness, typically providing one or more of the following characteristics: (a) the absorbent sheet exhibits an elevated SAT value and an elevated wet tensile value as compared with a like sheet prepared without regenerated cellulose microfiber; (b) the absorbent sheet exhibits an elevated wet/dry tensile ratio as compared with a like sheet prepared without regenerated cellulose microfiber; (c) the absorbent sheet exhibits a lower geometric mean (GM) Break Modulus than a like sheet having like tensile values prepared without regenerated cellulose microfiber; or (d) the absorbent sheet exhibits an elevated bulk as compared with a like sheet having like tensile values prepared without regenerated cellulose microfiber. Particularly suitable fibers are prepared from a cellulosic dope of dissolved cellulose comprising a solvent selected from ionic liquids and tertiary amine N-oxides.

The present invention also provides products with unusually high wet/dry tensile ratios, allowing for manufacture of softer products since the dry strength of a towel product, for example, is often dictated by the required wet strength. A particularly preferred embodiment of the invention includes sheet made with fiber that has been pre-treated with debonder at high consistency.

Further features and advantages of the invention will be appreciated from the discussion which follows.

BRIEF DESCRIPTION OF DRAWINGS

The invention is described in detail below with reference to the Figures wherein:

FIGS. 10-15 are graphical representations of physical properties of hand sheets incorporating regenerated cellulose microfiber, wherein FIG. 10 is a graph of hand sheet bulk versus tensile (breaking length), FIG. 11 is a plot of roughness versus tensile, FIG. 12 is a plot of opacity versus tensile, FIG. 13 is a plot of modulus versus tensile, FIG. 14 is a plot of hand sheet tear versus tensile and FIG. 15 is a plot of hand sheet bulk versus ZDT bonding;

DETAILED DESCRIPTION

Figure 1:
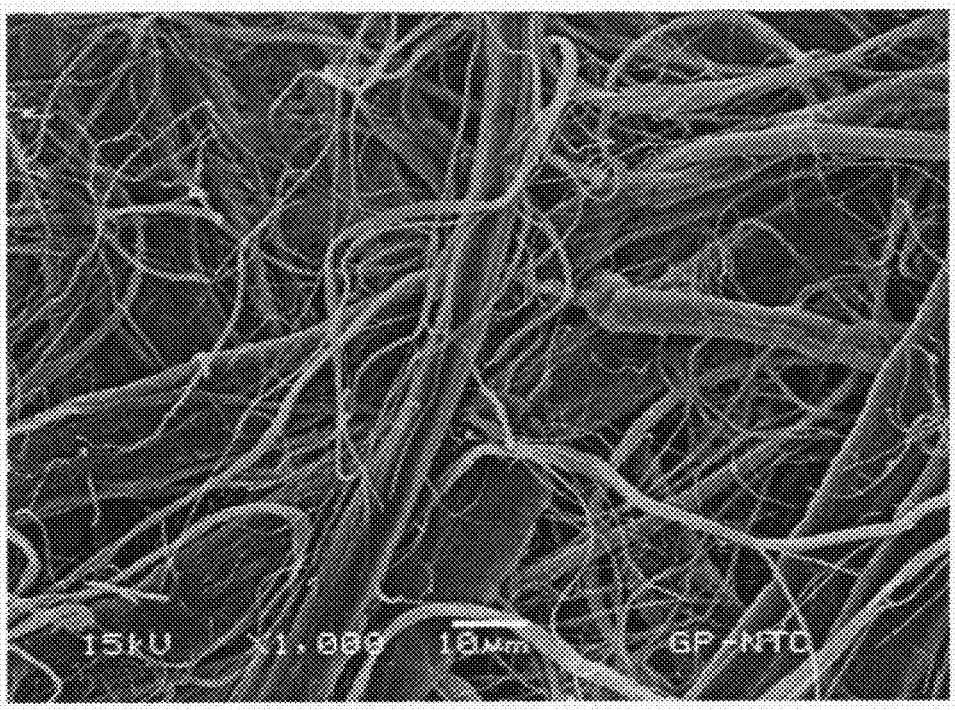
FIG. 1 is a photomicrograph showing creped tissue with 20% regenerated cellulose microfiber.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below; mils refers to thousandths of an inch; mg refers to milligrams and $m^2$ refers to square meters, percent means weight percent (dry basis), "ton" means short ton (2000 pounds) and so forth. Unless otherwise specified, the version of a test method applied is that in effect as of Jan. 1, 2006 and test specimens are prepared under standard TAPPI conditions; that is, conditioned in an atmosphere of 23°±1.0° C. (73.4°±1.8° F.) at 50% relative humidity for at least about 2 hours.

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73° F. is introduced to the sample at the center of the bottom sample plate through a 1 mm diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity, also referred to as SAT, is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow SAT" is specified in which case the cut off criteria is 1 mg in 20 seconds.

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood Kraft fibers; hardwood fibers, such as eucalyptus, maple, birch, aspen, or the like. Papermaking fibers used in connection with the invention are typically naturally occurring pulp-derived fibers (as opposed to reconstituted fibers such as lyocell or rayon) which are liberated from their source material by any one of a number of pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. Naturally occurring pulp-derived fibers are referred to herein simply as "pulp-derived" papermaking fibers. The products of the present invention may comprise a blend of conventional fibers (whether derived from virgin pulp or recycle sources) and high coarseness lignin-rich tubular fibers, such as bleached chemical thermomechanical pulp (BCTMP). Pulp-derived fibers thus also include high yield fibers such as BCTMP as well as thermomechanical pulp (TMP), chemithermomechanical pulp (CTMP) and alkaline peroxide mechanical pulp (APMP). "Furnishes" and like terminology refers to aqueous compositions including papermaking fibers, optionally wet strength resins, debonders and the like for making paper products. For purposes of calculating relative percentages of papermaking fibers, the fibrillated lyocell content is excluded as noted below.

Kraft softwood fiber is low yield fiber made by the well known Kraft (sulfate) pulping process from coniferous material and includes northern and southern softwood Kraft fiber, Douglas fir Kraft fiber and so forth. Kraft softwood fibers generally have a lignin content of less than 5 percent by weight, a length weighted average fiber length of greater than 2 mm, as well as an arithmetic average fiber length of greater than 0.6 mm.

Kraft hardwood fiber is made by the Kraft process from hardwood sources, i.e., eucalyptus and also has generally a lignin content of less than 5 percent by weight. Kraft hardwood fibers are shorter than softwood fibers, typically having a length weighted average fiber length of less than 1 mm and an arithmetic average length of less than 0.5 mm or less than 0.4 mm.

Recycle fiber may be added to the furnish in any amount. While any suitable recycle fiber may be used, recycle fiber with relatively low levels of groundwood is preferred in many cases, for example recycle fiber with less than 15% by weight lignin content, or less than 10% by weight lignin content may be preferred depending on the furnish mixture employed and the application.

Tissue calipers and or bulk reported herein may be measured at 8 or 16 sheet calipers as specified. Hand sheet caliper and bulk is based on 5 sheets. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8 mm) diameter anvils, 539±10 grams dead weight load, and 0.231 in./sec descent rate. For finished product testing, each sheet of product to be tested must have the same number of plies as the product when sold. For testing in general, eight sheets are selected and stacked together. For napkin testing, napkins are unfolded prior to stacking. For base sheet testing off of winders, each sheet to be tested must have the same number of plies as produced off the winder. For base sheet testing off of the papermachine reel, single plies must be used. Sheets are stacked together aligned in the MD. On custom embossed or printed product, try to avoid taking measurements in these areas if at all possible. Bulk may also be expressed in units of volume/weight by dividing caliper by basis weight (specific bulk).

The term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. Compactively dewatering a web thus refers, for example, to removing water from a nascent web having a consistency of less than 30 percent or so by application of pressure thereto and/or increasing the consistency of the web by about 15 percent or more by application of pressure thereto.

Crepe can be expressed as a percentage calculated as:

$$\text{Crepe percent}=[1-\text{reel speed/yankee speed}]\times 100\%$$

A web creped from a drying cylinder with a surface speed of 100 fpm (feet per minute) to a reel with a velocity of 80 fpm has a reel crepe of 20%.

A creping adhesive used to secure the web to the Yankee drying cylinder is preferably a hygroscopic, re-wettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in co-pending U.S. patent application Ser. No. 10/409,042 (U.S. Publication No. US 2005-0006040 A1), filed Apr. 9, 2003, entitled "Improved Creping Adhesive Modifier and Process for Producing Paper Products". The disclosures of the '316 patent and the '042 application are incorporated herein by reference. Suitable adhesives are optionally provided with modifiers and so forth. It is preferred to use crosslinker and/or modifier sparingly or not at all in the adhesive.

"Debonder", debonder composition", "softener" and like terminology refers to compositions used for decreasing tensiles or softening absorbent paper products. Typically, these compositions include surfactants as an active ingredient and are further discussed below.

"Freeness" or CSF is determined in accordance with TAPPI Standard T 227 OM-94 (Canadian Standard Method).

A like sheet prepared without regenerated cellulose microfiber refers to a sheet made by substantially the same process having substantially the same composition as a sheet made with regenerated cellulose microfiber except that the furnish includes no regenerated cellulose microfiber and substitutes papermaking fiber having substantially the same composition as the other papermaking fiber in the sheet. Thus, with respect to a sheet having 60% by weight northern softwood fiber, 20% by weight northern hardwood fiber and 20% by weight regenerated cellulose microfiber made by a CWP process, a like sheet without regenerated cellulose microfiber is made by the same CWP process with 75% by weight northern softwood fiber and 25% by weight northern hardwood fiber.

Lyocell fibers are solvent spun cellulose fibers produced by extruding a solution of cellulose into a coagulating bath. Lyocell fiber is to be distinguished from cellulose fiber made by other known processes, which rely on the formation of a soluble chemical derivative of cellulose and its subsequent decomposition to regenerate the cellulose, for example, the viscose process. Lyocell is a generic term for fibers spun directly from a solution of cellulose in an amine containing medium, typically a tertiary amine N-oxide. The production of lyocell fibers is the subject matter of many patents. Examples of solvent-spinning processes for the production of lyocell fibers are described in: U.S. Pat. No. 6,235,392 of Luo et al.; U.S. Pat. Nos. 6,042,769 and 5,725,821 to Gannon et al., the disclosures of which are incorporated herein by reference.

"MD" means machine direction and "CD" means cross-machine direction.

Opacity is measured according to TAPPI test procedure T425-OM-91, or equivalent.

"Predominant" and like terminology means more than 50% by weight. The fibrillated lyocell content of a sheet is calculated based on the total fiber weight in the sheet; whereas the relative amount of other papermaking fibers is calculated exclusive of fibrillated lyocell content. Thus a sheet that is 20% fibrillated lyocell, 35% by weight softwood fiber and 45% by weight hardwood fiber has hardwood fiber as the predominant papermaking fiber inasmuch as 45/80 of the papermaking fiber (exclusive of fibrillated lyocell) is hardwood fiber.

Dry tensile strengths (MD and CD), stretch, ratios thereof, modulus, break modulus, stress and strain are measured with a standard Instron test device or other suitable elongation tensile tester which may be configured in various ways, typically using 3 or 1 inch wide strips of tissue or towel, conditioned in an atmosphere of 23°±1° C. (73.4°±1° F.) at 50% relative humidity for 2 hours. The tensile test is run at a crosshead speed of 2 in/min. Tensile strength is sometimes referred to simply as "tensile" and is reported in breaking length (km), g/3" or Win.

The modulus of a product (also referred to as stiffness modulus or tensile modulus) is determined by the procedure for measuring tensile strength described above, using a sample with a width of 1 inch, and the modulus recorded is the chord slope of the load/elongation curve measured over the range of 0-50 grams load. "Break Modulus" is the stress at break divided by the elongation at break.

GM Break Modulus is expressed in grams/3 inches/% strain, unless other units are indicated. % strain is dimensionless and units need not be specified. Tensile values refer to break values unless otherwise indicated. Tensile strengths are reported in g/3" at break.

GM Break Modulus is thus:

$$[(\text{MD tensile/MD Stretch at break})\times(\text{CD tensile/CD Stretch at break})]^{1/2}$$

Tensile ratios are simply ratios of the values determined by way of the foregoing methods. Unless otherwise specified, a tensile property is a dry sheet property.

TEA is a measure of toughness and is reported CD TEA, MD TEA, or GM TEA. Total energy absorbed (TEA) is calculated as the area under the stress-strain curve using a tensile tester as has been previously described above. The area is based on the strain value reached when the sheet is strained to rupture and the load placed on the sheet has dropped to 65 percent of the peak tensile load. Since the thickness of a paper sheet is generally unknown and varies during the test, it is common practice to ignore the cross-sectional area of the sheet and report the "stress" on the sheet as a load per unit length or typically in the units of grams per 3 inches of width. For the TEA calculation, the stress is converted to grams per millimeter and the area calculated by integration. The units of strain are millimeters per millimeter so that the final TEA units become g-mm/mm$^2$.

The wet tensile of the tissue of the present invention is measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. Values are divided by two, as appropriate, to account for the loop.

Wet/dry tensile ratios are expressed in percent by multiplying the ratio by 100. For towel products, the wet/dry CD tensile ratio is the most relevant. Throughout this specification and claims which follow "wet/dry ratio" or like terminology refers to the wet/dry CD tensile ratio unless clearly specified otherwise. For handsheets, MD and CD values are approximately equivalent.

Softener or debonder add-on is calculated as the weight of "as received" commercial debonder composition per ton of bone dry fiber when using a commercially available debonder composition, without regard to additional diluents or dispersants which may be added to the composition after receipt from the vendor.

Debonder compositions are typically comprised of cationic or anionic amphiphilic compounds, or mixtures thereof (hereafter referred to as surfactants) combined with other diluents and non-ionic amphiphilic compounds; where the typical content of surfactant in the debonder composition ranges from about 10 wt % to about 90 wt %. Diluents include propylene glycol, ethanol, propanol, water, polyethylene glycols, and nonionic amphiphilic compounds. Diluents are often added to the surfactant package to render the latter more tractable (i.e., lower viscosity and melting point). Some diluents are artifacts of the surfactant package synthesis (e.g., propylene glycol). Non-ionic amphiphilic compounds, in addition to controlling composition properties, can be added to enhance the wettability of the debonder, where both debonding and maintenence of absorbency properties are critical to the substrate that a debonder is applied. The nonionic amphiphilic compounds can be added to debonder compositions to disperse inherent water immiscible surfactant packages in water streams, such as encountered during papermaking. Alternatively, the nonionic amphiphilic compound, or mixtures of different non-ionic amphiphilic compounds, as indicated in U.S. Pat. No. 6,969,443 to Kokko, can be carefully selected to predictably adjust the debonding properties of the final debonder composition.

When formulating debonder composition directly from surfactants, the debonder add-on includes amphiphilic additives such as nonionic surfactant, i.e. fatty esters of polyethylene glycols and diluents such as propylene glycol, respectively, up to about 90 percent by weight of the debonder composition employed; except, however that diluent content of more than about 30 percent by weight of non-amphiphilic diluent is excluded for purposes of calculating debonder composition add-on per ton of fiber. Likewise, water content is excluded in calculating debonder add-on.

A "Type C" quat refers to an imidazolinium surfactant, while a "Type C" debonder composition refers to a debonder composition which includes Type C quat. A preferred Type C debonder composition includes Type C quat, and anionic surfactant as disclosed in U.S. Pat. No. 6,245,197 blended with nonionic amphiphilic components and other diluents as is disclosed in U.S. Pat. No. 6,969,443. The disclosures of the '197 and '443 patents are incorporated herein by reference in their entireties.

It has been found in accordance with the present invention that elevated wet/dry CD tensile ratios are exhibited when the papermaking fibers are pretreated with a debonder or softener composition prior to their incorporation into the web. In this respect, the present invention may employ debonders including amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures rather than as single compounds. While the following discussion will focus on the predominant surfactant species, it should be understood that commercially available mixtures and compositions would generally be used in practice.

Quasoft 202-JR is a suitable material, which includes surfactant derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10 percent) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

Debonder compositions may include dialkyldimethyl-ammonium salts of the formula:

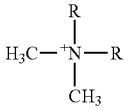

bis-dialkylamidoammonium salts of the formula:

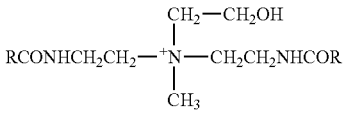

as well as dialkylmethylimidazolinium salts (Type C quats) of the formula:

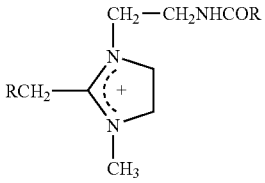

wherein each R may be the same or different and each R indicates a hydrocarbon chain having a chain length of from about twelve to about twenty-two carbon atoms and may be saturated or unsaturated; and wherein said compounds are associated with a suitable anion. One suitable salt is a dialkylimidazolinium compound and the associated anion is methylsulfate. Exemplary quaternary ammonium surfactants include hexamethonium bromide, tetraethylammonium bromide, lauryl trimethylammonium chloride, dihydrogenated tallow dimethylammonium methyl sulfate, oleyl imidazolinium, and so forth.

A nonionic surfactant component such as PEG diols and PEG mono or diesters of fatty acids, and PEG mono or diethers of fatty alcohols may be used as well, either alone or in combination with a quaternary ammonium surfactant. Suitable compounds include the reaction product of a fatty acid or fatty alcohol with ethylene oxide, for example, a polyethylene glycol diester of a fatty acid (PEG diols or PEG diesters). Examples of nonionic surfactants that can be used are polyethylene glycol dioleate, polyethylene glycol dilaurate, polypropylene glycol dioleate, polypropylene glycol dilaurate, polyethylene glycol monooleate, polyethylene glycol monolaurate, polypropylene glycol monooleate and polypropylene glycol monolaurate and so forth. Further details may be found in U.S. Pat. No. 6,969,443 of Bruce Kokko, entitled "Method of Making Absorbent Sheet from Recycle Furnish".

After debonder treatment, the pulp is mixed with strength adjusting agents such as permanent wet strength agents (WSR), optionally dry strength agents and so forth before the sheet is formed. Suitable permanent wet strength agents are known to the skilled artisan. A comprehensive but non-exhaustive list of useful strength aids include urea-formaldehyde resins, melamine formaldehyde resins, glyoxylated polyacrylamide resins, polyamidamine-epihalohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamidamine-epichlorohydrin permanent wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline-Curing Polymeric Amine-Epichlorohydrin by Espy in Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable dry strength agents include starch, guar gum, polyacrylamides, carboxymethyl cellulose (CMC) and the like. Of particular utility is carboxymethyl cellulose, an example of which is sold under the trade name Hercules CMC, by Hercules Incorporated of Wilmington, Del.

In accordance with the invention, regenerated cellulose fiber is prepared from a cellulolsic dope comprising cellulose dissolved in a solvent comprising tertiary amine N-oxides or ionic liquids. The solvent composition for dissolving cellulose and preparing underivatized cellulose dopes suitably includes tertiary amine oxides such as N-methylmorpholine-N-oxide (NMMO) and similar compounds enumerated in U.S. Pat. No. 4,246,221 to McCorsley, the disclosure of which is incorporated herein by reference. Cellulose dopes may contain non-solvents for cellulose such as water, alkanols or other solvents as will be appreciated from the discussion which follows.

Suitable cellulosic dopes are enumerated in Table 1, below.

TABLE 1

EXAMPLES OF TERTIARY AMINE N-OXIDE SOLVENTS

| Tertiary Amine N-oxide | % water | % cellulose |
|---|---|---|
| N-methylmorpholine N-oxide | up to 22 | up to 38 |
| N,N-dimethyl-ethanolamine N-oxide | up to 12.5 | up to 31 |
| N,N-dimethylcyclohexylamine N-oxide | up to 21 | up to 44 |
| N-methylhomopiperidine N-oxide | 5.5-20 | 1-22 |
| N,N,N-triethylamine N-oxide | 7-29 | 5-15 |
| 2(2-hydroxypropoxy)-N-ethyl-N,N,-dimethylamide N-oxide | 5-10 | 2-7.5 |
| N-methylpiperidine N-oxide | up to 17.5 | 5-17.5 |
| N,N-dimethylbenzylamine N-oxide | 5.5-17 | 1-20 |

See, also, U.S. Pat. No. 3,508,945 to Johnson, the disclosure of which is incorporated herein by reference.

Details with respect to preparation of cellulosic dopes including cellulose dissolved in suitable ionic liquids and cellulose regeneration therefrom are found in U.S. patent application Ser. No. 10/256,521; Publication No. US 2003/0157351 of Swatloski et al. entitled "Dissolution and Processing of Cellulose Using Ionic Liquids", the disclosure of which is incorporated herein by reference. Here again, suitable levels of non-solvents for cellulose may be included. There is described generally in this patent application a process for dissolving cellulose in an ionic liquid without derivatization and regenerating the cellulose in a range of structural forms. It is reported that the cellulose solubility and the solution properties can be controlled by the selection of ionic liquid constituents with small cations and halide or pseudohalide anions favoring solution. Preferred ionic liquids for dissolving cellulose include those with cyclic cations such as the following cations: imidazolium; pyridinum; pyridazinium; pyrimidinium; pyrazinium; pyrazolium; oxazolium; 1,2,3-triazolium; 1,2,4-triazolium; thiazolium; piperidinium; pyrrolidinium; quinolinium; and isoquinolinium.

Processing techniques for ionic liquids/cellulose dopes are also discussed in U.S. Pat. No. 6,808,557 to Holbrey et al., entitled "Cellulose Matrix Encapsulation and Method", the disclosure of which is incorporated herein by reference. Note also, U.S. patent application Ser. No. 11/087,496; Publication No. US 2005/0288484 of Holbrey et al., entitled "Polymer Dissolution and Blend Formation in Ionic Liquids", as well as U.S. patent application Ser. No. 10/394,989; Publication No. US 2004/0038031 of Holbrey et al., entitled "Cellulose Matrix Encapsulation and Method", the disclosures of which are incorporated herein by reference. With respect to ionic fluids in general the following documents provide further detail: U.S. patent application Ser. No. 11/406,620, Publication No. US 2006/0241287 of Hecht et al., entitled "Extracting Biopolymers From a Biomass Using Ionic Liquids"; U.S. patent application Ser. No. 11/472,724, Publication No. US 2006/0240727 of Price et al., entitled "Ionic Liquid Based Products and Method of Using The Same"; U.S. patent application Ser. No. 11/472,729; Publication No. US 2006/0240728 of Price et al., entitled "Ionic Liquid Based Products and Method of Using the Same"; U.S. patent application Ser. No. 11/263,391, Publication No. US 2006/0090271 of Price et al., entitled "Processes For Modifying Textiles Using Ionic Liquids"; and U.S. patent application Ser. No. 11/375,963 of Amano et al. (Pub. No. 2006/0207722), the disclosures of which are incorporated herein by reference. Some ionic liquids and quasi-ionic liquids which may be suitable are disclosed by Konig et al., Chem. Commun. 2005, 1170-1172, the disclosure of which is incorporated herein by reference.

"Ionic liquid", refers to a molten composition including an ionic compound that is preferably a stable liquid at temperatures of less than 100° C. at ambient pressure. Typically, such liquids have very low vapor pressure at 100° C., less than 75 mBar or so and preferably less than 50 mBar or less than 25 mBar at 100° C. Most suitable liquids will have a vapor pressure of less than 10 mBar at 100° C. and often the vapor pressure is so low it is negligible and is not easily measurable since it is less than 1 mBar at 100° C.

Suitable commercially available ionic liquids are Basionic™ ionic liquid products available from BASF (Florham Park, N.J.) and are listed in Table 2 below.

TABLE 2

Exemplary Ionic Liquids

| IL Abbreviation | Basionic ™ Grade | Product name | CAS Number |
|---|---|---|---|
| | | STANDARD | |
| EMIM Cl | ST 80 | 1-Ethyl-3-methylimidazolium chloride | 65039-09-0 |
| EMIM $CH_3SO_3$ | ST 35 | 1-Ethyl-3-methylimidazolium methanesulfonate | 145022-45-3 |
| BMIM Cl | ST 70 | 1-Butyl-3-methylimidazolium chloride | 79917-90-1 |
| BMIM $CH_3SO_3$ | ST 78 | 1-Butyl-3-methylimidazolium methanesulfonate | 342789-81-5 |
| MTBS | ST 62 | Methyl-tri-n-butylammonium methylsulfate | 13106-24-6 |
| MMMPZ $MeOSO_3$ | ST 33 | 1,2,4-Trimethylpyrazolium methylsulfate | |
| EMMIM $EtOSO_3$ | ST 67 | 1-Ethyl-2,3-di-methylimidazolium ethylsulfate | 516474-08-01 |
| MMMIM $MeOSO_3$ | ST 99 | 1,2,3-Trimethyl-imidazolium methylsulfate | 65086-12-6 |
| | | ACIDIC | |
| HMIM Cl | AC 75 | Methylimidazolium chloride | 35487-17-3 |
| HMIM $HSO_4$ | AC 39 | Methylimidazolium hydrogensulfate | 681281-87-8 |
| EMIM $HSO_4$ | AC 25 | 1-Ethyl-3-methylimidazolium hydrogensulfate | 412009-61-1 |
| EMIM $AlCl_4$ | AC 09 | 1-Ethyl-3-methylimidazolium tetrachloroaluminate | 80432-05-9 |
| BMIM $HSO_{4<}$/ | AC 28 | 1-Butyl-3-methylimidazolium hydrogensulfate | 262297-13-2 |
| BMIM $AlCl_4$ | AC 01 | 1-Butyl-3-methylimidazolium tetrachloroaluminate | 80432-09-3 |
| | | BASIC | |
| EMIM Acetat | BC 01 | 1-Ethyl-3-methylimidazolium acetate | 143314-17-4 |
| BMIM Acetat | BC 02 | 1-Butyl-3-methylimidazolium acetate | 284049-75-8 |

TABLE 2-continued

| Exemplary Ionic Liquids | | | |
|---|---|---|---|
| IL Abbreviation | Basionic ™ Grade | Product name | CAS Number |
| | | LIQUID AT RT | |
| EMIM $EtOSO_3$ | LQ 01 | 1-Ethyl-3-methylimidazolium ethylsulfate | 342573-75-5 |
| BMIM $MeOSO_3$ | LQ 02 | 1-Butyl-3-methylimidazolium methylsulfate | 401788-98-5 |
| | | LOW VISCOSITY | |
| EMIM SCN | VS 01 | 1-Ethyl-3-methylimidazolium thiocyanate | 331717-63-6 |
| BMIM SCN | VS 02 | 1-Butyl-3-methylimidazolium thiocyanate | 344790-87-0 |
| | | FUNCTIONALIZED | |
| COL Acetate | FS 85 | Choline acetate | 14586-35-7 |
| COL Salicylate | FS 65 | Choline salicylate | 2016-36-6 |
| MTEOA $MeOSO_3$ | FS 01 | Tris-(2-hydroxyethyl)-methylammonium methylsulfate | 29463-06-7 |

Cellulose dopes including ionic liquids having dissolved therein about 5% by weight underivatized cellulose are commercially available from Aldrich. These compositions utilize alkyl-methylimidazolium acetate as the solvent. It has been found that choline-based ionic liquids are not particularly suitable for dissolving cellulose.

After the cellulosic dope is prepared, it is spun into fiber, fibrillated and incorporated into absorbent sheet as hereinafter described.

This invention pertains generally, in part, to improving furnish properties with cellulose microfibers in order to improve softness, bulk, and absorbency while maintaining or improving strength. A synthetic cellulose such as lyocell is split into micro- and nano-fibers and added to conventional wood pulp at a relatively low level, on the order of 10%. The beneficial features of fibrillated lyocell include: biodegradability, hydrogen bonding, dispersibility, repulpability, and smaller microfibers than obtainable with meltspun fibers, for example.

Fibrillated lyocell or its equivalent has advantages over splittable meltspun fibers. Synthetic microdenier fibers come in a variety of forms. For example, a 3 denier nylon/PET fiber in a so-called pie wedge configuration can be split into 16 or 32 segments, typically in a hydroentangling process. Each segment of a 16-segment fiber would have a coarseness of about 2 mg/100 m versus eucalyptus pulp at about 7 mg/100 m. Unfortunately, a number of deficiencies have been identified with this approach for conventional wet laid applications. Dispersibility is less than optimal. Melt spun fibers must be split before sheet formation, and an efficient method is lacking. Most available polymers for these fibers are not biodegradable. The coarseness is lower than wood pulp, but still high enough that they must be used in substantial amounts and form a costly part of the furnish. Finally, the lack of hydrogen bonding requires other methods of retaining the fibers in the sheet.

Fibrillated lyocell has fibrils that can be as small as 0.1-0.25 microns (μm) in diameter, translating to a coarseness of 0.0013-0.0079 mg/100 m. Assuming these fibrils are available as individual strands—separate from the parent fiber—the furnish fiber population can be dramatically increased at a very low addition rate. Even fibrils not separated from the parent fiber may provide benefit. Dispersibility, repulpability, hydrogen bonding, and biodegradability remain product attributes since the fibrils are cellulose.

Fibrils from lyocell fiber have important distinctions from wood pulp fibrils. The most important distinction is the length of the lyocell fibrils. Wood pulp fibrils are only perhaps microns long, and therefore act in the immediate area of a fiber-fiber bond. Wood pulp fibrillation from refining leads to stronger, denser sheets. Lyocell fibrils, however, are potentially as long as the parent fibers. These fibrils can act as independent fibers and improve the bulk while maintaining or improving strength. Southern pine and mixed southern hardwood (MSHW) are two examples of fibers that are disadvantaged relative to premium pulps with respect to softness. The term "premium pulps" used herein refers to northern softwoods and eucalyptus pulps commonly used in the tissue industry for producing the softest bath, facial, and towel grades. Southern pine is coarser than northern softwood kraft, and mixed southern hardwood is both coarser and higher in fines than market eucalyptus. The lower coarseness and lower fines content of premium market pulp leads to a higher fiber population, expressed as fibers per gram (N or $N_{i>0.2}$) in Table 1. The coarseness and length values in Table 1 were obtained with an OpTest Fiber Quality Analyzer. Definitions are as follows:

$$L_n = \frac{\sum_{all\ fibers} n_i L_i}{\sum_{all\ fibers} n_i}$$

$$L_{n,i>0.2} = \frac{\sum_{i>0.2} n_i L_i}{\sum_{i>0.2} n_i}$$

$$C = 10^5 \times \frac{sampleweight}{\sum_{all\ fibers} n_i L_i}$$

$$N = \frac{100}{CL}[\ =\ ]\ \text{millionfibers/gram}$$

Northern bleached softwood Kraft (NBSK) and eucalyptus have more fibers per gram than southern pine and hardwood. Lower coarseness leads to higher fiber populations and smoother sheets.

TABLE 3

| Fiber Properties | | | | | | | |
|---|---|---|---|---|---|---|---|
| Sample | Type | C, mg/100 m | Fines, % | $L_{n,mm}$ | N, MM/g | $L_{n,l>0.2,mm}$ | $N_{l>0.2}$, MM/g |
| Southern HW | Pulp | 10.1 | 21 | 0.28 | 35 | 0.91 | 11 |
| Southern HW - low fines | Pulp | 10.1 | 7 | 0.54 | 18 | 0.94 | 11 |
| Aracruz Eucalyptus | Pulp | 6.9 | 5 | 0.50 | 29 | 0.72 | 20 |
| Southern SW | Pulp | 18.7 | 9 | 0.60 | 9 | 1.57 | 3 |
| Northern SW | Pulp | 14.2 | 3 | 1.24 | 6 | 1.74 | 4 |
| Southern (30 SW/70 HW) | Base sheet | 11.0 | 18 | 0.31 | 29 | 0.93 | 10 |
| 30 Southern SW/70 Eucalyptus | Base sheet | 8.3 | 7 | 0.47 | 26 | 0.77 | 16 |

For comparison, the "parent" or "stock" fibers of lyocell have a coarseness 16.6 mg/100 m before fibrillation and a diameter of about 11-12 μm. The fibrils have a coarseness on the order of 0.001-0.008 mg/100 m. Thus, the fiber population can be dramatically increased at relatively low addition rates. Fiber length of the parent fiber is selectable, and fiber length of the fibrils can depend on the starting length and the degree of cutting during the fibrillation process.

In its various aspects, the present invention is directed, in part, to an absorbent paper sheet for tissue or towel comprising from about 99 percent to about 70 percent by weight of cellulosic pulp-derived papermaking fiber and from about 1 percent to about 30 percent by weight fibrillated regenerated cellulose microfiber having a CSF value of less than 175 ml, the papermaking fiber being arranged in a fibrous matrix and the lyocell microfiber being sized and distributed in the fiber matrix to form a microfiber network therein. Fibrillation of the microfiber is controlled such that it has a reduced coarseness and a reduced freeness as compared with regenerated cellulose microfiber from which it is made, such that the microfiber network provides at least one of the following attributes to the absorbent sheet: (a) the absorbent sheet exhibits an elevated SAT value and an elevated wet tensile value as compared with a like sheet prepared without regenerated cellulose microfiber; (b) the absorbent sheet exhibits an elevated wet/dry CD tensile ratio as compared with a like sheet prepared without regenerated cellulose microfiber; (c) the absorbent sheet exhibits a lower GM Break Modulus than a like sheet having like tensile values prepared without regenerated cellulose microfiber; or (d) the absorbent sheet exhibits an elevated bulk as compared with a like sheet having like tensile values prepared without regenerated cellulose microfiber. Typically, the absorbent sheet exhibits a wet/dry tensile ratio at least 25 percent higher than that of a like sheet prepared without regenerated cellulose microfiber; commonly the absorbent sheet exhibits a wet/dry tensile ratio at least 50 percent higher than that of a like sheet prepared without regenerated cellulose microfiber. In some cases, the absorbent sheet exhibits a wet/dry tensile ratio at least 100 percent higher than that of a like sheet prepared without regenerated cellulose microfiber.

In some embodiments, the absorbent sheet of the invention exhibits a GM Break Modulus at least 20 percent lower than a like sheet having like tensile values prepared without regenerated cellulose microfiber and the absorbent sheet exhibits a specific bulk at least 5% higher than a like sheet having like tensile values prepared without regenerated cellulose microfiber. A specific bulk at least 10% higher than a like sheet having like tensile values prepared without regenerated cellulose microfiber is readily achieved.

One series of preferred embodiments has from about 5 percent by weight to about 15 percent by weight regenerated cellulose microfiber, wherein the regenerated cellulose microfiber has a CSF value of less than 150 ml. More typically, the regenerated cellulose microfiber has a CSF value of less than 100 ml; but a CSF value of less than 50 ml or 25 ml is preferred in many cases. Regenerated cellulose microfiber having a CSF value of 0 ml is likewise employed. While any suitable size microfiber may be used, the regenerated cellulose microfiber typically has a number average diameter of less than about 2.0 microns, such as from about 0.1 to about 2 microns. The regenerated cellulose microfiber may have a coarseness value of less than about 0.5 mg/100 m; from about 0.001 mg/100 m to about 0.2 mg/100 m in many cases. The product generally has a basis weight of from about 5 lbs per 3,000 square foot ream to about 40 lbs per 3,000 square foot ream. For towel, base sheet may have a basis weight of from about 15 lbs per 3,000 square foot ream to about 35 lbs per 3,000 square foot ream and the pulp-derived papermaking fiber comprises predominantly softwood fiber, usually predominantly southern softwood Kraft fiber and at least 20 percent by weight of pulp-derived papermaking fiber of hardwood fiber.

In another aspect of the invention, there is provided an absorbent paper sheet for tissue or towel comprising from about 99 percent to about 70 percent by weight of pulp-derived papermaking fiber and from about 1 percent to about 30 percent by weight regenerated cellulose microfiber having a CSF value of less than 100 ml, wherein the absorbent sheet has an absorbency of at least about 4 g/g. Absorbencies of at least about 4.5 g/g; at least about 5 g/g; or at least about 7.5 g/g are sometimes preferred. In many cases the absorbent sheet has an absorbency of from about 6 g/g to about 9.5 g/g.

Another product of the invention is an absorbent paper sheet for tissue or towel comprising from about 99 percent to about 70 or 65 percent by weight of pulp-derived papermaking fiber and from about 1 to about 30 or 35 percent by weight of regenerated cellulose microfiber having a CSF value of less than 100 ml, wherein the regenerated cellulose microfiber has a fiber count greater than 50 million fibers/gram. The regenerated cellulose microfiber may have a weight average diameter of less than 2 microns, a weight average length of less than 500 microns and a fiber count of greater than 400 million fibers/gram; or the regenerated cellulose microfiber has a weight average diameter of less than 1 micron, a weight average length of less than 400 microns and a fiber count of greater than 2 billion fibers/gram. In one embodiment, the regenerated cellulose microfiber has a weight average diameter of less than 0.5 microns, a weight average length of less than 300 microns and a fiber count of greater than 10 billion fibers/gram, and in another, the regenerated cellulose microfiber has a weight average diameter of less than 0.25 microns, a weight average length of less than 200 microns and a fiber count of greater than 50 billion fibers/gram. A fiber count greater than 200 billion fibers/gram is available, if so desired.

In yet another aspect of the invention, an absorbent sheet for tissue comprising at least about 75 percent by weight pulp-derived papermaking fiber wherein hardwood fiber is the predominant pulp-derived papermaking fiber and from about 1 percent to about 25 percent by weight regenerated cellulose microfiber having a CSF value of less than 100 ml is provided. This product may have a basis weight of less than about 15 lbs per 3,000 square foot ream such as from about 7 lbs per 3000 square foot ream to about 13 lbs per 3000 square foot ream. The sheet may include at least about 75 percent by weight of a mixture of hardwood and softwood pulp-derived papermaking fiber. A preferred hardwood fiber is southern hardwood Kraft fiber. In one embodiment, the pulp-derived papermaking fiber comprises at least about 20 percent by weight pulp-derived papermaking fiber of softwood fiber (exclusive of lyocell content). Preferably, the tissue sheet exhibits elevated GM tensile strength as compared with a like sheet made without regenerated cellulose microfiber, such as where the tissue sheet exhibits a GM tensile strength at least about 20, 30 or 40 percent higher than a like sheet of like basis weight made without regenerated cellulose microfiber. So also, the tissue sheet exhibits increased MD and CD stretch as compared with a like sheet made without regenerated cellulose microfiber. In one embodiment, the tissue sheet exhibits a CD stretch of at least 5 percent.

Another aspect of the invention provides a base sheet for tissue comprising pulp-derived papermaking fiber which is predominantly hardwood fiber and from about 5 to about 35 percent by weight regenerated cellulose microfiber, wherein the base sheet exhibits at least about 20% more GM tensile than a like sheet of like basis weight and like softness prepared without regenerated cellulose fiber. This sheet typically has a basis weight of from about 4 to about 12 lbs per 3000 square foot ream, such as a basis weight of from about 5 to about 8 lbs per 3000 square foot ream or about 5 to about 7 lbs per 3000 square foot ream.

Also provided is a base sheet for tissue comprising pulp-derived papermaking fiber which is predominantly hardwood fiber, the base sheet exhibiting a GM tensile of greater than 300 g/3" and a basis weight of from about 4 lbs per 3000 square foot ream to about 10 lbs per 3000 square foot ream, said base sheet including from about 1 to about 30 or about 35 percent by weight fibrillated regenerated cellulose microfiber having more than 400 million fibrils per gram.

Still yet another aspect of the invention provides an absorbent cellulosic sheet, comprising: (a) cellulosic pulp-derived papermaking fibers in an amount of from about 70% up to about 98% by weight; and (b) fibrillated regenerated cellulose fibers in an amount of from about 30% to about 2% by weight, said regenerated cellulose fibers having a number average fibril width of less than about 4 μm. The number average fibril width may be less than about 2 μm; less than about 1 μm; or less than about 0.5 μm. The number average fiber length of the regenerated cellulose fibers may be less than about 500 micrometers; less than about 250 micrometers; less than about 150 micrometers; less than about 100 micrometers; or the number average fiber length of the lyocell fibers is less than about 75 micrometers, if so desired.

Another product of the invention is an absorbent cellulosic sheet, comprising: (a) cellulosic pulp-derived papermaking fibers in an amount of from about 70% up to about 98% by weight; and (b) fibrillated regenerated cellulose fibers in an amount of from about 30% to about 2% by weight, said regenerated cellulose fibers having a number average fibril length of less than about 500 μm.

Still another product is an absorbent cellulosic sheet, comprising: (a) cellulosic pulp-derived papermaking fibers in an amount of from about 70% up to about 99% by weight, the southern softwood content of the cellulosic pulp-derived papermaking fibers in the absorbent cellulosic sheet being at least about 60% by weight of pulp-derived papermaking fiber exclusive of regenerated cellulose content; and (b) fibrillated regenerated cellulose fibers in an amount of from about 30% to about 1% by weight, said regenerated cellulose fibers having a number average fibril length of less than about 500 μm, said absorbent cellulosic sheet exhibiting a TAPPI opacity of more than 55 opacity units. The sheet may exhibit a TAPPI opacity of more than 60 opacity units or a TAPPI opacity of more than 63 opacity units. In some embodiments, the sheet has a basis weight of less than 8 lbs/3000 square feet ream and a normalized TAPPI opacity of greater than 6 TAPPI opacity units per pound of basis weight. In still other cases, such sheet exhibits a normalized basis weight of greater than 6.5 TAPPI opacity units per pound of basis weight. The gain in opacity is particularly useful in connection with recycle fiber, for example, where the sheet is mostly recycle fiber. Tissue base sheets which have a basis weight of from about 9 lbs to about 11 lbs/ream made of recycle fiber typically exhibit a normalized opacity of greater than 5 TAPPI opacity units per pound of basis weight. The products noted below optionally have the foregoing opacity characteristics.

Still yet another product is an absorbent cellulosic sheet, comprising: (a) cellulosic pulp-derived papermaking fibers in an amount of from about 70% up to about 99% by weight, the southern softwood content of the cellulosic pulp-derived papermaking fibers in the absorbent cellulosic sheet being at least about 60% by weight of pulp-derived papermaking fiber exclusive of regenerated cellulose content; and (b) fibrillated regenerated cellulose fibers in an amount of from about 30% to about 1% by weight, said regenerated cellulose fibers having a number average fibril width of less than about 4 μm.

A further product which may be made in accordance with the invention is an absorbent cellulosic sheet, comprising: (a) cellulosic pulp-derived papermaking fibers in an amount of from about 70% up to about 99% by weight, the southern softwood content of the cellulosic pulp-derived papermaking fibers in the absorbent cellulosic sheet being at least about 60% by weight of pulp-derived papermaking fiber exclusive of regenerated cellulose content; and (b) fibrillated regenerated cellulose fibers in an amount of from about 30% to about 1% by weight, said lyocell fibers exhibiting a fiber population of greater than about 35,000,000 fibers/g. The regenerated cellulose may exhibit a fiber population of greater than 50 million fibers/g; a fiber population of greater than 100 million fibers/g; a fiber population of greater than 500 million fibers/g; or a fiber population of greater than 10 billion fibers/g.

A still further product of the invention is an absorbent cellulosic sheet, comprising: (a) cellulosic pulp-derived papermaking fibers in an amount of from about 70% up to about 99% by weight, the southern softwood content of the cellulosic pulp-derived papermaking fibers in the absorbent cellulosic sheet being at least about 60% by weight of pulp-derived papermaking fiber exclusive of regenerated cellulose content; and (b) fibrillated regenerated cellulose fibers in an amount of from about 30% to about 1% by weight, said regenerated cellulose fibers exhibiting a fiber population of greater than about 35,000,000 fibers/g. This product and the others may have a breaking length of at least 0.91 km; a breaking length of at least 0.92 km; a breaking length of at least 0.95 km; or a breaking length of at least 0.97 km.

Yet another product of the invention is an absorbent cellulosic sheet, comprising: (a) cellulosic pulp-derived papermaking fibers in an amount of from about 70% up to about 99% by weight, the southern softwood content of the cellulosic pulp-derived papermaking fibers in the absorbent cellulosic sheet being at least about 60% by weight of pulp-derived papermaking fiber exclusive of regenerated cellulose content;

and (b) fibrillated regenerated cellulose fibers in an amount of from about 30% to about 1% by weight, said regenerated cellulose fibers having a number average fibril length of less than about 500 μm, said absorbent cellulosic sheet exhibiting a breaking length of at least 0.9 km.

Still yet another product of the invention is an absorbent cellulosic sheet, comprising: (a) cellulosic pulp-derived papermaking fibers in an amount of from about 70% up to about 99% by weight, the southern softwood content of the cellulosic pulp-derived papermaking fibers in the absorbent cellulosic sheet being at least about 60% by weight of pulp-derived papermaking fiber exclusive of regenerated cellulose content; and (b) fibrillated regenerated cellulose fibers in an amount of from about 30% to about 1% by weight, said regenerated cellulose fibers having a number average fibril width of less than about 4 μm, said absorbent cellulosic sheet exhibiting a breaking length of at least 0.9 km.

It has been found that the products of the invention exhibit unusually high wet/dry CD tensile ratios when the pulp-derived papermaking fibers are pretreated with a debonder composition. Wet/dry ratios of greater than 30%, i.e. about 35% or greater are readily achieved; generally between about 35% and 60%. Ratios of at least about 40% or at least about 45% are seen in the examples which follow. The pulp is preferably treated at high consistency, i.e. greater than 2%; preferably greater than 3 or 4% and generally between 3-8% upstream of a machine chest, in a pulper for example. The pulp-derived papermaking fibers, or at least a portion of the pulp-derived papermaking fibers may be pretreated with debonder during pulping, for example. All or some of the fibers may be pretreated; 50%, 75%, and up to 100% by weight of the pulp-derived fiber may be pretreated, including or excluding regenerated cellulose content where pretreatment may not be critical. Thereafter, the fiber may be refined, in a disk refiner as is known. So also, a dry and/or wet strength resin may be employed. Treatment of the pulp-derived fiber may be with from about 1 to about 50 pounds of debonder composition per ton of pulp-derived fiber (dry basis). From about 5-30 or 10-20 pounds of debonder per ton of pulp-derived fiber is suitable in most cases.

Pretreatment may be carried out for any suitable length of time, for example, at least 20 minutes, at least 45 minutes or at least 2 hours. Generally pretreatment will be for a time between 20 minutes and 48 hours. Pretreatment time is calculated as the amount of time aqueous pulp-derived papermaking fiber is in contact with aqueous debonder prior to forming the nascent web. Wet and dry strength resins are added in suitable amounts; for example, either or both may be added in amounts of from 2.5 to 40 lbs per ton of pulp-derived papermaking fiber in the sheet.

The present invention also includes production methods such as a method of making absorbent cellulosic sheet comprising: (a) preparing an aqueous furnish with a fiber mixture including from about 99 percent to about 70 percent of a pulp-derived papermaking fiber, the fiber mixture also including from about 1 to 30 percent by weight of regenerated cellulose microfibers having a CSF value of less than 175 ml; (b) depositing the aqueous furnish on a foraminous support to form a nascent web and at least partially dewatering the nascent web; and (c) drying the web to provide absorbent sheet. Typically, the aqueous furnish has a consistency of 2 percent or less; even more typically, the aqueous furnish has a consistency of 1 percent or less. The nascent web may be compactively dewatered with a papermaking felt and applied to a Yankee dryer and creped therefrom. Alternatively, the compactively dewatered web is applied to a rotating cylinder and fabric-creped therefrom or the nascent web is at least partially dewatered by throughdrying or the nascent web is at least partially dewatered by impingement air drying. In many cases fiber mixture includes southern softwood Kraft and southern hardwood Kraft.

Another method of making base sheet for tissue of the invention includes: (a) preparing an aqueous furnish comprising southern hardwood fiber and fibrillated regenerated cellulose microfiber having a CSF value of less than 100 ml and a fibril count of more than 400 million fibrils per gram; (b) depositing the aqueous furnish on a foraminous support to form a nascent web and at least partially dewatering the nascent web; and (c) drying the web to provide absorbent sheet. The fibrillated regenerated cellulose fiber may have a fibril count of more than 1 billion fibrils per gram or the fibrillated regenerated cellulose fiber has a fibril count of more than 100 billion fibrils per gram, as is desired.

The invention is further illustrated in the following Examples.

Example 1

Figure 2:
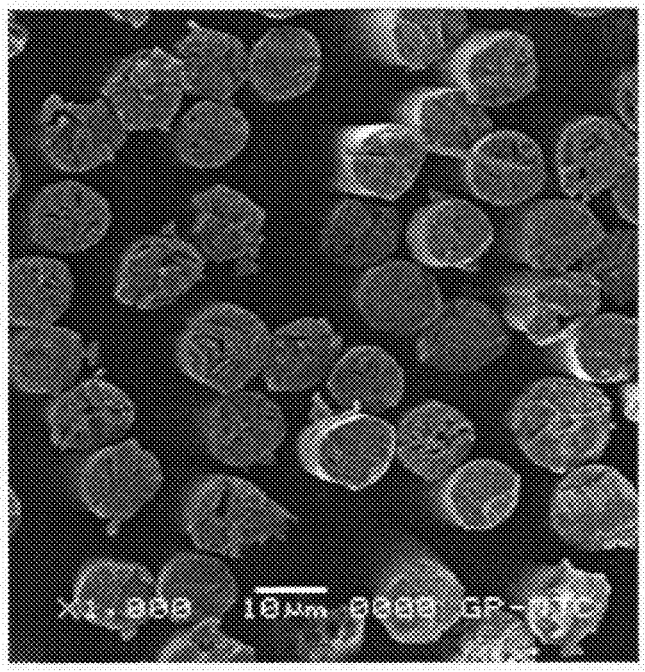
FIG. 2 is a photomicrograph of 1.5 denier unrefined regenerated cellulose fiber having a coarseness of 16.7 mg/100 m.
Figure 3:
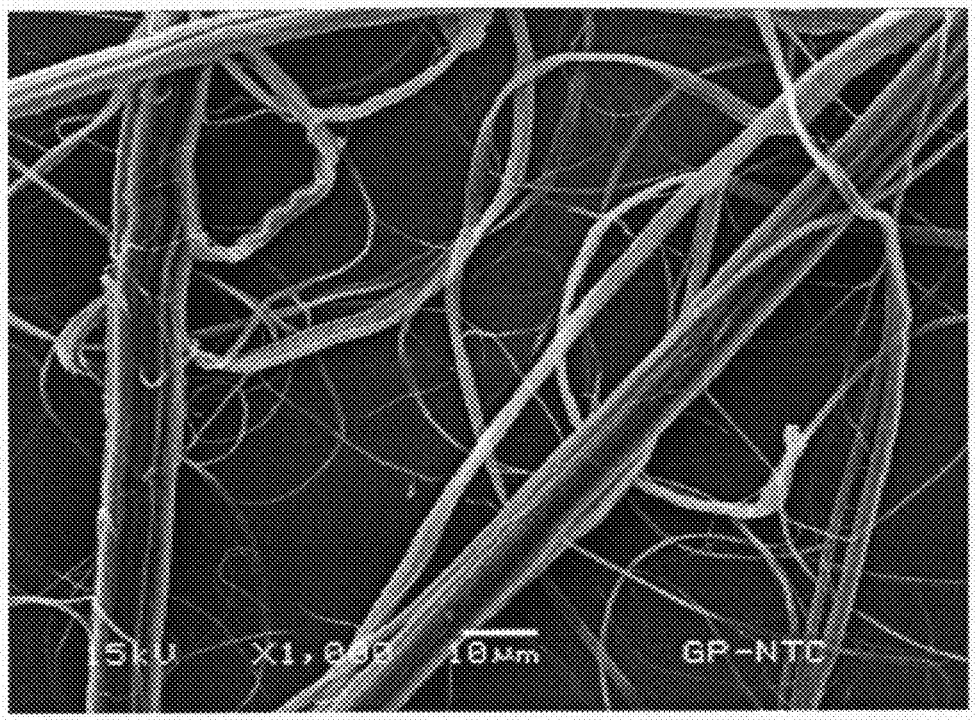
FIG. 3 is a photomicrograph of 14 mesh refined regenerated cellulose fiber.
Figure 4:
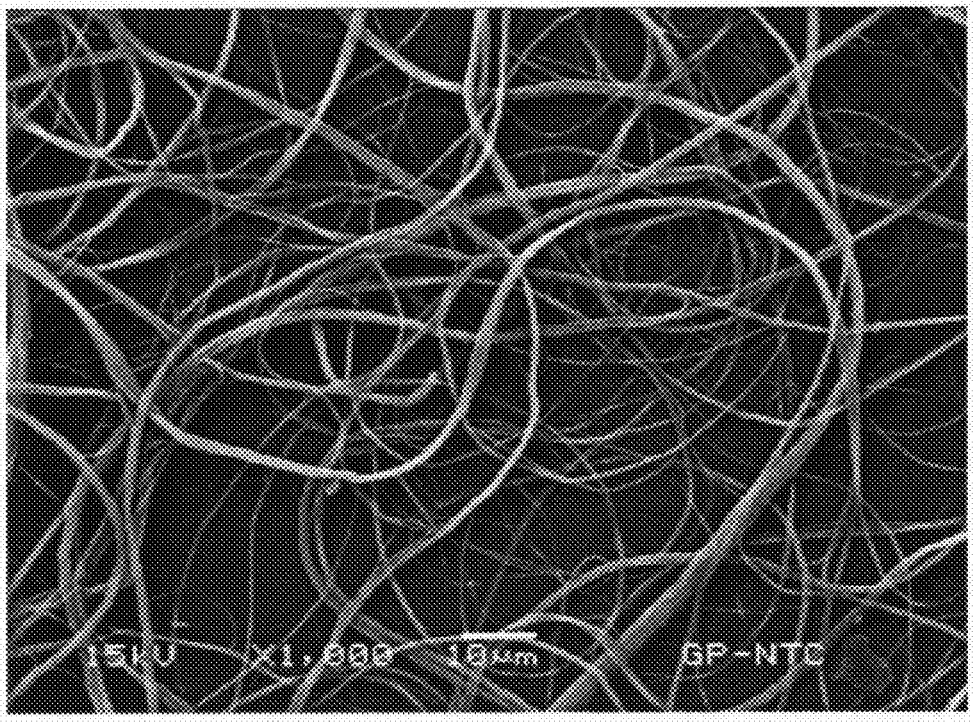
FIG. 4 is a photomicrograph of 200 mesh refined regenerated cellulose fiber.
Figure 5:
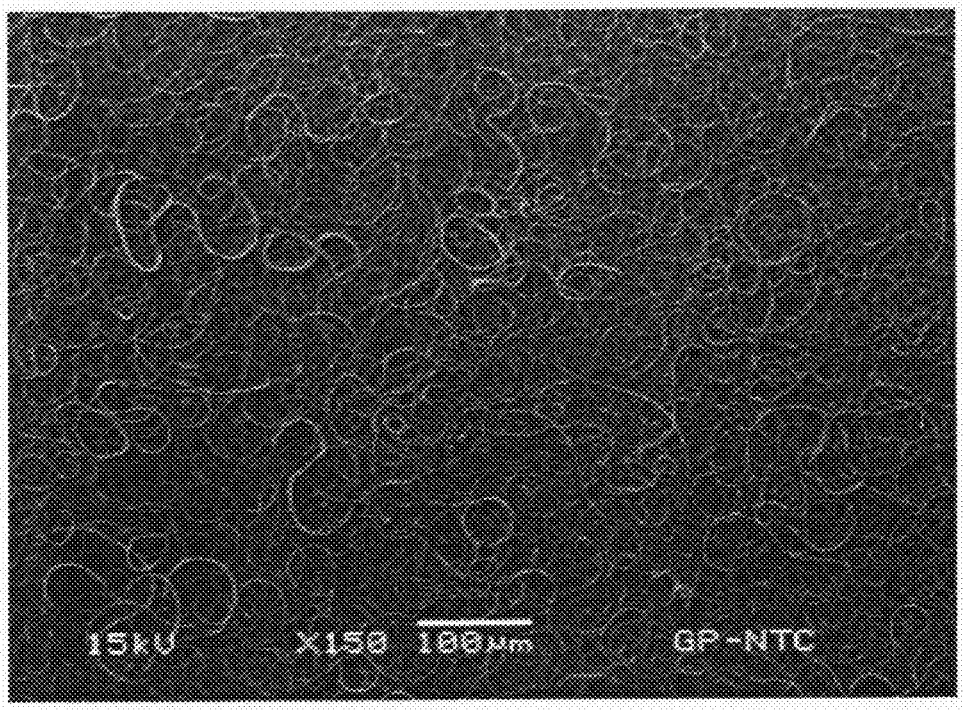
FIGS. 5-9 are photomicrographs at increasing magnification of fibrillated regenerated cellulose microfiber which passed through a 200 mesh screen of a Bauer-McNett classifier.
Figure 6:
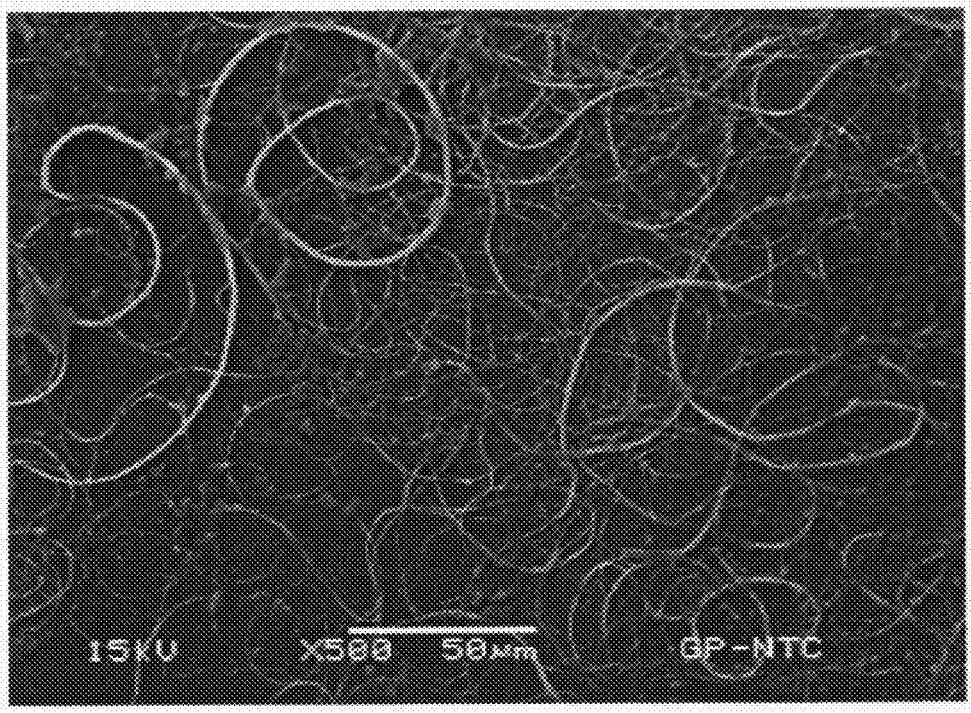
Figure 7:
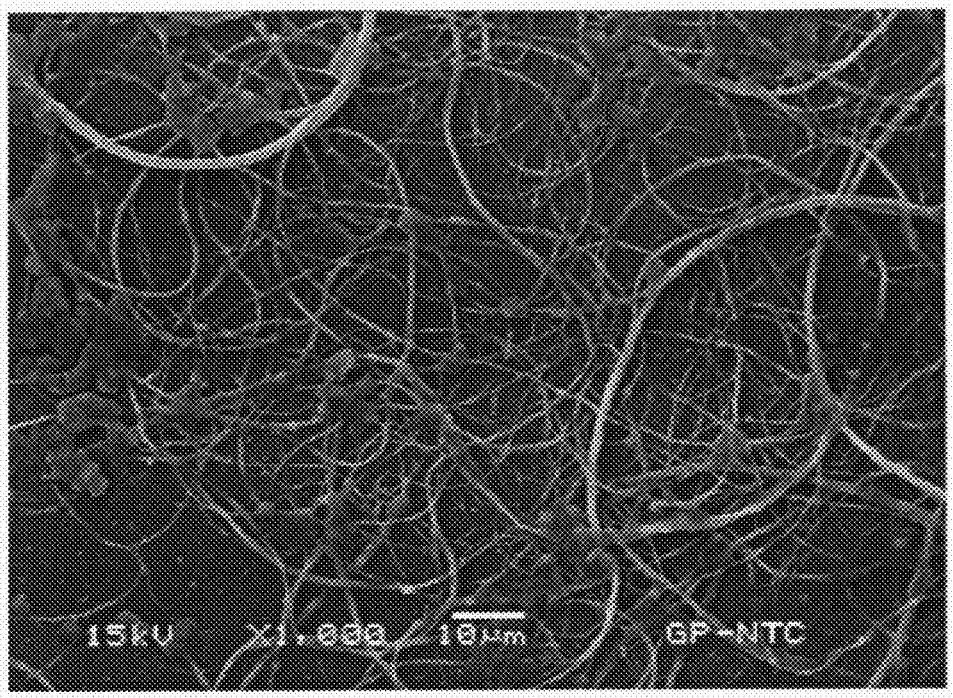
Figure 8:
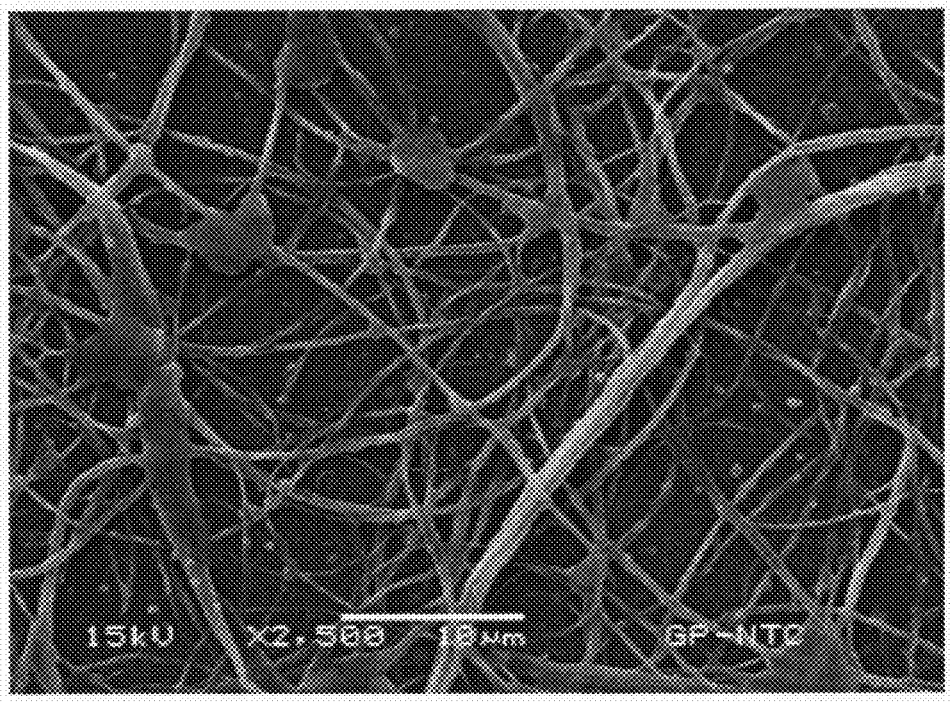
Figure 9:
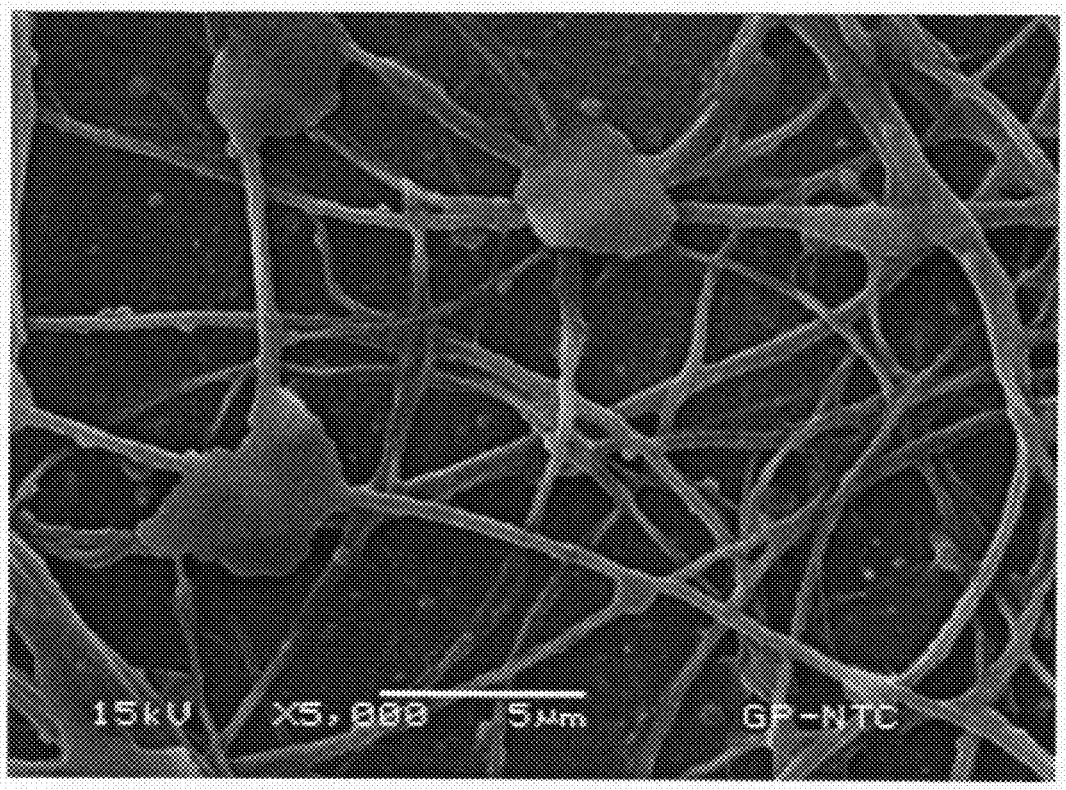

A hand sheet study was conducted with southern softwood and fibrillated lyocell fiber. The stock lyocell fiber was 1.5 denier (16.6 mg/100 m) by 4 mm in length, FIG. 2, which was then fibrillated until the freeness was <50 CSF. It is seen in FIGS. 3 and 4 that the fibrillated fiber has a much lower coarseness than the stock fiber. There is shown in FIGS. 5-9 photomicrographs of fibrillated lyocell material which passed through the 200 mesh screen of a Bauer McNett classifier. This material is normally called "fines". In wood pulp, fines are mostly particulate rather than fibrous. The fibrous nature of this material should allow it to bridge across multiple fibers and therfore contribute to network strength. This material makes up a substantial amount (16-29%) of the 40 csf fibrillated Lyocell.

The dimensions of the fibers passing the 200 mesh screen are on the order of 0.2 micron by 100 micron long. Using these dimensions, one calculates a fiber population of 200 billion fibers per gram. For perspective, southern pine might be three million fibers per gram and eucalyptus might be twenty million fibers per gram (Table 1). Comparing the fine fraction with the 14 mesh pictures, it appears that these fibers are the fibrils that are broken away from the original unrefined fibers. Different fiber shapes with lyocell intended to readily fibrillate could result in 0.2 micron diameter fibers that are perhaps 1000 microns or more long instead of 100.

One aspect of the invention is to enhance southern furnish performance, but other applications are evident: elevate premium tissue softness still higher at a given strength, enhance secondary fiber for softness, improve towel hand feel, increase towel wet strength, and improve SAT.

Figure 10:
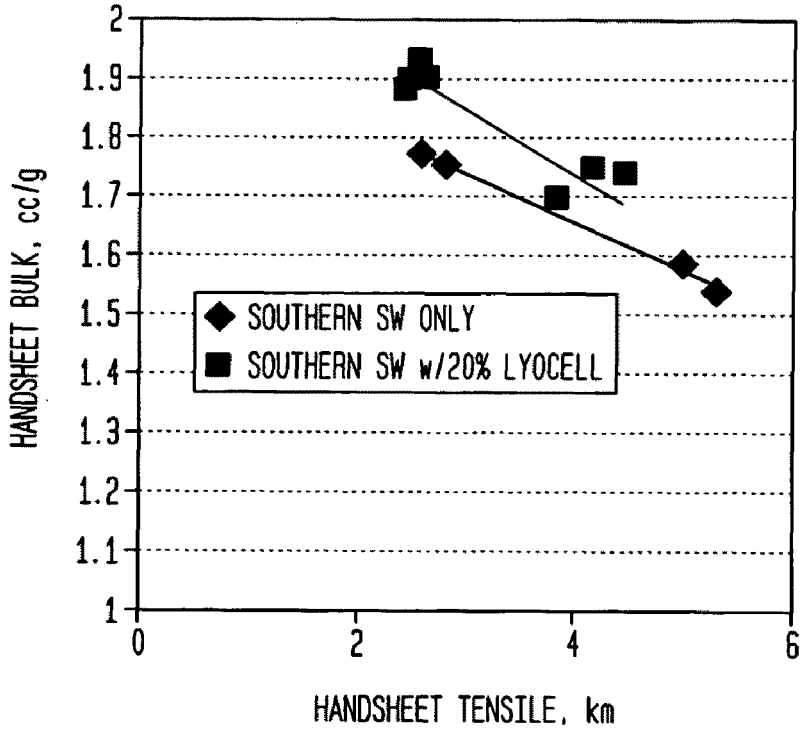

FIGS. 10-15 show the impact of fibrillated lyocell on hand sheet properties. Bulk, opacity, smoothness, modulus, and tear improve at a given tensile level. Results are compared as a function of tensile since strength is always an important variable in tissue products. Also, Kraft wood pulp tends to fall on similar curves for a given variable, so it is desirable to shift to a new curve to impact finished product properties. Fibrillated lyocell shifts the bulk/strength curve favorably (FIG. 10). Some of the microfibers may nest in the voids between the much larger softwood fibers, but the overall result is the lyocell interspersed between softwood fibers with a net increase in bulk.

Figure 11:
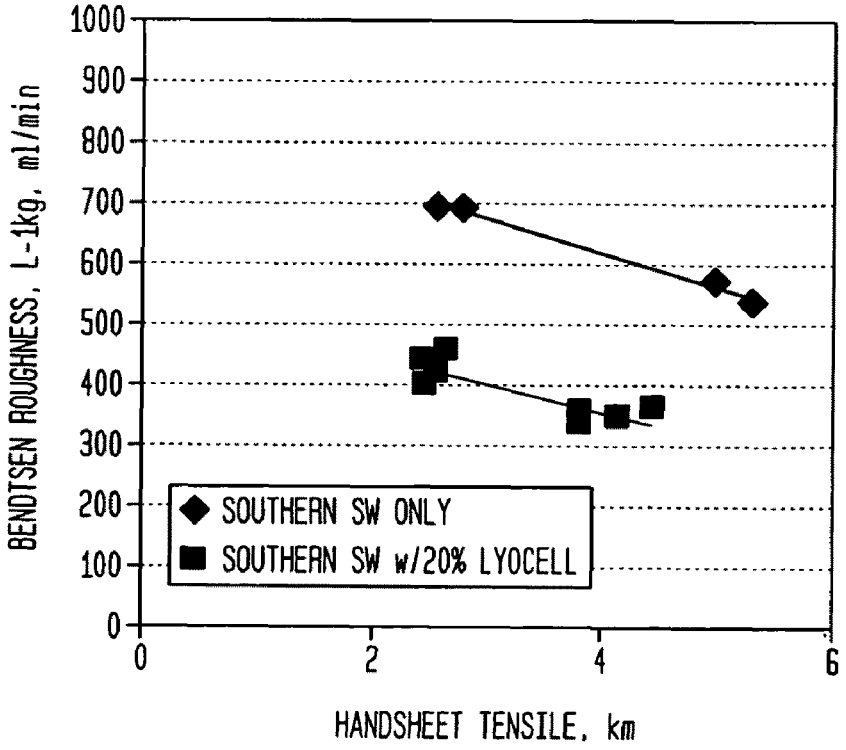

Fibrillated lyocell helps smoothness as measured by Bendtsen roughness (FIG. 11). Bendtsen roughness is obtained by measuring the air flow between a weighted platten and a paper sample. Smoother sheets permit less air flow.

The small fibers can fill in some of the surface voids that would otherwise be present on a 100% softwood sheet. The smoothness impact on an uncreped hand sheet should persist even after the creping process.

Figure 12:
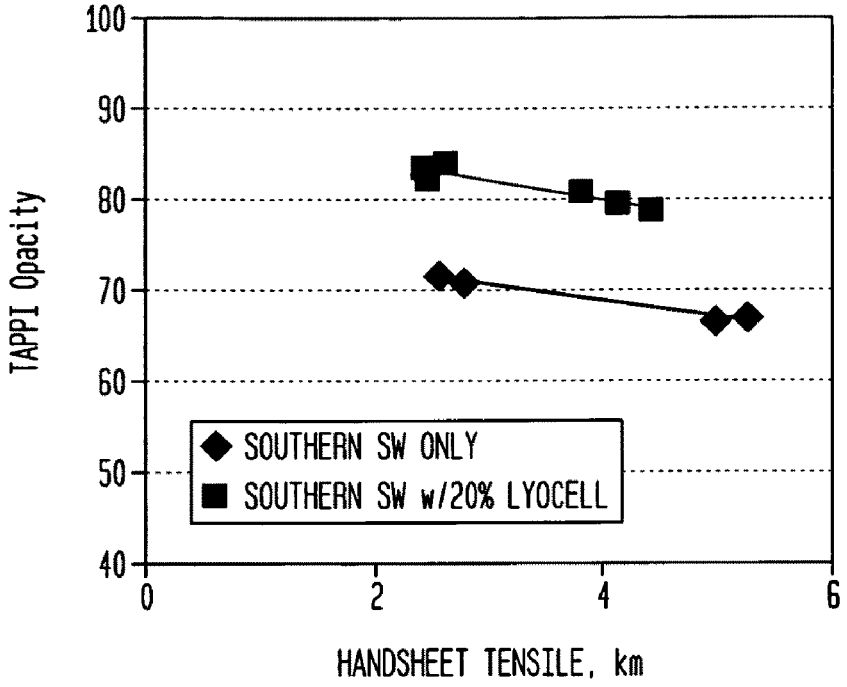

Opacity is another variable improved by the lyocell (FIG. 12). The large quantity of microfibers creates tremendous surface area for light scattering. Low 80's for opacity is equivalent to 100% eucalyptus sheets, so obtaining this opacity with 80% southern softwood is significant.

Figure 13:
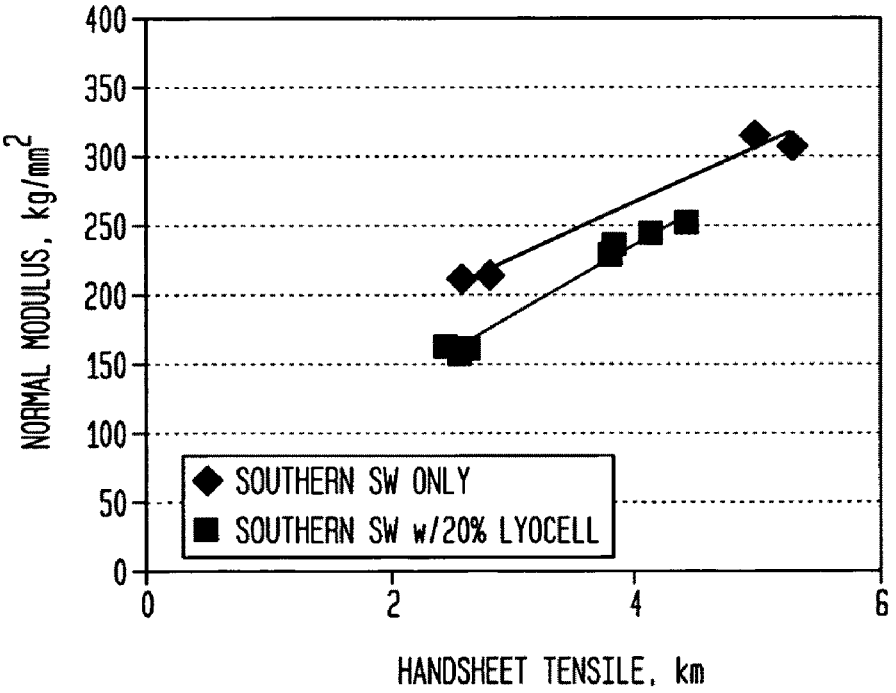
Figure 14:
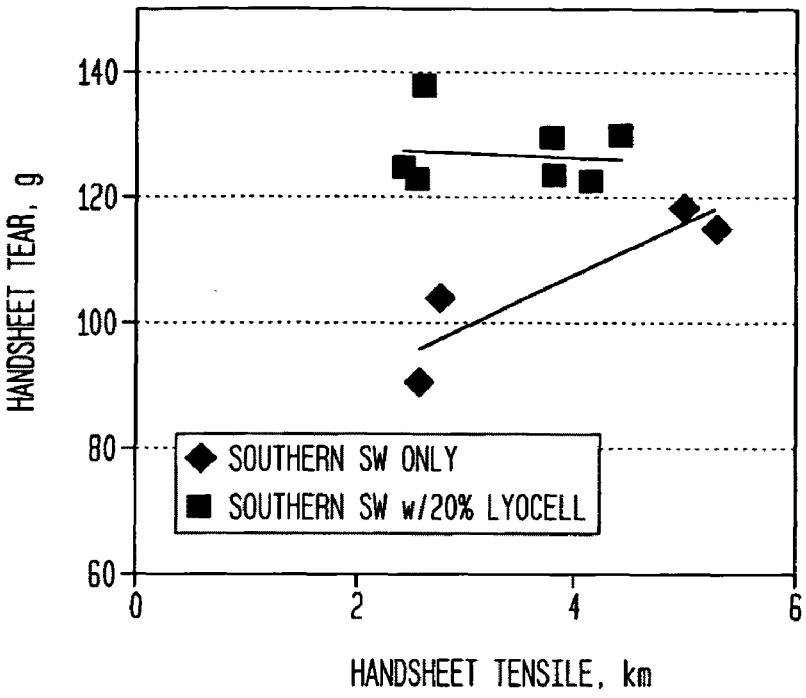
Figure 15:
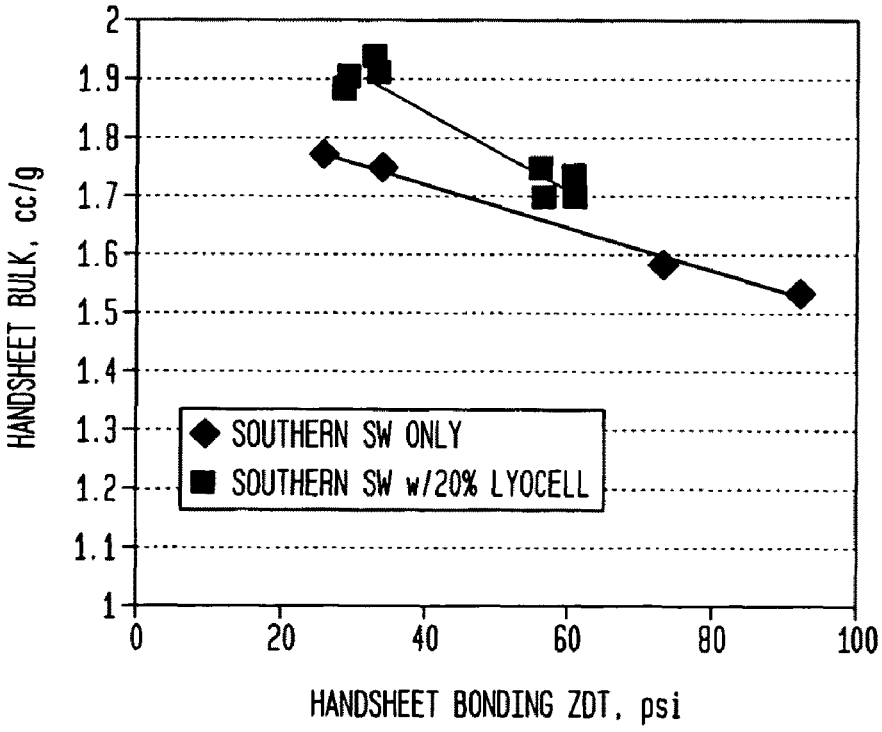

Hand sheet modulus is lower at a given tensile with the lyocell (FIG. 13). "Drapability" should improve as a result. The large number of fibers fills in the network better and allows more even distribution of stress. One of the deficiencies of southern softwood is its tendency to obtain lower stretch in creped tissue than northern softwood. It appears that lyocell may help address this deficiency. Fibrillated lyocell improves hand sheet tear (FIG. 14). Southern softwood is often noted for its tear strength relative to other Kraft pulps, so it is notable that the fibrillated lyocell increases tear in softwood hand sheets. Tear is not commonly referenced as an important attribute for tissue properties, but it does show another way in which lyocell enhances the network properties.

The role of softwood fibers can be generally described as providing network strength while hardwood fibers provide smoothness and opacity. The fibrillated lyocell is long enough to improve the network properties while its low coarseness provides the benefits of hardwood.

It is appreciated from the foregoing that lyocell fibrils are very different than wood pulp fibrils. A wood pulp fiber is a complex structure comprised of several layers (P, S1, S2, S3), each with cellulose strands arranged in spirals around the axis of the fiber. When subjected to mechanical refining, portions of the P and S1 layers peel away in the form of fines and fibrils. These fibrils are generally very short, perhaps no longer than 20 microns. The fibrils tend to act in the immediate vicinity of the fiber at the intersections with other fibers. Thus, wood pulp fibrils tend to increase bond strength, sheet strength, sheet density, and sheet stiffness. The multilayered fiber wall structure with spiralled fibrils makes it impossible to split the wood fiber along its axis using commercial processes. By contrast, lyocell fiber has a much simpler structure that allows the fiber to be split along its axis. The resulting fibrils are as small as 0.1-0.25 microns in diameter, and potentially as long as the original fiber. Fibril length is likely to be less than the "parent" fiber, and disintegration of many fibers will be incomplete. Nevertheless, if sufficient numbers of fibrils can act as individual fibers, the paper properties could be substantially impacted at a relatively low addition rate.

Consider the relative fiber coarsenesses of wood pulp furnishes and lyocell. Northern softwood (NBSK) has a coarseness of about 14 mg/100 m versus southern pine at 20 mg/100 m. Mixed southern hardwood (MSHW) has a coarseness of 10 mg/100 m versus eucalyptus at 6.5 mg/100 m. Lyocell fibrils with diameters between 0.1 and 0.25 microns would have coarseness values between 0.0013-0.0079 mg/100 m. One way to express the difference between a premium furnish and southern furnish is fiber population, expressed as the number fibers per gram of furnish (N). N is inversely proportional to coarseness, so premium furnish has a larger fiber population than southern furnish. The fiber population of southern furnish could be increased to equal or exceed that of premium furnish by the addition of fibrillated lyocell.

Lyocell microfibers have many attractive features including biodegradability, dispersibility, repulpability, low coarseness, and extremely low coarseness to length (C/L). The low C/L means that sheet strength can be obtained at a lower level of bonding, which makes the sheet more drapable (lower modulus as in FIG. 13).

Table 4 summarizes the effects that were significant at the 99% confidence level (except where noted). The purpose for the different treatments was to measure the relative impacts on strength. Southern softwood is less efficient in developing network strength than northern softwood, so one item of interest is to see if lyocell can enhance southern softwood. The furnish with 20% lyocell and 80% Southern softwood is significantly better than 100% Southern softwood. Bulk, opacity, and tear are higher at a given tensile while roughness and modulus are lower. These trends are directionally favorable for tissue properties.

The hand sheets for Table 4 were prepared according to TAPPI Method T-205. Bulk caliper in centimeters cubed per gram is obtained by dividing caliper by basis weight. Bendtsen roughness is obtained by measuring the air flow between a weighted platten and a paper sample. "L" designates the labelled side of the hand sheet that is against the metal plate during drying while "U" refers to the unlabelled side. ZDT refers to the out-of-plane tensile of the hand sheet.

TABLE 4

Main effects on hand sheet properties

| Test | Average Value | SW Refining Effect | Fib. Lyocell Effect | Refining-Lyocell Interaction |
|---|---|---|---|---|
| Caliper 5 Sheet ($cm^3/g$) | 1.76 | −0.19 | 0.15 | |
| Bendtsen Rough L-1 kg (ml/min) | 466 | −235 | −101 | 28 (95%) |
| Bendtsen Rough U-1 kg (ml/min) | 1482 | 137 (95%) | | |
| ZDT Fiber Bond (psi) | 49 | 36 | −11 | −13 |
| Tear HS, g | 120 | | 20 (95%) | |
| Opacity TAPPI | 77 | −4 | 13 | |
| Breaking Length, km | 3.5 | 1.8 | −0.6 (95%) | |
| Stretch Hand Sheet, % | 2.4 | 0.9 | | −0.4 (95%) |
| Tensile Energy Hand Sheet, kg-mm | 6.7 | 5.3 | | −1.9 (95%) |
| Tensile Modulus Hand Sheet, $kg/mm^2$ | 98 | 28 | −18 | |

Table 4 reiterates the benefits of fibrillated lyocell portrayed graphically in FIGS. 10-15: higher bulk, better smoothness, higher tear, better opacity, and lower modulus.

Figure 16:
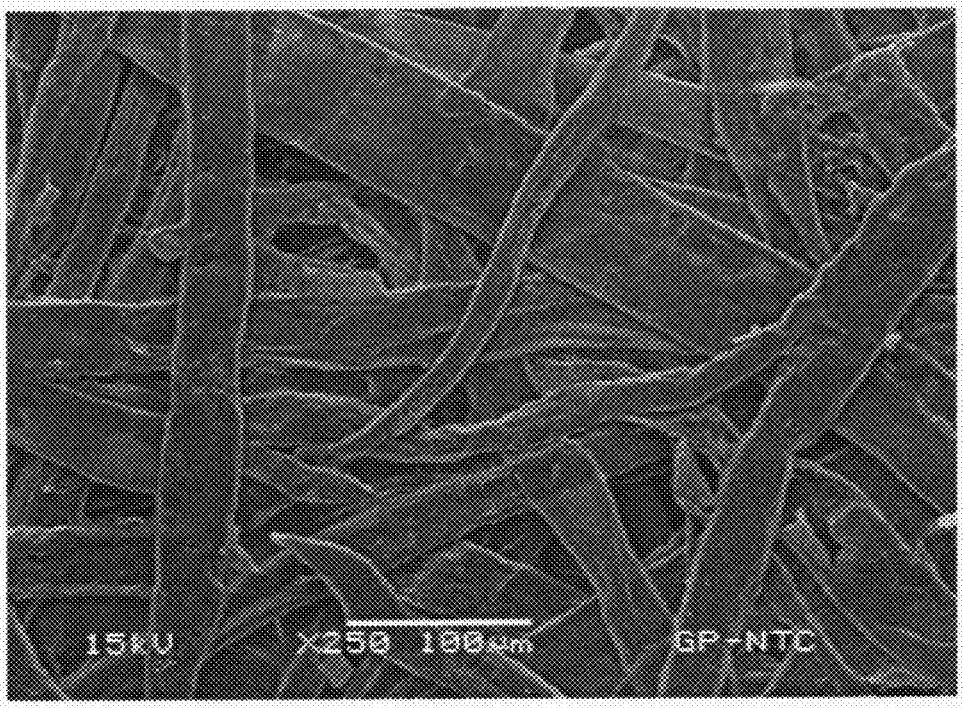
FIG. 16 is a photomicrograph at 250 magnification of a softwood hand sheet without fibrillated regenerated cellulose fiber.
Figure 17:
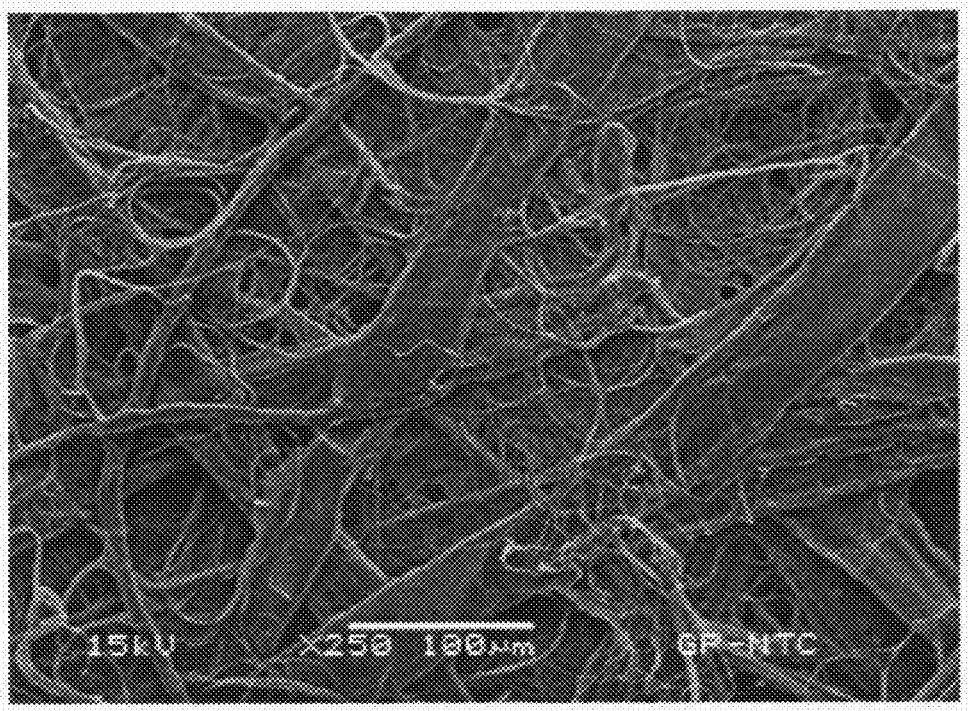
FIG. 17 is a photomicrograph at 250 magnification of a softwood hand sheet incorporating 20% fibrillated regenerated cellulose microfiber.

Table 5 compares the morphology of lyocell and softwood fibers as measured by the OpTest optical Fiber Quality Analyzer. The "stock" lyocell fibers (FIG. 2) have a coarseness of 16.7 mg/100 m, similar to southern softwood coarseness (20 mg/100 m). After fibrillation, the FQA measured coarseness drops to 11.9, similar to northern softwood. It is likely that resolution of the FQA instrument is unable to accurately measure either the length, width, or coarseness of the very fine fibrils. The smallest "fine" particle the FQA records is 41 microns. The narrowest width the FQA records is 7 microns. Thus, the coarseness value of 11.9 mg/100 m is not representative of the fibrillated lyocell. A one micron diameter fibril has a coarseness of 0.17 mg/100 m, and a 0.1 micron fibril has a coarseness of 0.0017 mg/100 m based on calculations. The average coarseness of the lyocell is clearly less than 11.9 mg/100 m measured by the FQA. Differences in fiber size are better appreciated by comparing FIGS. 16 and 17. FIG. 16 is a photomicrograph made with only southern softwood Kraft refined 1000 revolutions in a PFI mill, while FIG. 17 is a hand sheet made with 80% of the same southern softwood and 20% refined lyocell fiber. The exceptionally low coarseness of the fibrillated lyocell relative to conventional wood pulp is evident.

TABLE 5

Morphology of fibrillated lyocell versus whole lyocell and softwood

| OpTest FQA | Fib. Lyocell | Lyocell, 1.5 denier | Southern Softwood |
|---|---|---|---|
| Ln, mm | 0.38 | 2.87 | 0.68 |
| Lw, mm | 1.64 | 3.09 | 2.40 |
| Lz, mm | 2.58 | 3.18 | 3.26 |
| Fines (n), % | 67.4 | 2.9 | 64.0 |
| Fines (w), % | 16.3 | 0.1 | 8.5 |
| Curl Index (w) | 0.36 | 0.03 | 0.19 |
| Width, μm | 16.5 | 20.1 | 29.9 |
| Coarseness, mg/100 m | 11.9 | 16.7 | 20.5 |
| CS Freeness, ml | 22 | | 746 |

Integrated southern softwood and hardwood enjoy a lower cost position than premium pulp, yet the ability of southern furnish to produce soft tissue is less than desired for some applications. Mills producing premium products may require purchased premium fibers like northern softwood and eucalyptus for the highest softness grades, which increases cost and negatively impacts the mill fiber balance. In accordance with the present invention, refined lyocell fibers are added to improve furnish quality.

At high levels of refining, the fibrils can be separated from the parent fiber and act as independent micro- or perhaps even nano-fibers. The degree of fibrillation is measured by Canadian Standard Freeness (csf). Unrefined lyocell has a freeness of about 800 ml, and trial quantities were obtained at about 400, 200, and 40 ml. It is hypothesized that a high level of refining will produce the biggest impact at the lowest addition rate. More refining produces a higher population of very low coarseness fibers, but may also reduce average fiber length. It is preferred to maximize production of low coarseness fibrils while minimizing the cutting of fibers. In the hand sheet trial referenced, 4 mm lyocell was refined to a freeness of only 22 ml with an average fiber length (Lw) of 1.6 mm. As discussed earlier, the 1.6 mm as measured by the FQA is not considered an accurate average value, but only intended to show the directional decrease in length with refining. The fibrillated lyocell obtained for later examples began as 6 mm fibers with a coarseness of 16.7 mg/100 m before refining. The ideal fibrils are substantially less coarse than eucalyptus while maintaining adequate length. In reality, refining greatly reduces the fibril length, yet they are long enough to reinforce the fiber network.

Lyocell microfiber makes it possible to greatly increase the fibers/gram of a furnish while adding only modest amounts. Consider the calculations in Table 6, wherein it is seen that fibrillated lyocell readily achieves fiber counts of greater than a billion fibers per gram.

TABLE 6

Fibrillated Lyocell Fiber Count

| D, microns | C mg/100 m | Length, mm | N, million/g |
|---|---|---|---|
| 0.1 | 0.0013 | 0.1 | 795,775 |
| 0.25 | 0.0079 | 0.2 | 63,662 |
| 0.5 | 0.031 | 0.3 | 10,610 |
| 1 | 0.126 | 0.4 | 1,989 |
| 2 | 0.50 | 0.5 | 398 |
| 11.5 | 16.6 | 6 | 1 |

For comparison, eucalyptus fiber, which has a relatively large number of fibers, has only up to about 20 million fibers per gram.

Example 2

This hand sheet example demonstrates that the benefit of fibrillated lyocell is obtained predominantly from short, low coarseness fibrils rather than partially refined parent fibers unintentionally persisting after the refining process. 6 mm by 1.5 denier lyocell was refined to 40 freeness and fractionated in a Bauer McNett classifier using screens with meshes of 14, 28, 48, 100, and 200. Fiber length is the primary factor that determines the passage of fibers through each screen. The 14 and 28 mesh fractions were combined to form one fraction hereafter referred to as "Longs". The 48, 100, 200 mesh fractions and the portion passing through the 200 mesh were combined to form a second fraction hereafter referred to as "Shorts". Southern softwood was prepared by refining it 1000 revolutions in a PFI mill. Hand sheets were prepared at 15 lb/ream basis weight, pressed at 15 psi for five minutes, and dried on a steam-heated drum. Table 7 compares hand sheets made with different combinations of softwood and fibrillated lyocell. Softwood alone (Sample 1) has low opacity, low stretch, and low tensile. 20% longs (Sample 2) improves opacity and stretch modestly, but not tensile. 20% shorts (Sample 3) greatly increases opacity, stretch, and tensile, more so than the whole lyocell (Sample 4). Sample 5 used recombined longs and shorts to approximate the original fibrillated lyocell. It can be appreciated from this example that the shorts are the dominant contributor to the present invention.

TABLE 7

15 lb/ream hand sheets with different components of fibrillated lyocell

| Sample | Description | Opacity TAPPI Opacity Units | Stretch Handsht % | Breaking Length km | Bulk $cm^3/g$ | Basis Weight lb/ream |
|---|---|---|---|---|---|---|
| 1 | 100% southern softwood | 46 | 0.7 | 0.75 | 2.92 | 14.3 |
| 2 | 80% southern softwood/20% fib. lyocell Longs | 52 | 0.9 | 0.73 | 3.09 | 15.4 |
| 3 | 80% southern softwood/20% fib. lyocell Shorts | 65 | 1.4 | 0.98 | 2.98 | 15.0 |

TABLE 7-continued 15 lb/ream hand sheets with different components of fibrillated lyocell

| Sample | Description | Opacity TAPPI Opacity Units | Stretch Handsht % | Breaking Length km | Bulk $cm^3/g$ | Basis Weight lb/ream |
|---|---|---|---|---|---|---|
| 4 | 80% southern softwood/20% fib. lyocell Whole | 61 | 1.3 | 0.95 | 2.81 | 15.7 |
| 5 | 80% southern softwood/10% fib. lyocell Longs/ 10% fib. lyocell Shorts | 59 | 1.3 | 0.92 | 2.97 | 14.9 |

Figure 18:
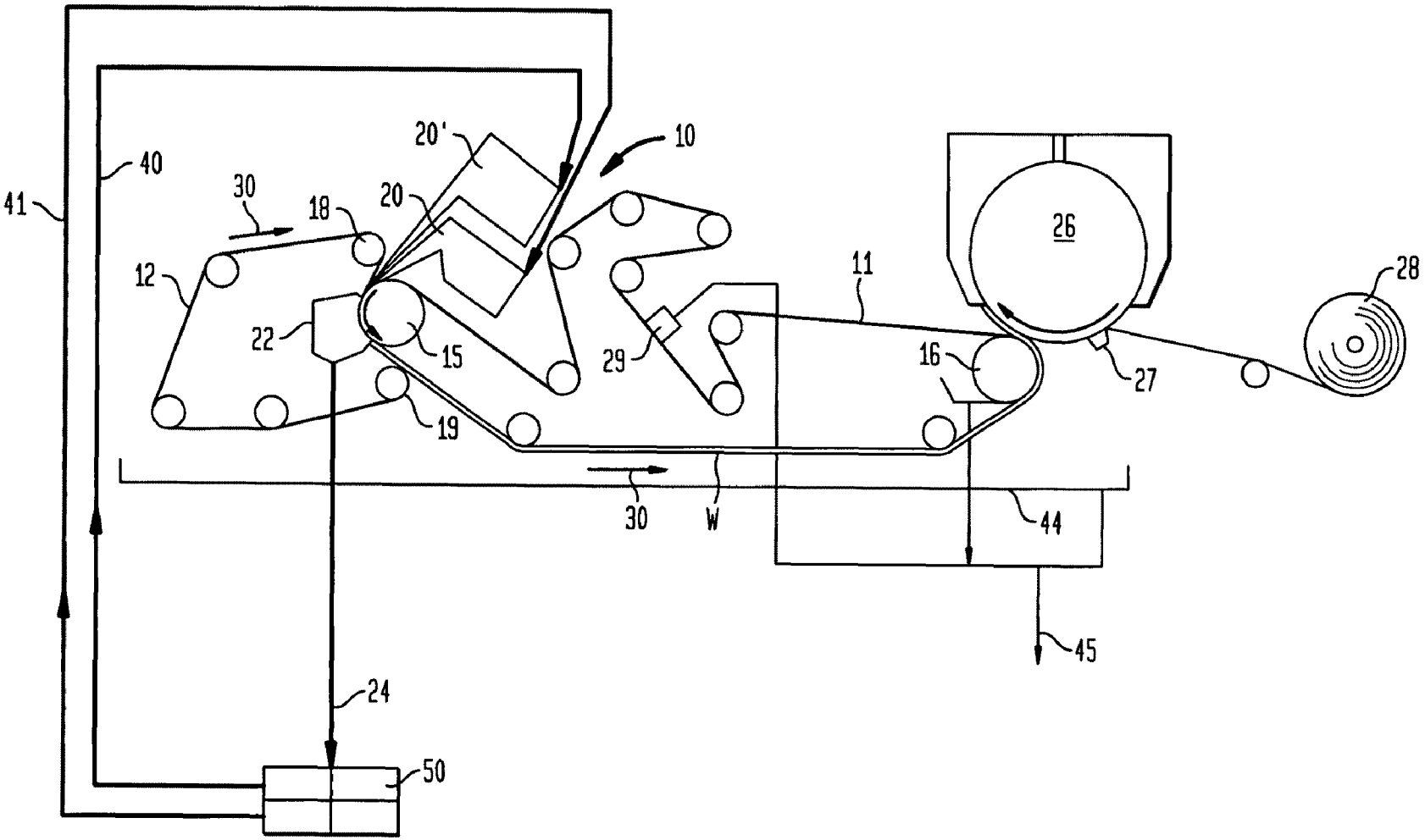
FIG. 18 is a schematic diagram of a wet press paper machine which may be used in the practice of the present invention.

Longs = 14 mesh + 28 mesh fractions
Shorts = 48 mesh + 100 mesh + 200 mesh + material passing through 200 mesh FIG. 18 illustrates one way of practicing the present invention where a machine chest 50, which may be compartmentalized, is used for preparing furnishes that are treated with chemicals having different functionality depending on the character of the various fibers used. This embodiment shows a divided headbox thereby making it possible to produce a stratified product. The product according to the present invention can be made with single or multiple headboxes, 20, 20' and regardless of the number of headboxes may be stratified or unstratified. The treated furnish is transported through different conduits 40 and 41, where it is delivered to the headbox of a crescent forming machine 10 as is well known, although any convenient configuration can be used.

FIG. 18 shows a web-forming end or wet end with a liquid permeable foraminous support member 11 which may be of any convenient configuration. Foraminous support member 11 may be constructed of any of several known materials including photopolymer fabric, felt, fabric or a synthetic filament woven mesh base with a very fine synthetic fiber batt attached to the mesh base. The foraminous support member 11 is supported in a conventional manner on rolls, including breast roll 15, and pressing roll, 16.

Forming fabric 12 is supported on rolls 18 and 19 which are positioned relative to the breast roll 15 for guiding the forming wire 12 to converge on the foraminous support member 11 at the cylindrical breast roll 15 at an acute angle relative to the foraminous support member 11. The foraminous support member 11 and the wire 12 move at the same speed and in the same direction which is the direction of rotation of the breast roll 15. The forming wire 12 and the foraminous support member 11 converge at an upper surface of the forming roll 15 to form a wedge-shaped space or nip into which one or more jets of water or foamed liquid fiber dispersion may be injected and trapped between the forming wire 12 and the foraminous support member 11 to force fluid through the wire 12 into a save-all 22 where it is collected for re-use in the process (recycled via line 24).

The nascent web W formed in the process is carried along the machine direction 30 by the foraminous support member 11 to the pressing roll 16 where the wet nascent web W is transferred to the Yankee dryer 26. Fluid is pressed from the wet web W by pressing roll 16 as the web is transferred to the Yankee dryer 26 where it is dried and creped by means of a creping blade 27. The finished web is collected on a take-up roll 28.

A pit 44 is provided for collecting water squeezed from the furnish by the press roll 16, as well as collecting the water removed from the fabric by a Uhle box 29. The water collected in pit 44 may be collected into a flow line 45 for separate processing to remove surfactant and fibers from the water and to permit recycling of the water back to the papermaking machine 10.

Using a CWP apparatus of the class shown in FIG. 18, a series of absorbent sheets were made with mixed hardwood/softwood furnishes and furnishes including refined lyocell fiber. The general approach was to refine softwood to a target level and prepare a softwood/hardwood blend in a mixing tank. After making a control from 100% wood pulp furnish, additional cells were made by metering microfiber into the mixture. Tensile was optionally adjusted with either debonder or starch. The southern pulps used were softwood and hardwood. The "premium" furnish was made from northern softwood and eucalyptus. Tissue creping was kept constant to reduce the number of variables. 1.8 lb/T 1145 PAE was applied, and 15 degree blades were used except for the towel cells, which used 8 degree blades. Dryer temperature was constant at 248° F. Basis weight, MDDT, CDDT and caliper were measured on all rolls. CDWT and 2-ply SAT were measured on some trial cells and softness was evaluated by a panel of trained testers using 2-ply swatches, 4"×28", prepared from base sheet with the Yankee side facing outward. Details and results appear in Tables 8-9 and FIGS. 19-30.

TABLE 8

Materials for CWP Testing

| Wood Pulp | Microfiber | Softwood freeness [ml] |
|---|---|---|
| 40 SouthernSW/60 SouthernHW | 0 | 570 |
| 32 SouthernSW/48 SouthernHW | 20 (217 csf) | 570 |
| 20 SouthernSW/30 SouthernHW | 50 (217 csf) | 570 |
| 0 | 100 (217 csf) | |
| 40 SouthernSW/60 SouthernHW | 0 | 570 |
| 32 SouthernSW/48 SouthernHW | 20 (40 csf) | 570 |
| 36 SouthernSW/54 SouthernHW | 10 (40 csf) | 570 |
| 38 SouthernSW/57 SouthernHW | 5 (40 csf) | 570 |
| 40 NorthernSW/60 SouthernHW | 0 | 580 |
| 38 NorthernSW/57 SouthernHW | 5 (40 csf) | 580 |
| 32 NorthernSW/48 SouthernHW | 20 (40 csf) | 580 |
| 70 SouthernSW/30 SouthernHW | 0 | 580 |
| 56 SouthernSW/24 SouthernHW | 20 (40 csf) | 580 |
| 40 SouthernSW/60 SouthernHW | 0 | 680 |
| 36 SouthernSW/54 SouthernHW | 10 (40 csf) | 680 |
| 38 SouthernSW/57 SouthernHW | 5 (40 csf) | 680 |
| 39 SouthernSW/59 SouthernHW | 2 (40 csf) | 680 |
| 40 NorthernSW/60 Eucalyptus | 0 | 580 |
| 32 NorthernSW/48 Eucalyptus | 20 (40 csf) | 580 |
| 50 NorthernSW/50 Eucalyptus | 0 | 580 |
| 40 NorthernSW/40 Eucalyptus | 20 (40 csf) | 580 |

(Softwood Freeness Differences Results from Refining)

TABLE 9

| Base sheet physical properties | | | | | | | | | | | |
|---|---|---|---|---|---|---|---|---|---|---|---|
| Sample | Wood pulp | Microfiber | SAT Capacity $g/m^2$ | SAT Rate $g/s^{0.5}$ | Caliper 8 Sheet mils/ 8 sht | Basis Weight $lb/3000\ ft^2$ | Tensile MD g/3 in | Stretch MD % | Tensile CD g/3 in | Stretch CD % | Tensile GM g/3 in. |
| 1 | 40 SouthernSW/ 60 SouthernHW | 0 | | | 40.3 | 12.1 | 448 | 23.1 | 360 | 4.6 | 400 |
| 2 | 40 SouthernSW/ 60 SouthernHW | 0 | | | 40.2 | 12.5 | 505 | 24.6 | 350 | 4.7 | 419 |
| 3 | 40 SouthernSW/ 60 SouthernHW | 0 | | | 39.3 | 12.4 | 513 | 24.7 | 312 | 4.1 | 398 |
| 4 | 40 SouthernSW/ 60 SouthernHW | 0 | | | 38.6 | 12.3 | 560 | 24.8 | 386 | 4.2 | 464 |
| 5 | 40 SouthernSW/ 60 SouthernHW | 0 | | | 38.4 | 12.2 | 532 | 24.6 | 366 | 4.5 | 441 |
| 6 | 40 SouthernSW/ 60 SouthernHW | 0 | | | 38.4 | 12.1 | 451 | 21.1 | 366 | 4.9 | 404 |
| 7 | 40 SouthernSW/ 60 SouthernHW | 0 | | | 37.9 | 12.0 | 523 | 23.7 | 359 | 3.6 | 433 |
| 8 | 32 SouthernSW/ 48 SouthernHW | 20 (217 csf) | | | 39.3 | 11.6 | 534 | 26.3 | 410 | 4.4 | 466 |
| 9 | 32 SouthernSW/ 48 SouthernHW | 20 (217 csf) | | | 41.5 | 12.3 | 561 | 26.0 | 357 | 4.9 | 447 |
| 10 | 32 SouthernSW/ 48 SouthernHW | 20 (217 csf) | | | 37.8 | 11.7 | 566 | 26.0 | 423 | 4.6 | 489 |
| 11 | 20 SouthernSW/ 30 SouthernHW | 50 (217 csf) | | | 44.6 | 14.4 | 1009 | 25.7 | 513 | 4.7 | 719 |
| 12 | 20 SouthernSW/ 30 SouthernHW | 50 (217 csf) | | | 50.6 | 14.3 | 968 | 30.9 | 619 | 5.9 | 773 |
| 13 | 20 SouthernSW/ 30 SouthernHW | 50 (217 csf) | | | 51.1 | 14.9 | 925 | 29.7 | 528 | 6.1 | 696 |
| 14 | 0 | 100 (217 csf) | | | 54.1 | 12.3 | 825 | 32.9 | 530 | 10.6 | 658 |
| 15 | 40 SouthernSW/ 60 SouthernHW | 0 | | | 43.1 | 12.6 | 501 | 24.9 | 325 | 4.4 | 404 |
| 16 | 40 SouthernSW/ 60 SouthernHW | 0 | | | 40.3 | 12.2 | 462 | 24.1 | 322 | 4.1 | 384 |
| 17 | 40 SouthernSW/ 60 SouthernHW | 0 | | | 41.3 | 12.0 | 458 | 24.3 | 324 | 4.4 | 385 |
| 18 | 32 SouthernSW/ 48 SouthernHW | 20 (40 csf) | | | 39.0 | 11.8 | 804 | 30.4 | 411 | 6.2 | 574 |
| 19 | 32 SouthernSW/ 48 SouthernHW | 20 (40 csf) | | | 41.3 | 11.6 | 773 | 31.3 | 442 | 6.2 | 584 |
| 20 | 32 SouthernSW/ 48 SouthernHW | 20 (40 csf) | | | 40.8 | 11.8 | 773 | 29.7 | 395 | 5.7 | 551 |
| 21 | 32 SouthernSW/ 48 SouthernHW | 20 (40 csf) | | | 39.4 | 11.8 | 854 | 31.0 | 470 | 5.7 | 633 |
| 22 | 32 SouthernSW/ 48 SouthernHW | 20 (40 csf) | | | 39.9 | 11.8 | 692 | 26.6 | 384 | 6.0 | 515 |
| 23 | 32 SouthernSW/ 48 SouthernHW | 20 (40 csf) | | | 40.5 | 11.6 | 772 | 28.7 | 371 | 6.2 | 533 |
| 24 | 32 SouthernSW/ 48 SouthernHW | 20 (40 csf) | | | 39.2 | 11.5 | 751 | 27.8 | 376 | 5.9 | 530 |
| 25 | 36 SouthernSW/ 54 SouthernHW | 10 (40 csf) | | | 40.0 | 11.6 | 657 | 28.0 | 293 | 5.7 | 439 |
| 26 | 36 SouthernSW/ 54 SouthernHW | 10 (40 csf) | | | 39.0 | 11.7 | 652 | 28.6 | 314 | 5.0 | 452 |
| 27 | 38 SouthernSW/ 57 SouthernHW | 5 (40 csf) | | | 40.6 | 12.6 | 948 | 29.0 | 391 | 5.7 | 607 |
| 28 | 38 SouthernSW/ 57 SouthernHW | 5 (40 csf) | | | 49.3 | 14.9 | 792 | 28.6 | 355 | 5.7 | 530 |
| 29 | 38 SouthernSW/ 57 SouthernHW | 5 (40 csf) | | | 38.8 | 11.9 | 743 | 27.4 | 348 | 5.5 | 507 |
| 30 | 40 NorthernSW/ 60 SouthernHW | 0 | | | 37.7 | 11.7 | 855 | 28.5 | 352 | 5.7 | 548 |
| 31 | 40 NorthernSW/ 60 SouthernHW | 0 | | | 37.2 | 11.7 | 735 | 27.4 | 358 | 5.6 | 513 |
| 32 | 40 NorthernSW/ 60 SouthernHW | 0 | | | 45.8 | 14.3 | 1098 | 31.3 | 589 | 5.5 | 804 |
| 33 | 40 NorthernSW/ 60 SouthernHW | 0 | | | 42.9 | 12.8 | 956 | 30.4 | 511 | 5.7 | 698 |
| 34 | 40 NorthernSW/ 60 SouthernHW | 0 | | | 39.1 | 12.2 | 708 | 27.7 | 456 | 3.8 | 567 |
| 35 | 40 NorthernSW/ 60 SouthernHW | 0 | | | 37.7 | 12.2 | 728 | 28.4 | 535 | 3.6 | 623 |
| 36 | 40 NorthernSW/ 60 SouthernHW | 0 | | | 37.8 | 11.9 | 668 | 26.9 | 506 | 4.0 | 581 |

TABLE 9-continued

| | | | Base sheet physical properties | | | | | | | | |
|---|---|---|---|---|---|---|---|---|---|---|---|
| 37 | 38 NorthernSW/ 57 SouthernHW | 5 (40 csf) | | | 38.0 | 12.7 | 1061 | 29.6 | 509 | 5.0 | 735 |
| 38 | 38 NorthernSW/ 57 SouthernHW | 5 (40 csf) | | | 35.8 | 11.9 | 859 | 28.2 | 474 | 4.9 | 634 |
| 39 | 38 NorthernSW/ 57 SouthernHW | 5 (40 csf) | | | 34.2 | 11.6 | 764 | 28.1 | 397 | 5.0 | 551 |
| 40 | 38 NorthernSW/ 57 SouthernHW | 5 (40 csf) | | | 35.3 | 11.6 | 760 | 26.3 | 418 | 5.1 | 562 |
| 41 | 32 NorthernSW/ 48 SouthernHW | 20 (40 csf) | | | 38.2 | 12.1 | 1308 | 30.8 | 622 | 5.9 | 901 |
| 42 | 32 NorthernSW/ 48 SouthernHW | 20 (40 csf) | | | 39.7 | | 1568 | 32.4 | 855 | 5.5 | 1158 |
| 43 | 70 SouthernSW/ 30 SouthernHW | 0 | 265 | 0.099 | 43.4 | 15.0 | 3134 | 29.5 | 1498 | 5.0 | 2165 |
| 44 | 70 SouthernSW/ 30 SouthernHW | 0 | 249 | 0.091 | 40.9 | 14.4 | 3305 | 30.1 | 1705 | 5.0 | 2374 |
| 45 | 70 SouthernSW/ 30 SouthernHW | 0 | 240 | 0.084 | 40.4 | 14.8 | 3464 | 30.7 | 1664 | 4.5 | 2400 |
| 46 | 56 SouthernSW/ 24 SouthernHW | 20 (40 csf) | 271 | 0.071 | 48.7 | 14.8 | 3115 | 32.4 | 1305 | 5.1 | 2013 |
| 47 | 56 SouthernSW/ 24 SouthernHW | 20 (40 csf) | 289 | 0.078 | 49.0 | 14.9 | 3058 | 32.2 | 1545 | 5.2 | 2171 |
| 48 | 40 SouthernSW/ 60 SouthernHW | 0 | | | 43.7 | 12.9 | 421 | 24.7 | 341 | 4.0 | 376 |
| 49 | 40 SouthernSW/ 60 SouthernHW | 0 | | | 41.5 | 12.0 | 377 | 24.2 | 316 | 3.8 | 343 |
| 50 | 40 SouthernSW/ 60 SouthernHW | 0 | | | 41.2 | 11.8 | 349 | 24.3 | 262 | 4.1 | 302 |
| 51 | 36 SouthernSW/ 54 SouthernHW | 10 (40 csf) | | | 44.4 | 12.5 | 642 | 28.2 | 321 | 6.2 | 454 |
| 52 | 36 SouthernSW/ 54 SouthernHW | 10 (40 csf) | | | 43.1 | 12.4 | 663 | 30.0 | 337 | 5.7 | 473 |
| 53 | 36 SouthernSW/ 54 SouthernHW | 10 (40 csf) | | | 44.8 | 12.5 | 701 | 29.1 | 317 | 6.3 | 471 |
| 54 | 38 SouthernSW/ 57 SouthernHW | 5 (40 csf) | | | 41.5 | 11.9 | 488 | 27.3 | 324 | 5.3 | 397 |
| 55 | 38 SouthernSW/ 57 SouthernHW | 5 (40 csf) | | | 41.6 | 11.7 | 445 | 26.2 | 325 | 5.0 | 379 |
| 56 | 39 SouthernSW/ 59 SouthernHW | 2 (40 csf) | | | 41.5 | 11.8 | 403 | 24.9 | 290 | 4.7 | 338 |
| 57 | 39 SouthernSW/ 59 SouthernHW | 2 (40 csf) | | | 41.2 | 11.7 | 337 | 23.5 | 331 | 4.5 | 333 |
| 58 | 40 NorthernSW/ 60 Eucalyptus | 0 | | | 41.8 | 10.3 | 351 | 27.8 | 199 | 4.8 | 264 |
| 59 | 40 NorthernSW/ 60 Eucalyptus | 0 | | | 39.5 | 10.1 | 322 | 27.4 | 221 | 5.0 | 267 |
| 60 | 40 NorthernSW/ 60 Eucalyptus | 0 | | | 40.7 | 10.4 | 316 | 26.9 | 187 | 5.0 | 243 |
| 61 | 32 NorthernSW/ 48 Eucalyptus | 20 (40 csf) | | | 43.1 | 10.6 | 622 | 31.3 | 280 | 6.5 | 417 |
| 62 | 32 NorthernSW/ 48 Eucalyptus | 20 (40 csf) | | | 40.9 | 10.6 | 618 | 31.3 | 320 | 6.5 | 443 |
| 63 | 32 NorthernSW/ 48 Eucalyptus | 20 (40 csf) | | | 40.7 | 10.1 | 556 | 31.4 | 300 | 6.9 | 409 |
| 64 | 32 NorthernSW/ 48 Eucalyptus | 20 (40 csf) | | | 35.6 | 7.9 | 331 | 29.4 | 164 | 7.3 | 233 |
| 65 | 32 NorthernSW/ 48 Eucalyptus | 20 (40 csf) | | | 33.0 | 7.9 | 343 | 30.4 | 139 | 7.2 | 218 |
| 66 | 32 NorthernSW/ 48 Eucalyptus | 20 (40 csf) | | | 31.5 | 8.0 | 589 | 31.2 | 276 | 7.4 | 403 |
| 67 | 50 NorthernSW/ 50 Eucalyptus | 0 | | | 37.0 | 10.7 | 571 | 25.1 | 354 | 4.6 | 448 |
| 68 | 50 NorthernSW/ 50 Eucalyptus | 0 | | | 35.4 | 10.1 | 511 | 25.4 | 307 | 4.8 | 395 |
| 69 | 50 NorthernSW/ 50 Eucalyptus | 0 | | | 35.1 | 10.2 | 496 | 25.0 | 279 | 4.5 | 372 |
| 70 | 40 NorthernSW/ 40 Eucalyptus | 20 (40 csf) | | | 34.3 | 9.9 | 806 | 30.9 | 415 | 5.0 | 578 |
| 71 | 40 NorthernSW/ 40 Eucalyptus | 20 (40 csf) | | | 36.1 | 10.0 | 752 | 31.5 | 470 | 5.1 | 593 |
| 72 | 40 NorthernSW/ 40 Eucalyptus | 20 (40 csf) | | | 25.1 | 6.3 | 302 | 26.4 | 191 | 6.4 | 240 |
| 73 | 40 NorthernSW/ 40 Eucalyptus | 20 (40 csf) | | | 25.1 | 6.2 | 288 | 29.8 | 208 | 6.5 | 245 |
| 74 | 40 NorthernSW/ 40 Eucalyptus | 20 (40 csf) | | | 24.1 | 6.2 | 428 | 27.6 | 287 | 6.1 | 350 |
| 75 | 40 NorthernSW/ 40 Eucalyptus | 20 (40 csf) | | | 22.8 | 6.2 | 463 | 25.6 | 318 | 5.9 | 383 |

TABLE 9-continued

| Base sheet physical properties | | | | | | | | | | |
|---|---|---|---|---|---|---|---|---|---|---|
| 76 | 40 NorthernSW/ 40 Eucalyptus | 20 (40 csf) | 21.5 | 5.2 | 436 | 28.8 | 305 | 6.4 | 364 |
| 77 | 40 NorthernSW/ 40 Eucalyptus | 20 (40 csf) | 22.4 | 5.2 | 245 | 24.5 | 181 | 7.6 | 211 |

| Sample | Wet Tens Finch Cured-CD g/3 in. | Break Modulus GM gms/% | T.E.A. CD mm-gm/ $mm^2$ | T.E.A. MD mm-gm/ $mm^2$ | Break Modulus CD gms/% | Break Modulus MD gms/% |
|---|---|---|---|---|---|---|
| 1 | | 39.6 | 0.13 | 0.70 | 83.4 | 18.8 |
| 2 | | 38.4 | 0.13 | 0.79 | 73.4 | 20.3 |
| 3 | | 40.3 | 0.10 | 0.83 | 79.2 | 20.5 |
| 4 | | 47.1 | 0.12 | 0.88 | 98.1 | 22.6 |
| 5 | | 41.5 | 0.12 | 0.83 | 77.6 | 22.3 |
| 6 | | 41.2 | 0.13 | 0.66 | 76.9 | 22.1 |
| 7 | | 47.8 | 0.09 | 0.80 | 101.8 | 22.5 |
| 8 | | 43.5 | 0.14 | 0.81 | 94.8 | 20.0 |
| 9 | | 41.1 | 0.12 | 0.83 | 78.9 | 21.4 |
| 10 | | 41.8 | 0.14 | 0.84 | 84.6 | 20.7 |
| 11 | | 63.2 | 0.18 | 1.08 | 103.9 | 38.5 |
| 12 | | 55.1 | 0.27 | 1.34 | 99.3 | 30.5 |
| 13 | | 47.7 | 0.24 | 1.26 | 74.1 | 30.7 |
| 14 | | 34.9 | 0.45 | 1.16 | 49.2 | 25.2 |
| 15 | | 39.2 | 0.10 | 0.77 | 74.0 | 20.7 |
| 16 | | 37.3 | 0.10 | 0.73 | 70.3 | 19.8 |
| 17 | 7.4 | 38.2 | 0.11 | 0.71 | 75.5 | 19.3 |
| 18 | | 40.9 | 0.19 | 1.18 | 64.9 | 25.8 |
| 19 | | 42.7 | 0.21 | 1.15 | 74.6 | 24.6 |
| 20 | | 42.9 | 0.18 | 1.11 | 73.1 | 25.1 |
| 21 | 11.0 | 45.5 | 0.21 | 1.23 | 75.3 | 27.5 |
| 22 | | 40.7 | 0.18 | 0.97 | 63.0 | 26.3 |
| 23 | | 40.5 | 0.18 | 1.07 | 64.9 | 25.3 |
| 24 | | 41.0 | 0.17 | 1.03 | 62.4 | 26.9 |
| 25 | | 33.8 | 0.13 | 1.02 | 47.7 | 24.0 |
| 26 | | 39.1 | 0.12 | 1.02 | 66.9 | 22.8 |
| 27 | | 46.9 | 0.18 | 1.36 | 66.3 | 33.4 |
| 28 | | 39.7 | 0.16 | 1.17 | 56.9 | 27.7 |
| 29 | | 42.8 | 0.14 | 1.02 | 70.1 | 26.4 |
| 30 | | 42.6 | 0.15 | 1.19 | 61.8 | 29.5 |
| 31 | | 42.1 | 0.15 | 1.04 | 66.6 | 26.6 |
| 32 | | 58.3 | 0.25 | 1.22 | 101.3 | 33.6 |
| 33 | | 52.7 | 0.23 | 1.17 | 89.8 | 31.0 |
| 34 | | 54.4 | 0.13 | 1.10 | 123.2 | 24.1 |
| 35 | | 57.9 | 0.15 | 1.14 | 136.7 | 24.6 |
| 36 | | 56.8 | 0.15 | 1.08 | 135.1 | 24.3 |
| 37 | | 61.7 | 0.20 | 1.51 | 108.4 | 35.2 |
| 38 | | 53.5 | 0.17 | 1.26 | 91.6 | 31.6 |
| 39 | | 44.4 | 0.16 | 1.08 | 75.6 | 26.1 |
| 40 | | 50.4 | 0.16 | 1.03 | 82.2 | 31.0 |
| 41 | | 67.3 | 0.28 | 1.54 | 104.5 | 43.4 |
| 42 | | 88.6 | 0.36 | 1.77 | 156.7 | 50.1 |
| 43 | 378 | 178.8 | 0.59 | 4.55 | 302.7 | 106.4 |
| 44 | 303 | 190.2 | 0.61 | 4.55 | 337.4 | 107.2 |
| 45 | 378 | 207.4 | 0.57 | 4.53 | 367.1 | 117.2 |
| 46 | 506 | 159.2 | 0.48 | 3.24 | 278.4 | 91.2 |
| 47 | 443 | 162.1 | 0.64 | 3.17 | 278.5 | 94.6 |
| 48 | | 39.6 | 0.09 | 0.63 | 93.0 | 17.3 |
| 49 | | 37.5 | 0.09 | 0.59 | 91.8 | 15.9 |
| 50 | | 31.0 | 0.07 | 0.53 | 66.0 | 14.6 |
| 51 | | 34.1 | 0.15 | 0.93 | 51.8 | 22.5 |
| 52 | | 36.2 | 0.14 | 0.95 | 60.3 | 21.7 |
| 53 | | 35.9 | 0.16 | 1.01 | 52.1 | 24.8 |
| 54 | | 34.3 | 0.13 | 0.75 | 65.0 | 18.3 |
| 55 | | 33.1 | 0.13 | 0.65 | 63.2 | 17.4 |
| 56 | | 34.5 | 0.10 | 0.63 | 73.9 | 16.2 |
| 57 | | 31.3 | 0.11 | 0.51 | 66.7 | 14.8 |
| 58 | | 23.1 | 0.07 | 0.51 | 42.7 | 12.5 |
| 59 | | 21.7 | 0.08 | 0.48 | 41.8 | 11.2 |
| 60 | | 21.4 | 0.07 | 0.46 | 37.1 | 12.4 |
| 61 | | 28.7 | 0.14 | 0.77 | 42.8 | 19.2 |
| 62 | | 31.0 | 0.16 | 0.78 | 51.2 | 19.0 |
| 63 | | 27.8 | 0.16 | 0.71 | 43.4 | 17.9 |
| 64 | | 15.9 | 0.09 | 0.46 | 23.5 | 10.8 |
| 65 | | 15.1 | 0.08 | 0.49 | 20.2 | 11.2 |
| 66 | 87 | 26.6 | 0.15 | 0.78 | 38.3 | 18.5 |
| 67 | | 41.0 | 0.12 | 0.83 | 72.3 | 23.3 |
| 68 | | 34.3 | 0.11 | 0.76 | 60.9 | 19.4 |

TABLE 9-continued

| Base sheet physical properties | | | | | | |
|---|---|---|---|---|---|---|
| 69 | | 35.3 | 0.09 | 0.75 | 62.8 | 19.9 |
| 70 | | 46.6 | 0.16 | 1.03 | 85.6 | 25.6 |
| 71 | | 47.6 | 0.18 | 0.97 | 94.6 | 24.1 |
| 72 | | 18.1 | 0.09 | 0.46 | 28.3 | 11.6 |
| 73 | | 18.0 | 0.10 | 0.48 | 32.8 | 9.9 |
| 74 | 112 | 27.1 | 0.13 | 0.68 | 47.3 | 15.5 |
| 75 | 109 | 30.7 | 0.14 | 0.70 | 54.4 | 17.3 |
| 76 | 50 | 27.7 | 0.14 | 0.70 | 50.0 | 15.4 |
| 77 | 54 | 15.8 | 0.06 | 0.40 | 25.6 | 9.9 |

Figure 19:
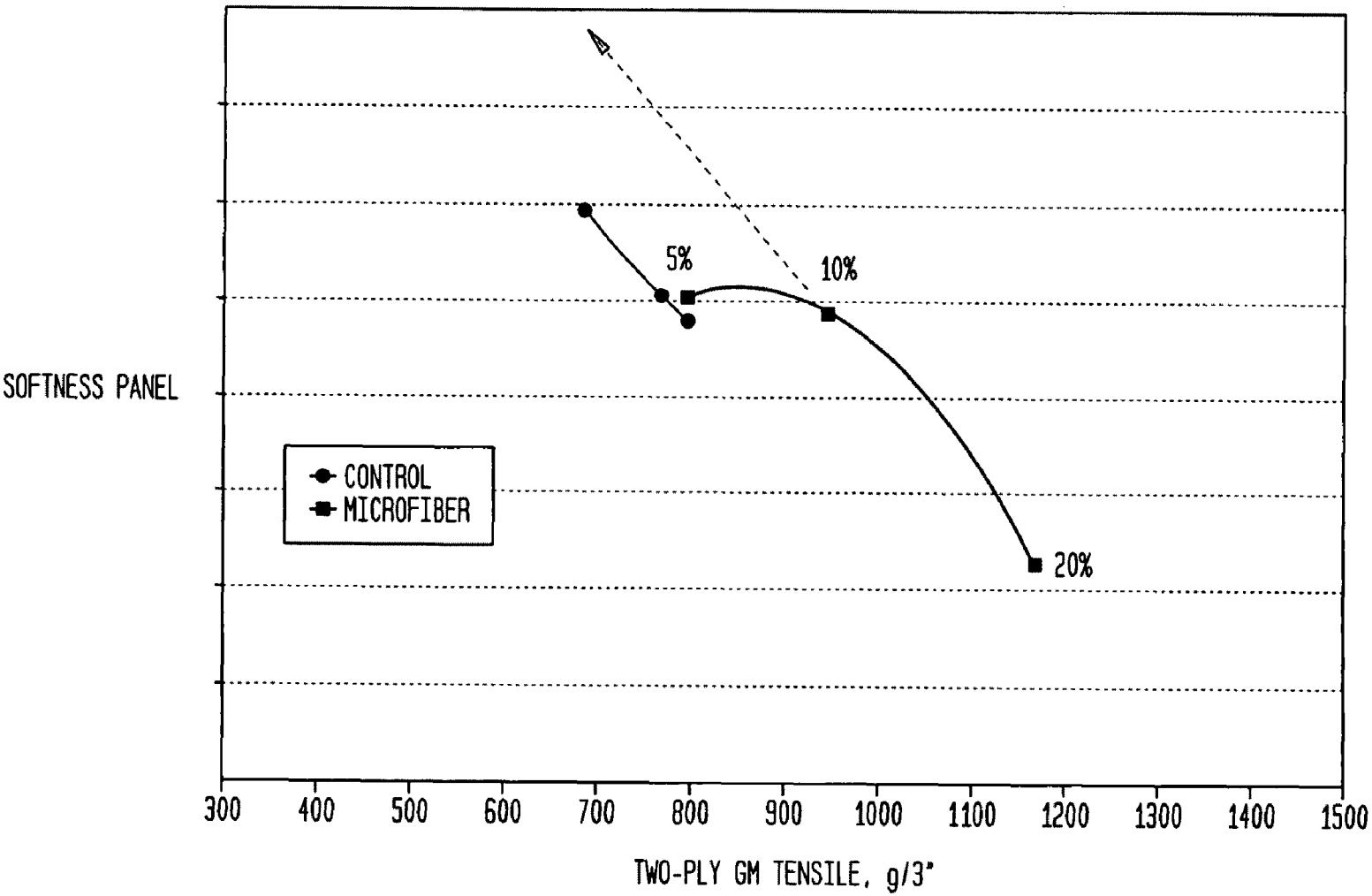
FIG. 19 is a plot of softness (panel) versus two-ply GM tensile for 12 lb/ream tissue base sheet with southern furnish and regenerated cellulose microfiber prepared by a CWP process.
Figure 20:
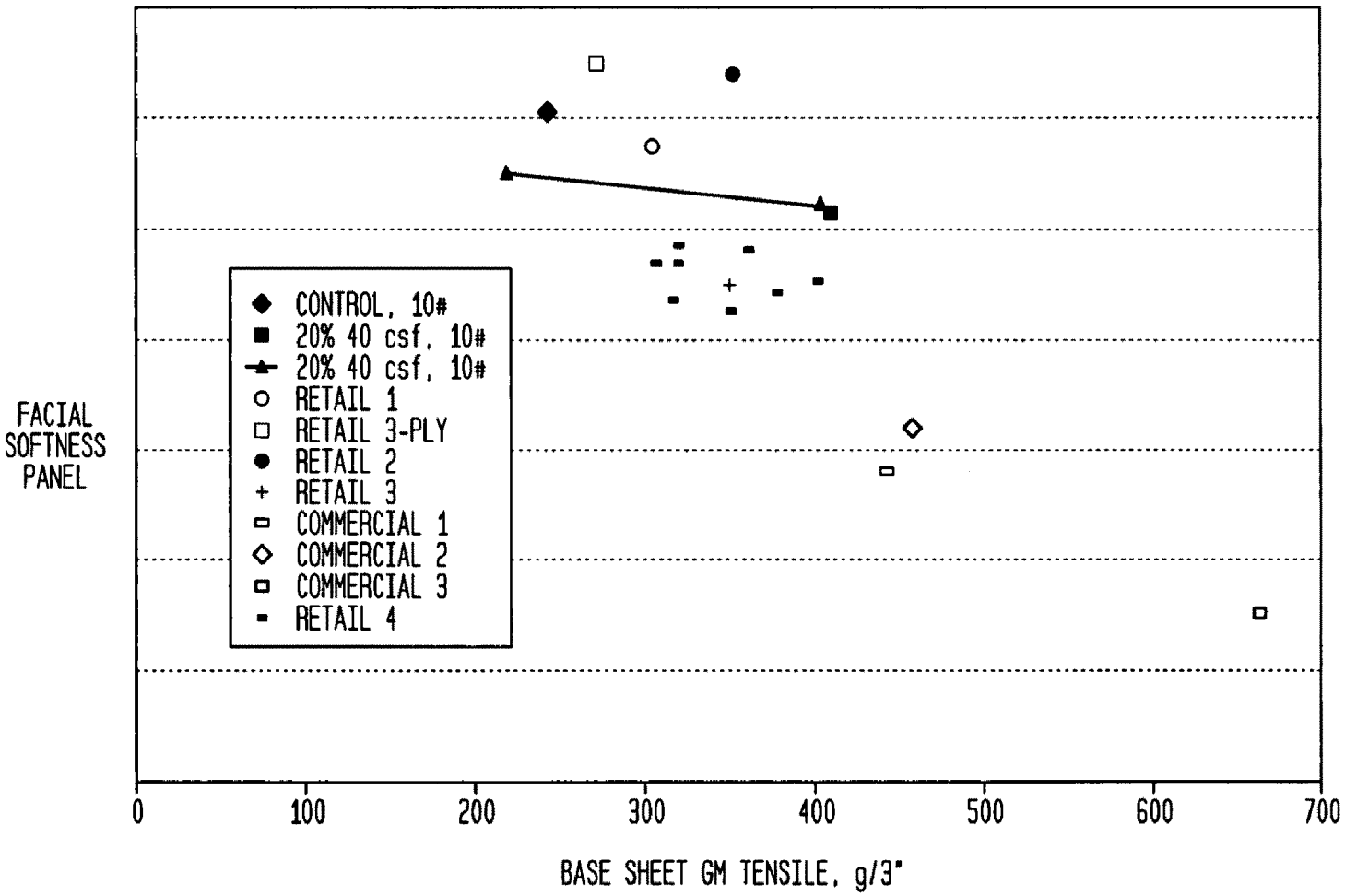
FIG. 20 is a plot of panel softness versus tensile for various tissue sheets.

Bath tissue made with southern furnish and 10% microfiber was 21% stronger than the control at the same softness (FIG. 19). Based on past experience, the sheet with microfiber would be softer than the control if the tensile was reduced through more aggressive creping, calendering, embossing, and so forth. In FIG. 20 it is seen that the lyocell microfiber has an exceptional ability to achieve low basis weight at acceptable tensile levels and softness.

Figure 21:
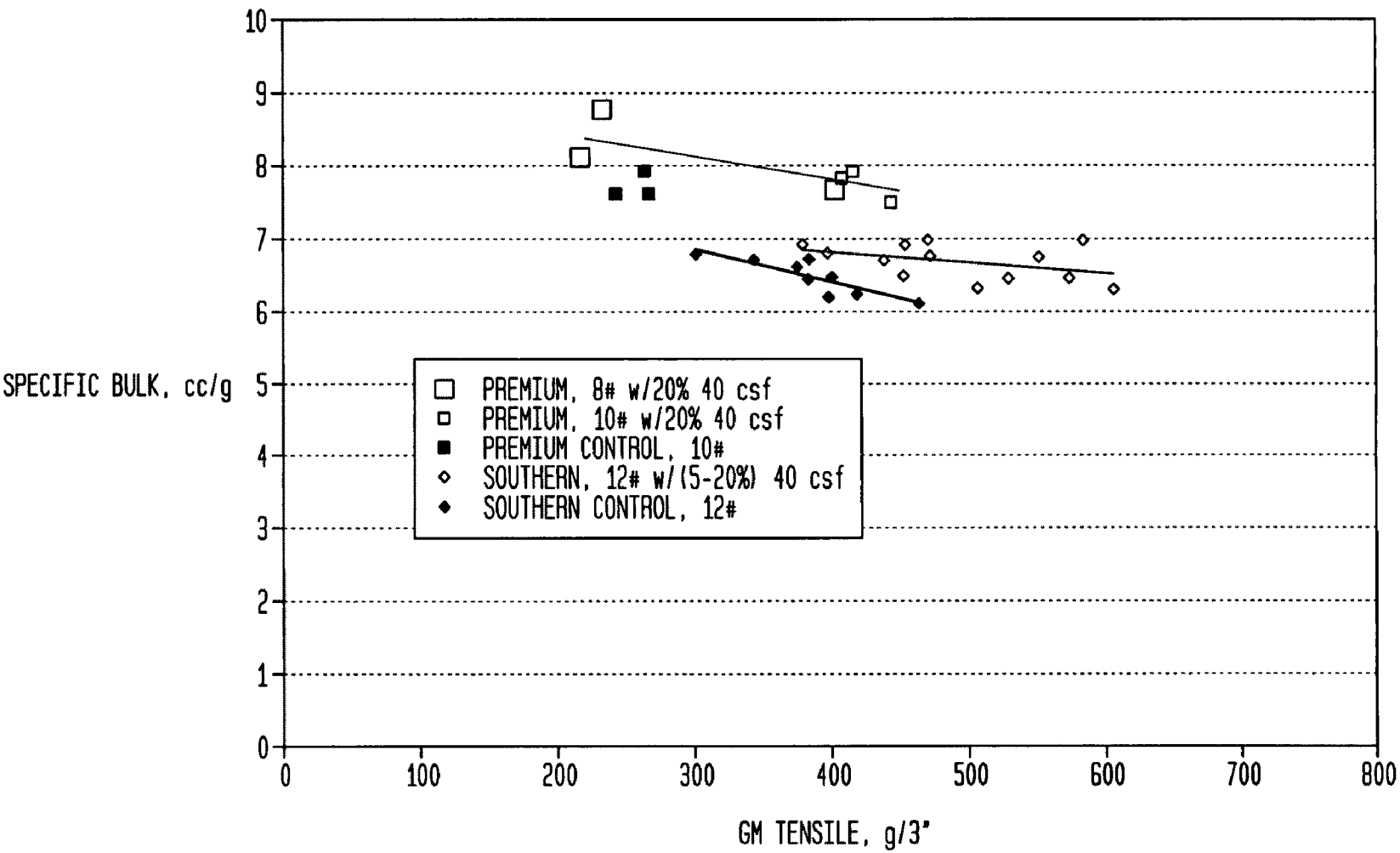
FIG. 21 is a plot of bulk versus tensile for creped CWP base sheet.

In FIG. 21 it is seen that the addition of lyocell microfiber in a CWP process increases bulk at various basis weights and tensile strengths. This is a surprising result inasmuch as one would not expect fine material to increase bulk. This result is not seen in other processes, for example, a fabric creping process where the web is vacuum molded prior to application to a Yankee drying cylinder.

Microfiber benefits both southern furnish and premium furnish (northern softwood and eucalyptus), but southern furnish benefits more.

Microfiber substantially increases strength and stretch in low basis weight tissue. The high fiber population provided by the microfiber makes a very uniform network. Although most of the microfiber tendencies seen in the hand sheet study were confirmed in creped tissue, the large impact of microfiber on tensile and modulus was surprising. Note FIGS. 22-26.

The bulk, strength, and opacity provided by microfiber enables basis weight reduction not achievable with wood pulp alone. Tensile was increased from 250 g/3" @ 10 lb/ream to 400 g/3" @ 8 lb/ream by adding 20% microfiber and a cmc/wsr package. A 5.2 lb/ream sheet was produced at the same tensile as a 10 lb/ream control with the same combination of 20% microfiber and cmc/wsr, and a stronger wood pulp furnish.

Microfiber in towel increases wet tensile, wet/dry ratio, and SAT capacity. This has implications for softer towel or wiper grades. Wet/dry ratio on one sample was increased from about 20% to 39% with the addition of 20% microfiber. Microfiber shifts the SAT/wet strength curve.

Lyocell @217 csf had an unacceptable level of flocs and nits. Therefore, the 400 csf fiber was not used, and the rest of the trial used 40 csf microfiber. The 40 csf microfiber dispersed uniformly, and it was found that the 217 csf microfiber could be dispersed after circulating through the Jordan refiner unloaded for 20 min. The 217 csf was reduced to 20 csf in the process.

Micrographs of Bauer McNett fractions (see FIGS. 3, 4 and 5-9) suggest that half the fibers in the 40 csf lyocell are not disintegrated. The implication of this observation is that the results found in this trial could possibly be obtained with half the addition rate if a process is developed to fibrillate 100% of the fibers.

Yankee adhesion was slightly lower with microfiber in the furnish. Pond height in the head box increased due to lower drainage but was manageable with increased vacuum.

Tensile/Modulus Impacts

Figure 22:
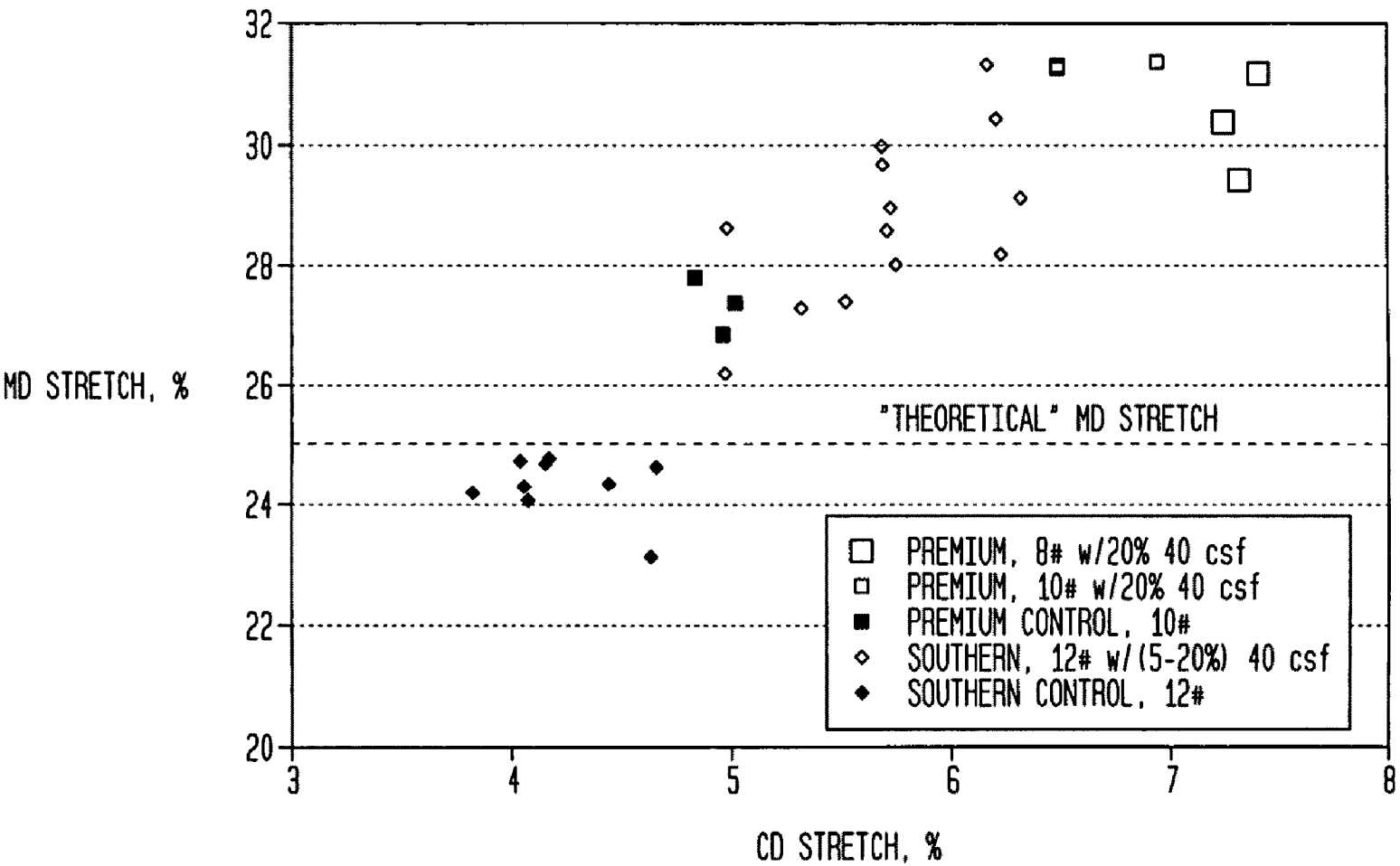
FIG. 22 is a plot of MD stretch versus CD stretch for CWP tissue base sheet.
Figure 23:
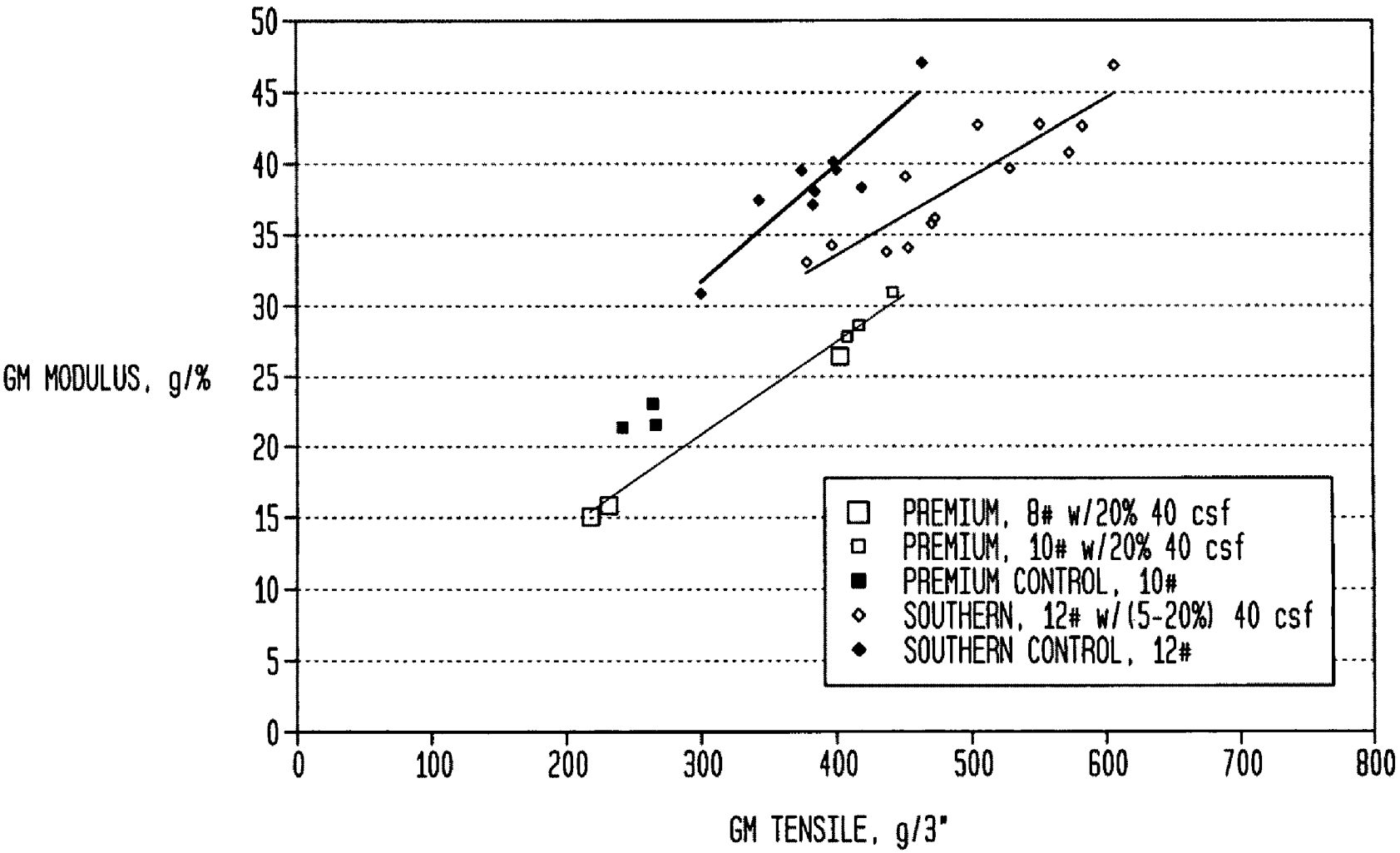
FIG. 23 is a plot of GM Break Modulus versus GM tensile for tissue base sheet.
Figure 24:
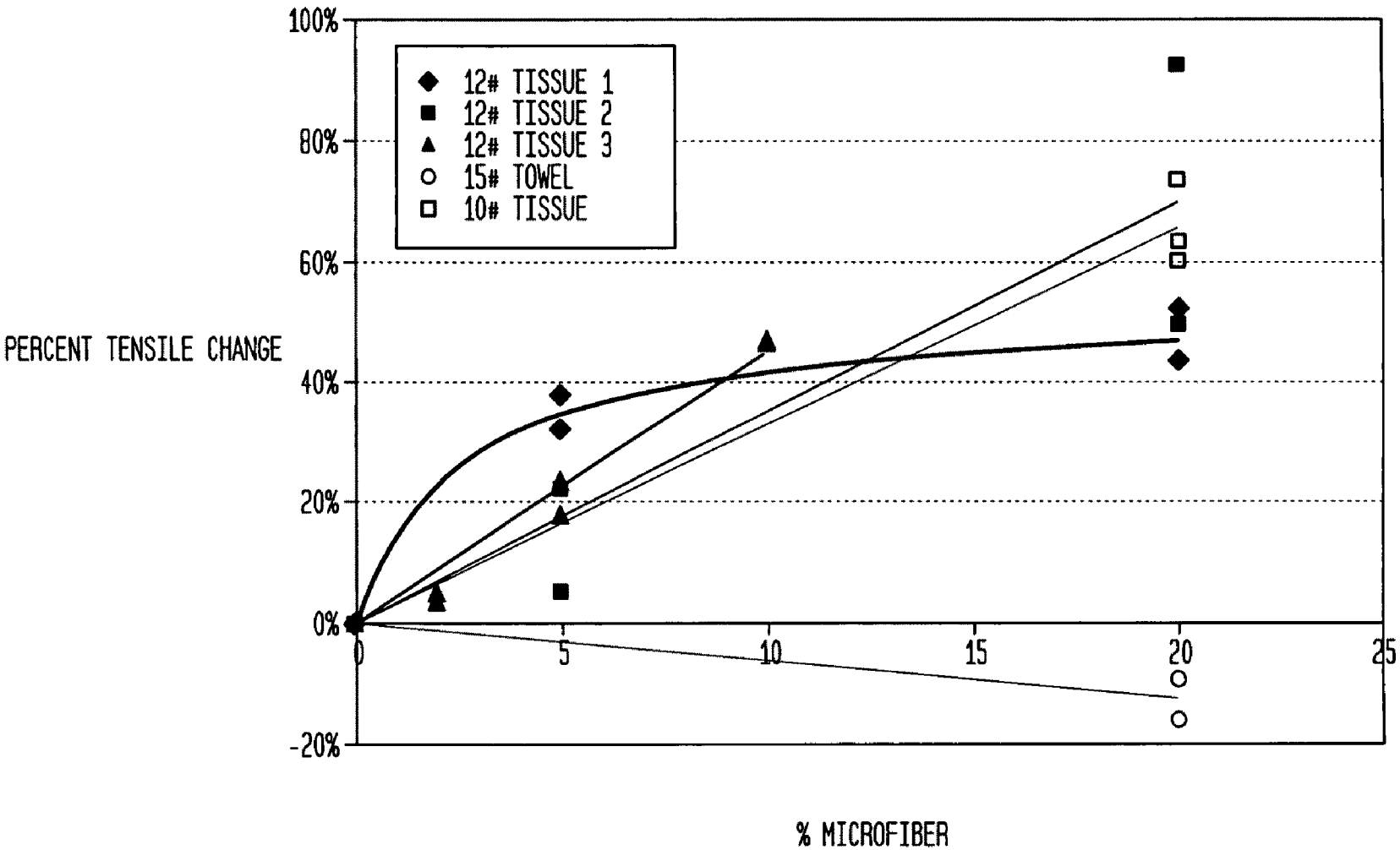
FIG. 24 is a plot of tensile change versus percent microfiber for tissue and towel base sheet.

FIGS. 22, 23 and 24 show salient effects of the microfiber. The microfiber increases the tensile and stretchiness of the sheet. For example, a 12 lb/ream bath tissue base sheet was made with 100% wood pulp comprised of 40% Southern softwood and 60% Southern hardwood. When 20% microfiber was added, the tensile increased 48%, but the modulus increased only 13%. The low increase in modulus resulted from a substantial increase in the stretchiness of the sheet. MD stretch increased from 24.2% to 30.5%, and CD stretch increased from 4.2% to 6.0%. The microfibers benefit southern and premium (northern softwood and eucalyptus) furnish, but the greater benefit is provided to southern furnish. This was demonstrated by comparing the "theoretical" stretch, defined as (yankee speed/reel speed−1)*100. The theoretical MD stretch in this trial was (100/80−1)*100=25%. The definition here is the amount of strain required simply to pull out the crepe of the sheet. It is possible to get actual stretch higher than theoretical stretch because the uncreped sheet also has a small amount of stretch. The southern furnish in this example had 24.2% stretch, slightly below theoretical. In either the southern or premium furnishes, MD stretch is as high as 31-32%. Southern furnish benefits more because it starts from a lower baseline.

FIG. 24 shows the change in tensile resulting from microfiber. Microfiber increases tensile in lightly refined tissue furnishes, but tensile decreases in a towel furnish where a greater percentage of the furnish is refined. The later result is consistent with hand sheets, but the large tensile increase in light weight tissue was surprising and not seen in hand sheets. Note that 20% microfiber in hand sheets with unrefined southern softwood did not result in higher tensile.

Basis Weight Reduction

Figure 25:
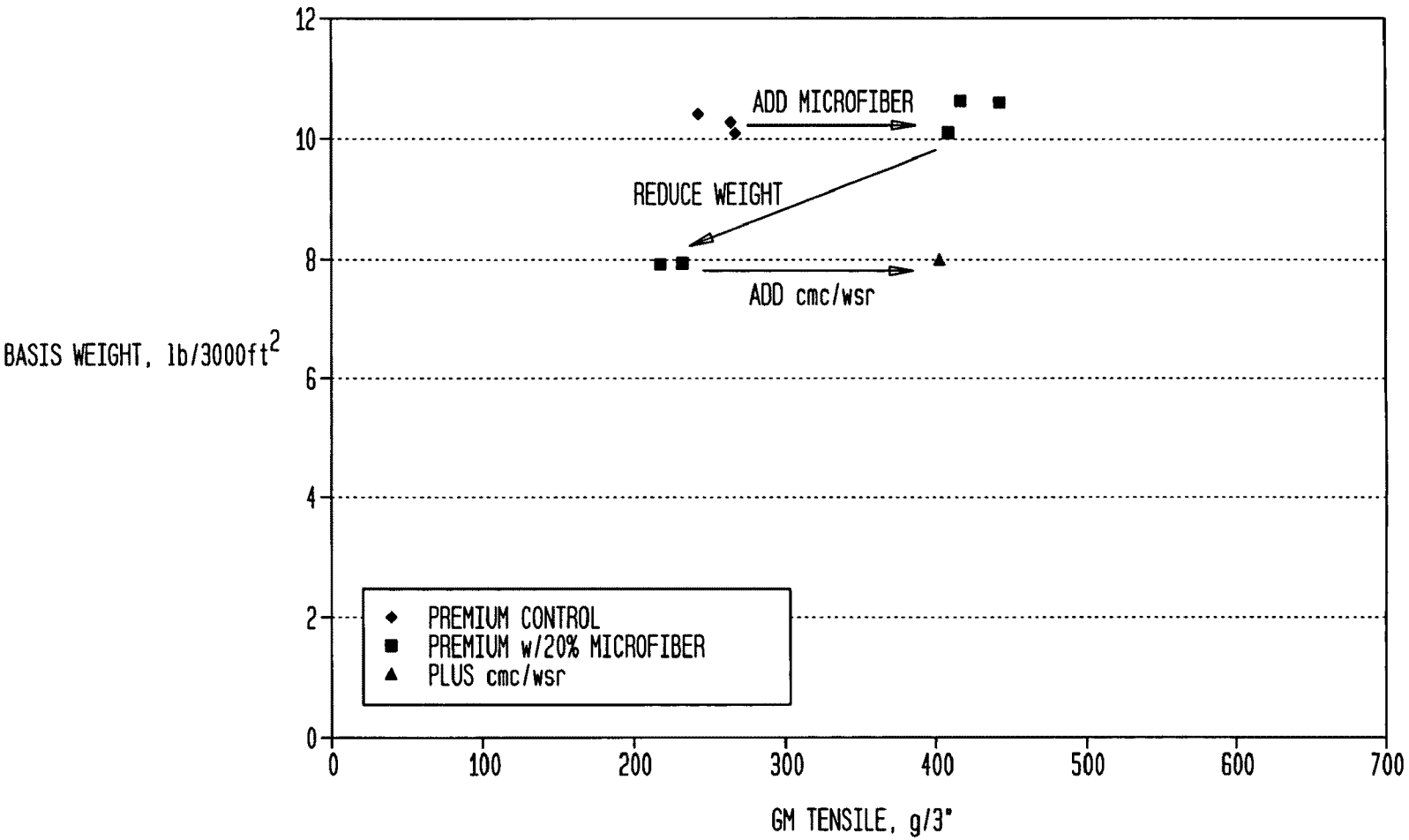
FIG. 25 is a plot of basis weight versus tensile for tissue base sheet.
Figure 26:
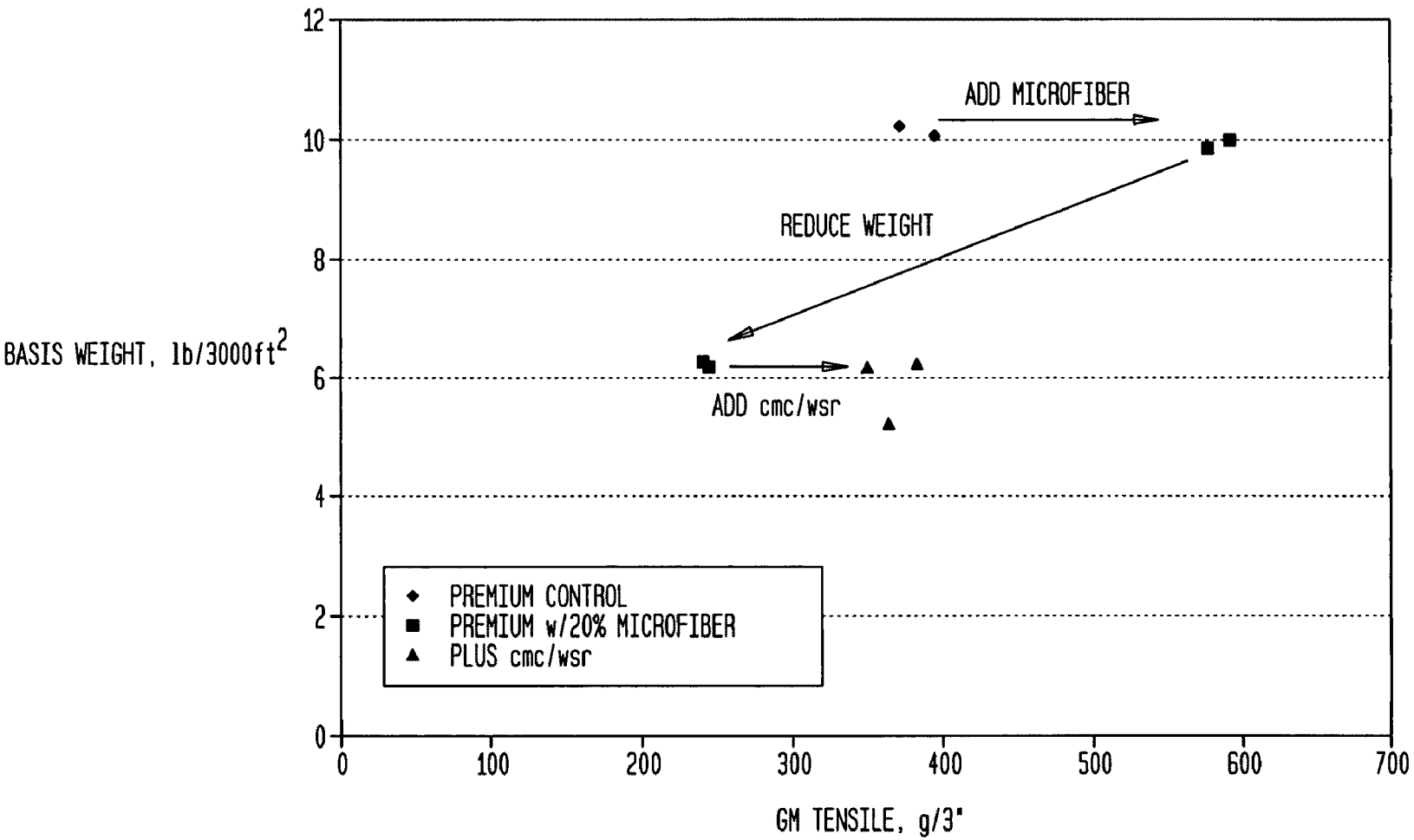
FIG. 26 is a plot of basis weight versus tensile for CWP base sheet.
Figure 27:
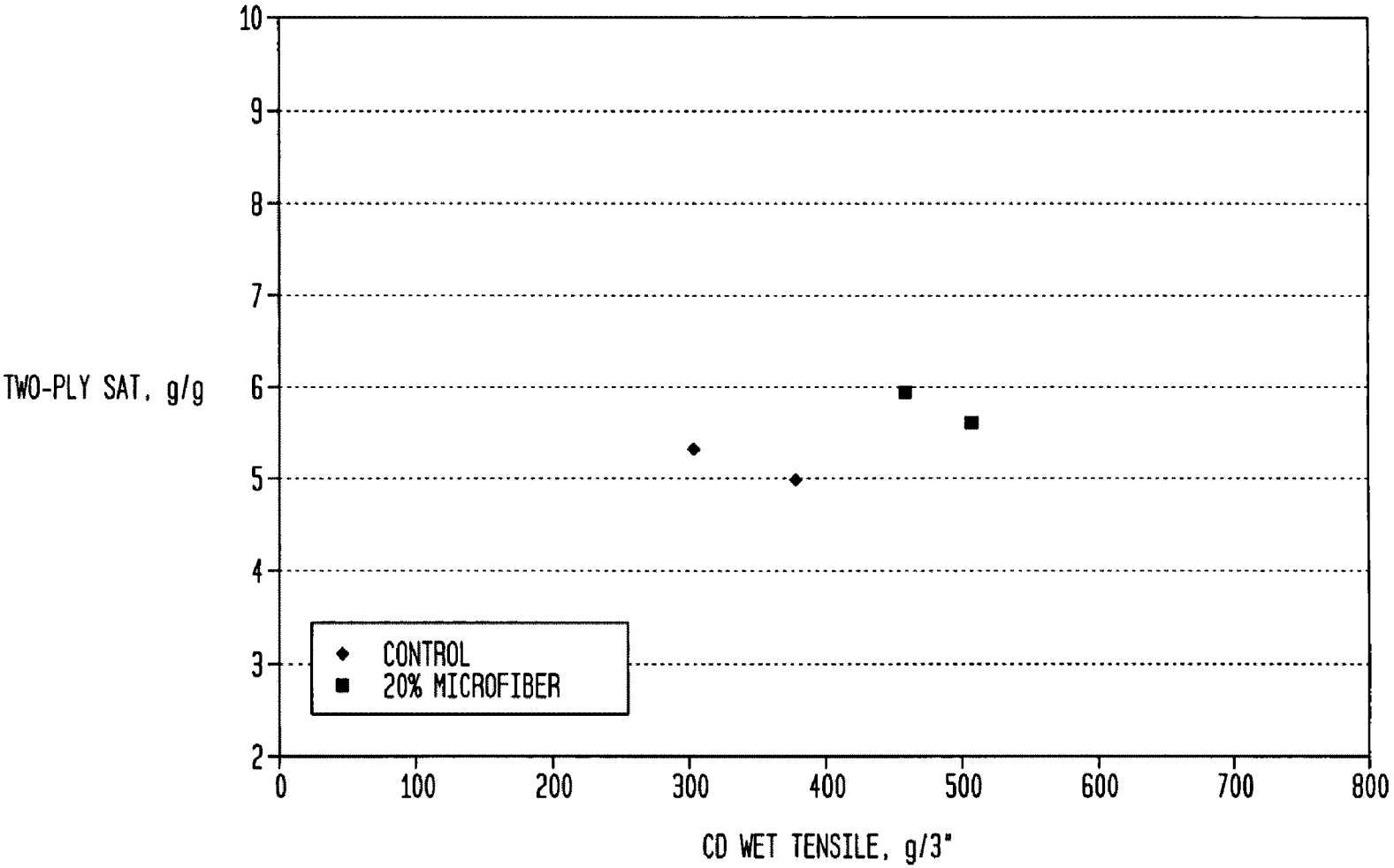
FIG. 27 is a plot of two-ply SAT versus CD wet tensile.
Figure 28:
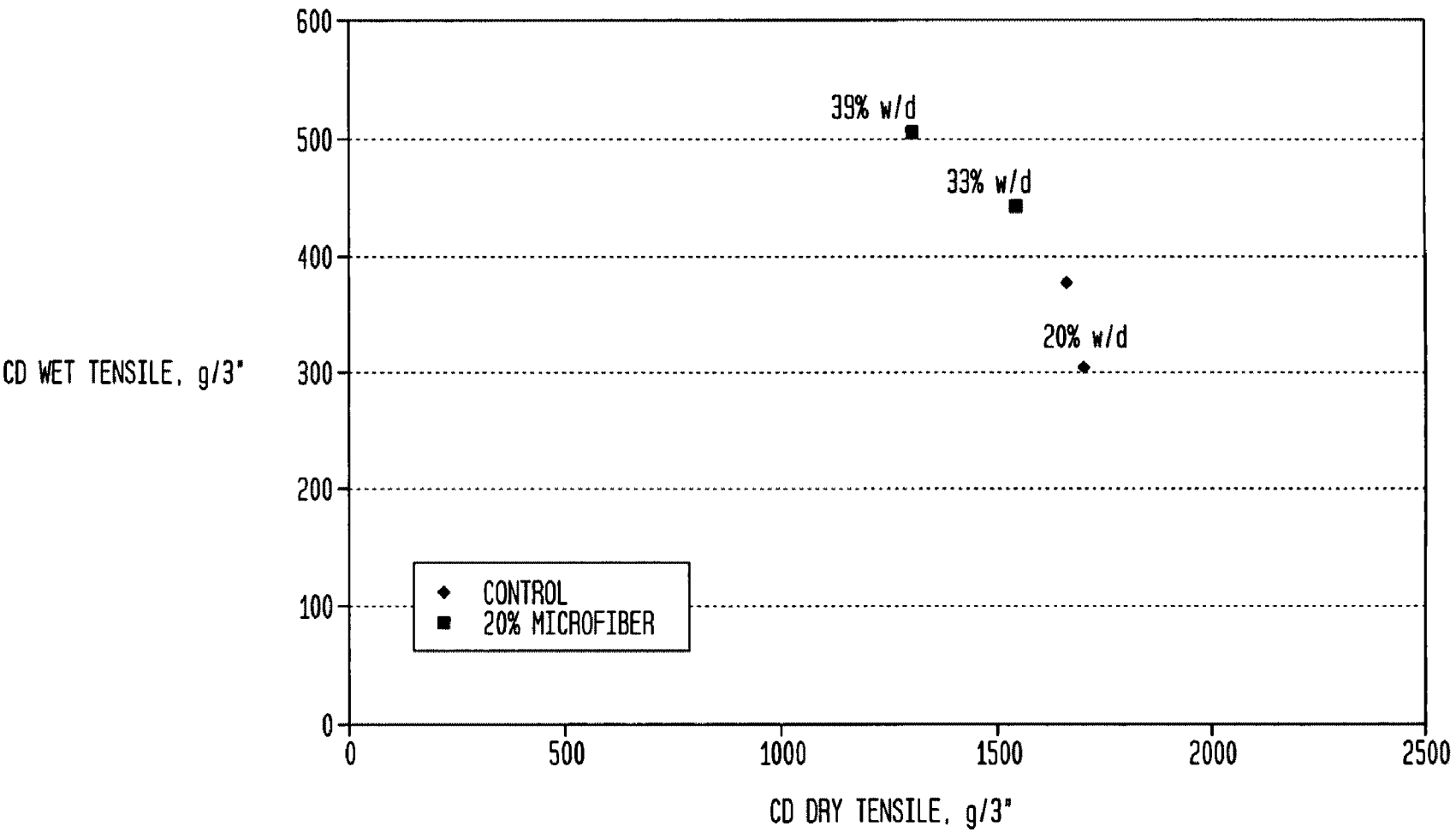
FIG. 28 is a plot of CD wet tensile versus CD dry tensile for CWP base sheet.

Microfiber has potential for substantially reducing basis weight. FIGS. 25, 26 show two examples where basis weight was reduced 25% and 40-50%, respectively. In the first case, a 10 lb/ream base sheet @ 255 g/3" GMT was reduced to 8 lb/ream @ 403 g/3" GMT with 20% microfiber and cmc/wet strength addition. The wet/dry ratio was 32%. The 8 lb/ream sample with 403 g/3" was 58% stronger than the 10 lb/ream control, yet break modulus increased by only 23%. Opacity and formation were good. In a second case, a 10 lb/ream base sheet at about 400 g/3" was reduced to as low as 5.2 lb/ream at the same tensile using the same methodology as the first case. The 8 lb/ream sheets had good uniformity. The 5.2 lb/ream sheet had some holes, but the holes were more related to the limitation of the inclined former on PM 1 than the ability of the fiber to achieve good fiber coverage. A 6 lb/ream sheet with good uniformity and tensile is a significant accomplishment on the current pilot machine. A crescent former may be capable of even lower weights that would not be achievable with 100% wood pulp. While such low weights may not ultimately be used, it demonstrates the degree to which microfiber impacts the integrity of a tissue web.

Towel Properties

Microfiber can improve towel wet strength, wet/dry ratio, and SAT capacity. A 15 lb/ream base sheet was made with a 100% wood pulp furnish comprised of 70% Southern softwood and 30% Southern hardwood. A conventional wet strength package was employed with 4 lb/ton cmc and 20 lb/ton Amres 25HP. Two control rolls had dry tensiles of 2374 and 2400 g/3" gmt, and CD wet tensile ratios of 303/1705=18% and 378/1664=23%. The furnish was changed to 80% wood pulp and 20% cellulose microfibers, and basis weight target was maintained at 15 lb/ream. Bulk increased, opacity increased, break modulus decreased 19%, and dry tensiles decreased to 2013 and 2171 g/3". CD wet/dry on these two rolls increased to 506/1305=39% and 443/1545=29%. SAT capacity increased 15%. SAT capacity and wet strength are typically inversely related, so the fact that microfiber increases both means that the SAT/wet strength curve has been shifted positively. Selected results are presented graphically in FIGS. 27, 28.

Figure 29:
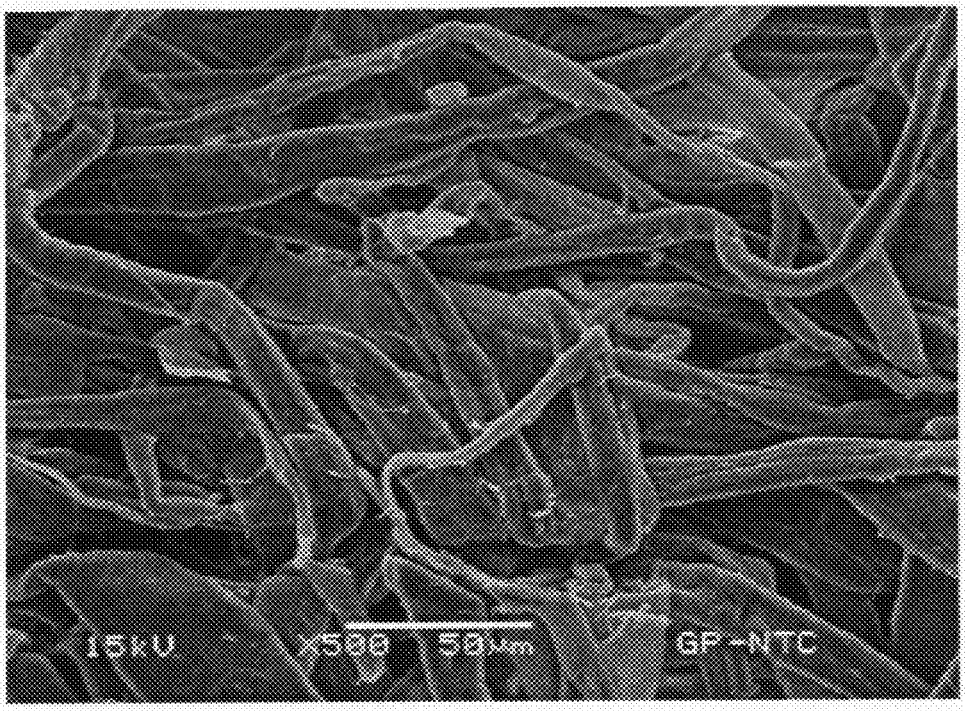
FIG. 29 is a scanning electron micrograph (SEM) of creped tissue without microfiber.
Figure 30:
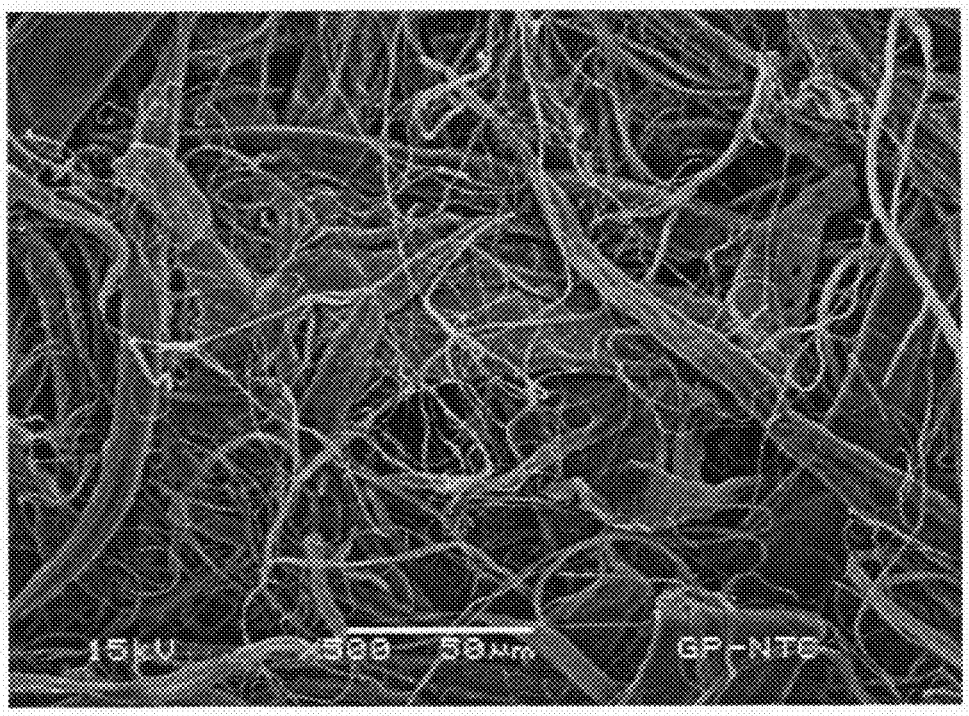
FIG. 30 is a photomicrograph of creped tissue with 20 percent microfiber.

Without intending to be bound by any theory, it is believed the foregoing results stem from the microfiber network provided by the microfiber. FIG. 29 is a photomicrograph of a creped sheet without microfiber and FIG. 30 is a photomicrograph of a corresponding sheet with 20% refined lyocell. It is seen in FIG. 30 that the microfiber greatly enhances fiber networking in the sheet even at low weights due to its extremely high fiber population.

Table 10 shows FQA measurements on various lyocell pulps. Even though it is likely that many microfibers are not seen, some trends can be noticed from those that are seen. Unrefined lyocell has very uniform length, very low fines, and is very straight. Refining reduces fiber length, generates "fines" (which are different than conventional wood pulp fines), and makes the fibrils curly. Comparing the refined 4 mm with the refined 6 mm suggests that initial fiber length within a certain window may not matter for the ultimate fibril length since most parent fibers will be disintegrated into shorter fibrils. 6 mm is preferred over 4 mm since it would avoid the additional processing step of cutting short fibers from tow. For fibrillating lyocell, typical conditions are low consistency (0.5%-1%), low intensity (as defined by conventional refining technology), and high energy (perhaps 20 HPday/ton). High energy is desirable when fibrillating the regenerated cellulose, since it can take a long time at low energy. Up to 6% consistency or more can optionally be used and high energy input, perhaps 20 HPD/T or more may be employed.

Another finding from Table 10 is that the 217 csf lyocell was readily taken down to 20 csf after recirculating through the Jordan refiner unloaded for 20 min. The 20 csf pulp was uniformly dispersed, unlike the 217 csf pulp.

TABLE 10

Fiber Quality Analyzer data for Lyocell fibers.

| Description | Arithmetic Average Length, Ln, mm | Length-weighted Length, Lw, mm | Weight-weighted Length, Lz, mm | Fines, Fw, % | Curl Index Lw | FQA Fiber Width microns |
|---|---|---|---|---|---|---|
| 6 mm Lyocell refined to 40 csf | | | | | | |
| Sample 1 | 0.34 | 1.77 | 3.19 | 19.0 | 0.55 | 16.1 |
| Sample 2 | 0.33 | 1.74 | 3.23 | 19.8 | 0.57 | 17.0 |
| Sample 3 | 0.36 | 1.91 | 3.20 | 18.0 | 0.52 | 16.6 |
| Bauer McNett Fractions, 40 csf | | | | | | |
| 14 fraction | 0.86 | 2.79 | 3.58 | 5.4 | 0.60 | 18.2 |
| 28 fraction | 1.69 | 2.58 | 2.94 | 1.0 | 0.66 | 18.2 |
| 48 fraction | 0.39 | 1.00 | 1.64 | 12.7 | 0.62 | 15.5 |
| 100 fraction | 0.21 | 0.36 | 0.54 | 29.4 | 0.57 | 14.7 |
| 200 fraction | 0.11 | 0.22 | 1.48 | 70.0 | 0.70 | 12.4 |
| 6 mm Lyocell refined to 217 csf | 0.58 | 3.34 | 4.69 | 11.2 | 0.70 | 18.9 |
| 217 csf Lyocell refined to 20 csf | 0.26 | 1.08 | 2.36 | 26.7 | 0.33 | 13.7 |
| 3 mm Lyocell, unrefined | 2.87 | 3.09 | 3.18 | 0.1 | 0.03 | 20.1 |
| 4 mm Lyocell refined to 22 csf | 0.38 | 1.64 | 2.58 | 16.3 | 0.36 | 16.5 |

Mechanism

Without intending to be bound to any theory, the mechanism of how microfiber works appears to be its ability to dramatically improve network uniformity through extremely high surface area. Several observations can be tied together to support this hypothesis: the weakness of lyocell, the different strength results in hand sheets and tissue, and the interactions with unrefined and refined wood pulp.

Unrefined lyocell is very weak by itself and even highly refined lyocell doesn't come close to the strength potential of wood pulp (8-10 km). The alpha cellulose in lyocell and the morphology of the fibrils appear to develop strength through a very high number of weak bonds. The high fibril population provides more connections between wood fibers when added to tissue. Southern furnish in general, and pine in particular, has a low fiber population, which requires higher bond strength than premium furnish for a given strength. Southern softwood can also be difficult to form well, leading to islands of unconnected flocs. Microfiber can bridge the flocs to improve the uniformity of the network. This ability of microfiber becomes more pronounced as basis weight is dropped. Impact on strength is not seen in high basis weight hand sheets because there are sufficient wood fibers to fill in the sheet.

INDUSTRIAL APPLICABILITY

Fibrillated lyocell is expensive relative to southern furnish, but it provides capabilities that have not been obtainable by other means. Fibrillated lyocell fibers at relatively low addition rates can enhance southern furnish at competive cost relative to premium furnish.

Additional Examples

Additional exemplary configurations include a three ply facial product comprised of two outer plies with exceptional softness and an inner ply with wet strength, and perhaps a higher level of dry strength than the outer plies. The product is made by a combination of cellulose microfibers and appropriate chemistries to impart the desired properties. It may be possible to make exceptionally low basis weights while achieving a soft product with good strength.

The microfibers provide enormous surface area and network uniformity due to exceptionally high fiber population. The quality of the network leads to higher wet/dry tensiles.

The absorbency findings (rate and capacity) are attributed to a smaller pore structure created by the microfibers. There may be a more optimal addition rate where the capacity and other benefits are realized without reducing the rate.

Bath Tissue with Southern Furnish

A 12 lb/ream bath tissue base sheet was made with 100% wood pulp comprised of 40% Southern softwood and 60% Southern hardwood. Two rolls were made with tensiles of 384 and 385 g/3" GMT and break moduli of 37.2 and 38.2 g %. The furnish was changed to 80% wood pulp and 20% cellulose microfibers. Two rolls were made with tensiles of 584 and 551 g/3" GMT and break moduli of 42.7 and 42.9 g %. The tensile increased 48%, but the modulus increased only 13%. The low increase in modulus resulted from a substantial increase in the stretchiness of the sheet. MD stretch increased from 24.2% to 30.5%, and CD stretch increased from 4.2% to 6.0%. The southern furnish in this example had 24.2% stretch, slightly below theoretical. Premium furnish in Example 1 gave about a 27% MD stretch. In either the southern or premium furnishes, MD stretch is as high as 31-32%. Southern furnish benefits more because it starts from a lower baseline.

Microfibers may be more beneficial in fabric-crepe processes than conventional through-dry processes which require high permeability. The reason is that microfibers may tend to close the sheet pore structure so that air flow would be reduced in conventional TAD, but are not problematic for wet pressing/fabric crepe processes where the sheet is compactively dewatered. One way to leverage the benefit of microfiber is to reduce basis weight, but bulk could then become an issue for certain products. The microfiber in combination with papermaking processes that mold the sheet could be particularly advantageous for making low basis weight products with adequate bulk. It should be noted that the microfibers favorably shift the bulk/strength relationship for CWP sheet. The cellulosic substrate can be prepared according to conventional processes (including TAD, CWP and variants thereof) known to those skilled in the art. In many cases, the fabric creping techniques revealed in the following co-pending applications will be especially suitable: U.S. patent application Ser. No. 11/678,669, entitled "Method of Controlling Adhesive Build-Up on a Yankee Dryer"; U.S. patent application Ser. No. 11/451,112 (Publication No. US 2006-0289133), filed Jun. 12, 2006, entitled "Fabric-Creped Sheet for Dispensers"; U.S. Ser. No. 11/451,111, filed Jun. 12, 2006 (Publication No. US 2006-0289134), entitled "Method of Making Fabric-creped Sheet for Dispensers"; U.S. patent application Ser. No. 11/402,609 (Publication No. US 2006-0237154), filed Apr. 12, 2006, entitled "Multi-Ply Paper Towel With Absorbent Core"; U.S. patent application Ser. No. 11/151,761, filed Jun. 14, 2005 (Publication No. US 2005/0279471), entitled "High Solids Fabric-crepe Process for Producing Absorbent Sheet with In-Fabric Drying"; U.S. application Ser. No. 11/108,458, filed Apr. 18, 2005 (Publication No. US 2005-0241787), entitled "Fabric-Crepe and In Fabric Drying Process for Producing Absorbent Sheet"; U.S. application Ser. No. 11/108,375, filed Apr. 18, 2005 (Publication No. US 2005-0217814), entitled "Fabric-crepe/Draw Process for Producing Absorbent Sheet"; U.S. application Ser. No. 11/104,014, filed Apr. 12, 2005 (Publication No. US 2005-0241786), entitled "Wet-Pressed Tissue and Towel Products With Elevated CD Stretch and Low Tensile Ratios Made With a High Solids Fabric-Crepe Process"; U.S. application Ser. No. 10/679,862 (Publication No. US 2004-0238135), filed Oct. 6, 2003, entitled "Fabric-crepe Process for Making Absorbent Sheet"; U.S. patent application Ser. No. 12/033,207, filed Feb. 19, 2008, entitled "Fabric Crepe Process With Prolonged Production Cycle"; and U.S. Provisional Patent Application Ser. No. 60/808,863, filed May 26, 2006, entitled "Fabric-creped Absorbent Sheet with Variable Local Basis Weight". The applications referred to immediately above are particularly relevant to the selection of machinery, materials, processing conditions and so forth as to fabric creped products of the present invention and the disclosures of these applications are incorporated herein by reference.

A wet web may also be dried or initially dewatered by thermal means by way of throughdrying or impingement air drying. Suitable rotary impingement air drying equipment is described in U.S. Pat. No. 6,432,267 to Watson and U.S. Pat. No. 6,447,640 to Watson et al.

Towel Examples 78-89

Towel-type handsheets were prepared with softwood/lyocell furnish and tested for physical properties and to determine the effect of additives on wet/dry CD tensile ratios. It has also been found that pretreatment of the pulp with a debonder composition is surprisingly effective in increasing the wet/dry CD tensile ratio of the product, enabling still softer products. Details are given below and appear in Table 11.

The wood pulp employed in Examples 78-89 was Southern Softwood Kraft. CMC is an abbreviation for carboxymethyl cellulose, a dry strength resin, which was added @ 5 lb/ton of fiber. A wet strength resin (Wsr) was also added in these examples; Amres 25 HP (Georgia Pacific) was added @ 20 lb/ton of fiber (including lyocell content in the fiber weight). The debonder composition (Db) utilized was a Type C, ion paired debonder composition as described above applied @ 10% active and was added based on the weight of pulp-derived papermaking fiber, exclusive of lyocell content.

The cmf used was lyocell fiber, 6 mm×1.5 denier which was refined to 40 ml CSF prior to adding it to the furnish.

The procedure followed is described below:

1. The pulp was pre-soaked in water before disintegration.
2. The pulp for Cells 79, 81, 83, 85 and 86-89 was prepared by adding the debonder in the amounts indicated to the British disintegrator, then adding the pre-soaked dry lap to about 3% consistency and disintegrating.
3. Where refining is indicated in Table 11, the pulp was split in half; half the pulp was thickened for refining and refined for 1000 revs and rediluted to 3% with the filtrate.
4. The pulp halves were re-combined in a beaker and, with vigorous stirring, the AMRES wet-strength resin was added. After 5 min the CMC was added. After another 5 min the pulp was then diluted and the handsheets were made; 0.5 g handsheets, pressed @ 15 psi/5 min, dried on a drum dryer and cured in a forced air oven @ 105° C./5 min.
5. The pulp for Cells 78, 80, 82, 84 were made by way of the steps above, leaving out the debonder, and sometimes not refining as indicated in Table 11.
6. For Examples having 20% cmf, the cmf was added to the softwood before the wsr/cmc additions.

TABLE 11

Handsheet Properties

| Sample | Description | Basis Weight Raw Wt g | Caliper 5 Sheet mils/ 5 sht | Tensile g/3 in | Breaking Length, km | Stretch % | T.E.A. mm-gm/ mm^2 |
|---|---|---|---|---|---|---|---|
| 78 | 100% SW, Unrefined, no debonder | 0.541 | 14.78 | 7753 | 3.76 | 3.5 | 2.077 |
| 79 | 100% SW, Unrefined, debonder | 0.549 | 14.50 | 7380 | 3.53 | 3.5 | 1.873 |
| 80 | 100% SW, Refined, no debonder | 0.536 | 13.26 | 12281 | 6.01 | 3.8 | 3.433 |
| 81 | 100% SW, Refined, debonder | 0.517 | 12.70 | 11278 | 5.72 | 3.8 | 3.134 |
| 82 | 80% SW-20% cmf, Unrefined, no debonder | 0.512 | 14.46 | 5889 | 3.02 | 5.0 | 2.528 |
| 83 | 80% SW-20% cmf, Unrefined, debonder | 0.535 | 14.88 | 6040 | 2.96 | 4.7 | 2.403 |
| 84 | 80% SW-20% cmf, Refined, no debonder | 0.529 | 14.19 | 8420 | 4.18 | 5.5 | 3.970 |
| 85 | 80% SW-20% cmf, Unrefined, debonder | 0.511 | 13.37 | 7361 | 3.78 | 5.2 | 3.254 |
| 86 | 100% SW, Unrefined, 15 #/T debonder | 0.520 | 14.39 | 4255 | 2.15 | 2.2 | 0.699 |
| 87 | 100% SW, Refined, 15 #/T debonder | 0.535 | 13.82 | 7951 | 3.90 | 3.3 | 2.136 |
| 88 | 80% SW-20% cmf, Unrefined, 15 #/debonder | 0.510 | 14.72 | 4200 | 2.16 | 3.8 | 1.346 |
| 89 | 80% SW-20% cmf, Refined, 15 #/debonder | 0.523 | 13.76 | 6092 | 3.06 | 3.5 | 1.764 |

| Sample | Description | Basis Weight g/m^2 | Bulk cm^3/g | Break Modulus (gms/3")/% | Wet Tens Finch Cured g/3 in. | Wet/dry | Wet Breaking Length, km | Basis weight, lb/3000 ft^2 |
|---|---|---|---|---|---|---|---|---|
| 78 | 100% SW, Unrefined, no debonder | 27.03 | 2.777 | 2,210.42 | 1,950.28 | 25.2% | 0.947 | 16.6 |
| 79 | 100% SW, Unrefined, debonder | 27.43 | 2.686 | 2,144.02 | 1,942.54 | 26.3% | 0.929 | 16.8 |
| 80 | 100% SW, Refined, no debonder | 26.81 | 2.513 | 3,234.22 | 2,972.68 | 24.2% | 1.455 | 16.5 |
| 81 | 100% SW, Refined, debonder | 25.86 | 2.494 | 3,001.87 | 2,578.17 | 22.9% | 1.308 | 15.9 |
| 82 | 80% SW-20% cmf, Unrefined, no debonder | 25.60 | 2.868 | 1,179.91 | 2,421.25 | 41.1% | 1.241 | 15.7 |
| 83 | 80% SW-20% cmf, Unrefined, debonder | 26.75 | 2.827 | 1,305.43 | 2,218.00 | 36.7% | 1.088 | 16.4 |
| 84 | 80% SW-20% cmf, Refined, no debonder | 26.44 | 2.726 | 1,537.60 | 2,784.00 | 33.1% | 1.382 | 16.2 |
| 85 | 80% SW-20% cmf, Unrefined, debonder | 25.54 | 2.661 | 1,416.99 | 2,784.63 | 37.8% | 1.431 | 15.7 |
| 86 | 100% SW, Unrefined, 15 #/T debonder | 26.00 | 2.812 | 1,913.19 | 1,257.87 | 29.6% | 0.635 | 16.0 |
| 87 | 100% SW, Refined, 15 #/T debonder | 26.73 | 2.628 | 2,398.30 | 2,555.01 | 32.1% | 1.255 | 16.4 |
| 88 | 80% SW-20% cmf, Unref, 15 #/debonder | 25.52 | 2.930 | 1,129.36 | 1,712.95 | 40.8% | 0.881 | 15.7 |
| 89 | 80% SW-20% cmf, Refined, 15 #/debonder | 26.14 | 2.675 | 1,746.57 | 2,858.03 | 46.9% | 1.435 | 16.0 |

Figure 31:
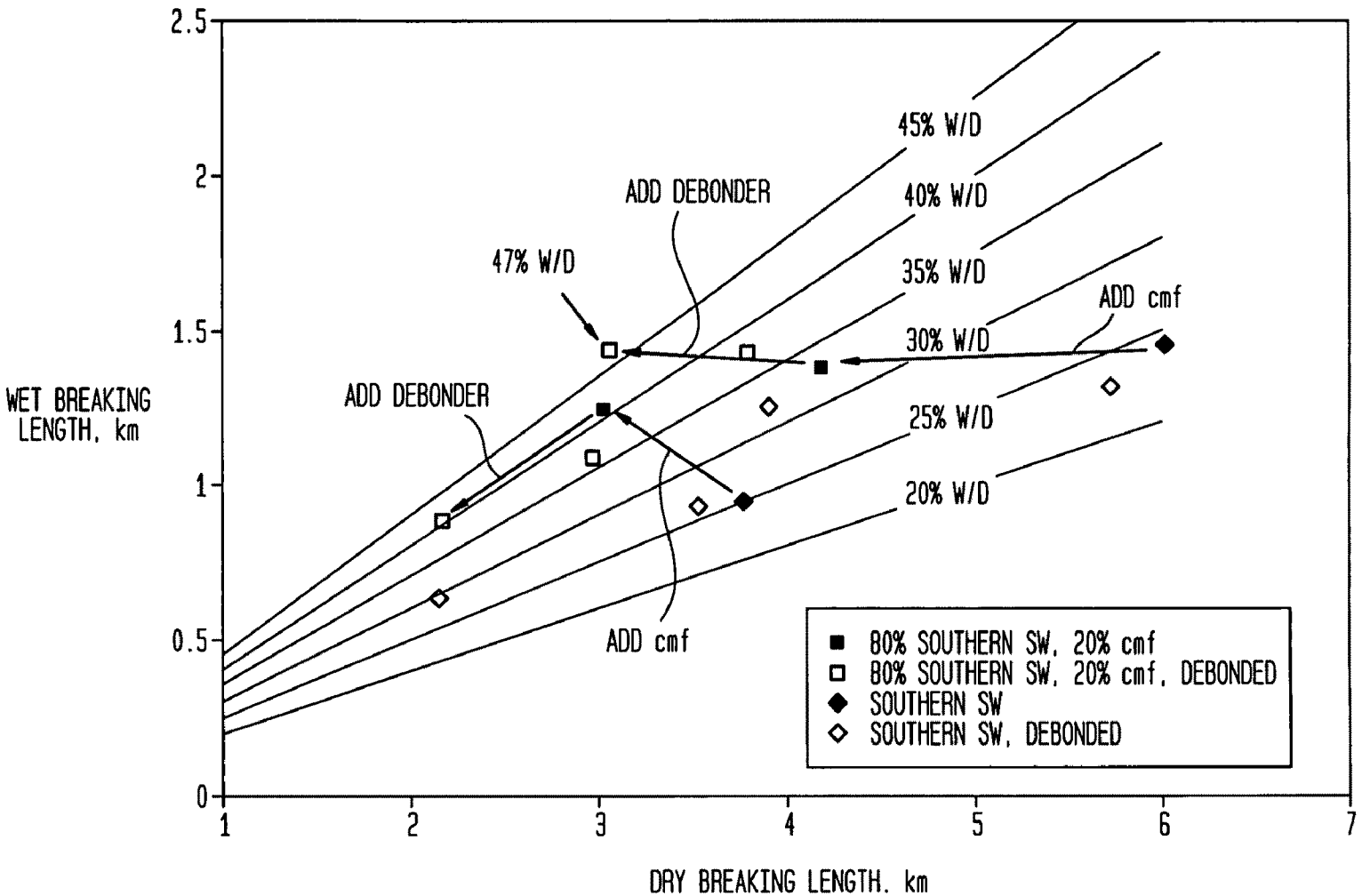
FIG. 31 is a plot of Wet Breaking Length versus Dry Breaking Length for various products, showing the effects of regenerated cellulose microfiber and debonder on product tensiles.
Figure 32:
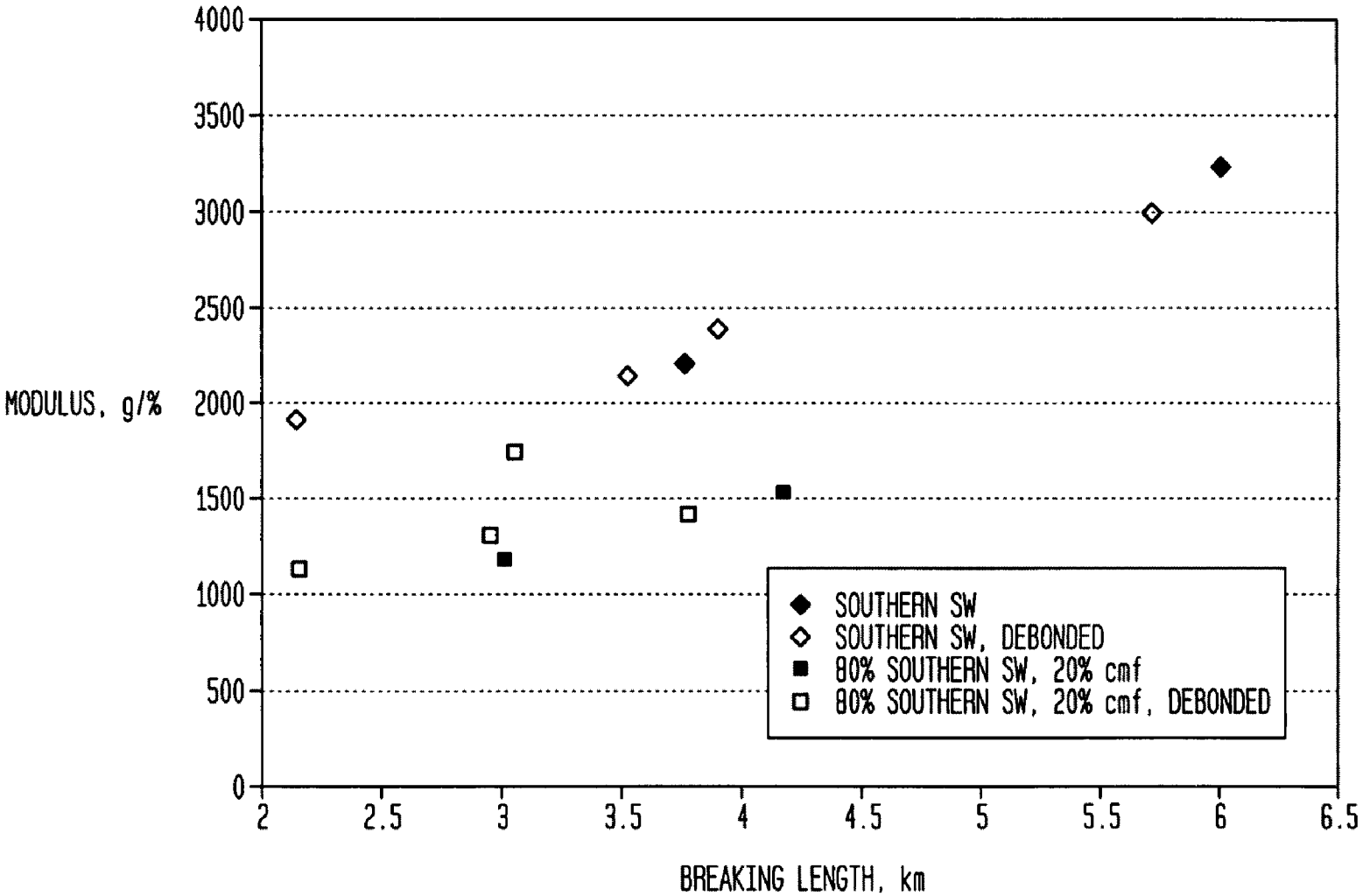
FIG. 32 is a plot of GM Break Modulus versus Breaking Length, showing the effect of regenerated cellulose microfiber and debonder on product stiffness.
Figure 33:
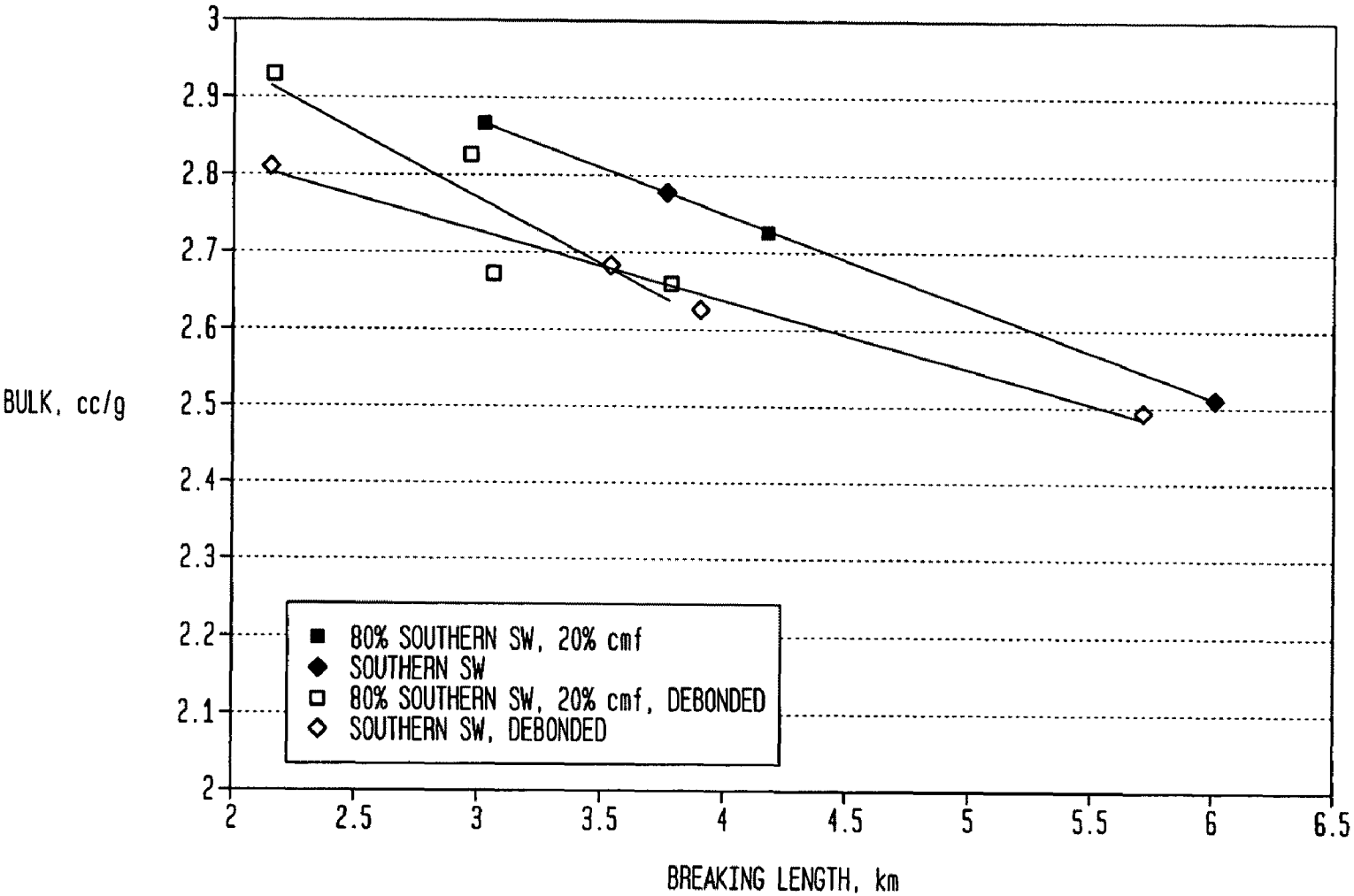
FIG. 33 is a plot of Bulk versus Breaking Length showing the effect of regenerated cellulose microfiber and debonder or product bulk.

The effect of pretreating the softwood pulp with debonder is seen in FIG. 31. The wet/dry tensile ratio is greatly increased by both the cmf and debonder pretreatment. In some cases, wet strength stays virtually constant as dry strength decreases. The dry strength of a towel is often dictated by the required wet strength, leading to products that are relatively stiff. For example, a towel with 25% wet/dry tensile ratio may have dry strength substantially stronger than desired in order to meet wet strength needs. Refining is usually required to increase the strength, which decreases bulk and absorbency. Increasing the wet/dry tensile ratio from 24 to 47% allows dry tensile to be cut almost in half. The lower modulus at a given tensile provided by the cmf also contributes to better hand feel (FIG. 32). The debonder reduced bulk somewhat in the samples tested (FIG. 33).

Figure 34:
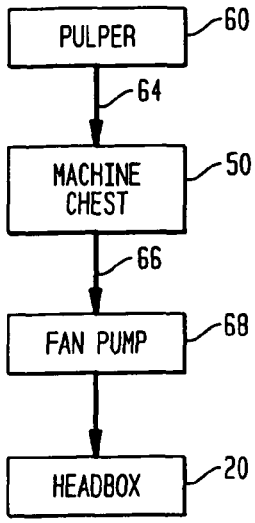
FIG. 34 is a flow diagram illustrating fiber pre-treatment prior to feeding the furnish to a papermachine.

In commercial processes, it is preferred to pre-treat the pulp-derived papermaking fibers upstream of the machine chest for purposes of runnability as is noted in copending U.S. Patent Application Ser. No. 60/850,681, filed Oct. 10, 2006, entitled "Method of Producing Absorbent Sheet with Increased Wet/Dry CD Tensile Ratio" incorporated by reference above and as seen in FIG. 34. In a typical application of the present invention, debonder is added to the furnish in a pulper 60 as shown in FIG. 34 which is a flow diagram illustrating schematically pulp feed to a papermachine. Debonder is added in pulper 60 while the fiber is at a consistency of anywhere from about 3 percent to about 10 percent. Thereafter, the mixture is pulped after debonder addition for 10 minutes or more before wet strength or dry strength resin is added. The pulped fiber is diluted, typically to a consistency of 1 percent or so and fed forward to a machine chest 50 where other additives, including permanent wet strength resin and dry strength resin, may be added. If so desired, the wet strength resin and dry strength resin may be added in the pulper or upstream or downstream of the machine chest, i.e., at 64 or 66; however, they should be added after debonder as noted above and the dry strength resin is preferably added after the wet strength resin. The furnish may be refined and/or cleaned before or after it is provided to the machine chest as is known in the art.

From machine chest 50, the furnish is further diluted to a consistency of 0.1 percent or so and fed forward to a headbox, such as headbox 20 by way of a fan pump 68.

Tissue Base Sheet Opacity

Utilizing a papermachine of the class shown in FIG. 18, tissue base sheets of various basis weights were prepared utilizing fibrillated regeneratd cellulose microfiber and recycle pulp-derived papermaking fiber. TAPPI opacity was measured and correlates with basis weight as shown in FIG. 35 which is a plot of TAPPI opacity vs. basis weight for 7 and 10 lb tissue base sheets having the compositions noted on the Figure.

Figure 35:
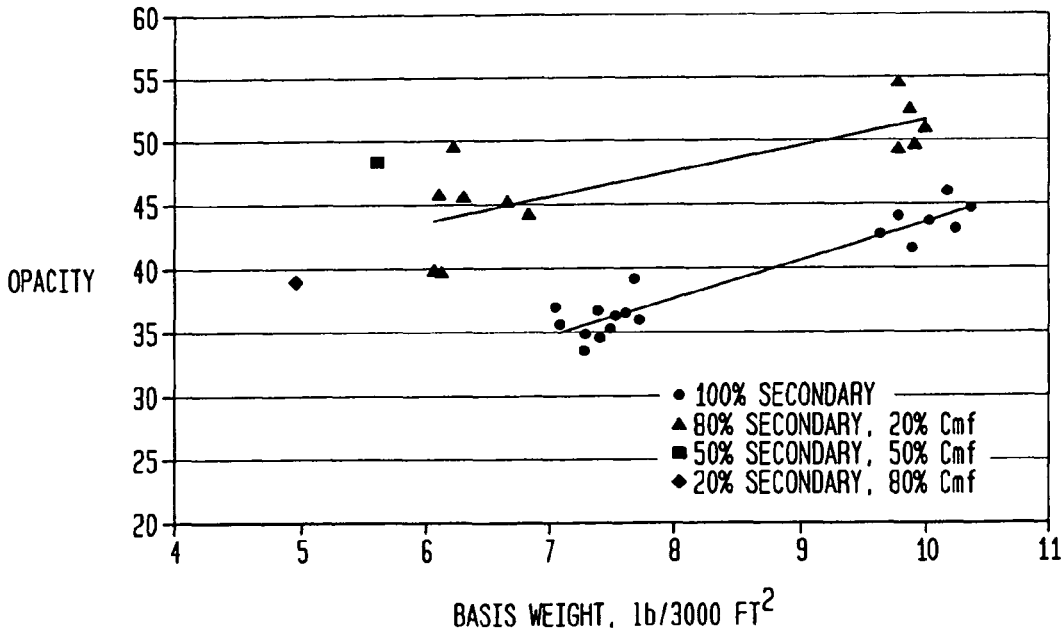
FIG. 35 is a plot of TAPPI opacity vs. basis weight showing that regenerated cellulose microfiber greatly increases the opacity of tissue base sheet prepared with recycle furnish.

It is seen in FIG. 35 that large increases in opacity, typically in the range of about 30%-40% and more is readily obtained using fibrillated regenerated cellulose microfiber. Coupled with the strength increases observed with this invention, it is thus possible in accordance with the invention to provide high quality tissue products using much less fiber than conventional products.

While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. A method of making absorbent cellulosic sheet comprising:

(a) preparing an aqueous furnish with a fiber mixture including from about 99 percent to about 70 percent of a pulp-derived papermaking fiber, the fiber mixture also including from about 1 to 30 percent by weight of fibrillated regenerated cellulose microfibers having a CSF value of less than 175 ml wherein the regenerated cellulose is prepared from a cellulosic dope of dissolved cellulose comprising a solvent selected from ionic liquids and tertiary amine N-oxides;

(b) pretreating at least a portion of the fiber mixture with a debonder composition;

(c) depositing the debonder-treated aqueous furnish on a foraminous support to form a nascent web and at least partially dewatering the nascent web; and (d) drying the web to provide absorbent sheet;

wherein formation of the sheet and pretreatment of the fiber are controlled and the furnish and debonder is selected such that the sheet has a wet/dry CD tensile ratio in the range of greater than 30%.

2. The method of making absorbent cellulosic sheet according to claim 1, wherein the pulp-derived papermaking fiber is treated with debonder concurrently with pulping of the fiber.

3. The method of making absorbent cellulosic sheet according to claim 1, further comprising refining the pulp-derived papermaking fiber.

4. The method of making absorbent cellulosic sheet according to claim 1, wherein the pulp-derived papermaking fiber is treated with the debonder composition prior to refining the pulp-derived papermaking fiber.

5. The method of making absorbent cellulosic sheet according to claim 1, further comprising adding a dry strength resin to the finish.

6. The method of making absorbent cellulosic sheet according to claim 1, further comprising adding a wet strength resin to the furnish.

7. The method of making absorbent cellulosic sheet according to claim 1, wherein the pulp-derived fiber is pretreated with the debonder composition in an amount from about 1 pound of debonder composition per ton of pulp-derived fiber to about 50 lbs of debonder composition per ton of pulp-derived fiber.

8. The method of making absorbent cellulosic sheet according to claim 1, wherein the pulp-derived fiber is pretreated with the debonder composition in an amount from about 5 pounds of debonder composition per ton of pulp-derived fiber to about 30 lbs of debonder composition per ton of pulp-derived fiber.

9. The method of making absorbent cellulosic sheet according to claim 1, wherein the pulp-derived fiber is pretreated with the debonder composition in an amount from about 10 pounds of debonder composition per ton of pulp-derived fiber to about 20 lbs of debonder composition per ton of pulp-derived fiber.

10. The method of making absorbent cellulosic sheet according to claim 1, wherein the pulp-derived papermaking fiber is pretreated with debonder prior to mixing it with the fibrillated regenerated cellulose microfiber.

11. The method of making absorbent cellulosic sheet according to claim 1, wherein the pulp-derived papermaking fiber is pretreated with debonder composition for at least 20 minutes prior to depositing the furnish on the foraminous support to form the nascent web.

12. The method of making absorbent cellulosic sheet according to claim 1, wherein the pulp-derived papermaking fiber is pretreated with debonder composition upstream of a machine chest and prior to depositing the furnish on the foraminous support to form the nascent web.

13. The method of making absorbent cellulosic sheet according to claim 1, wherein the pulp-derived papermaking fiber is pretreated with debonder composition in a pulper and diluted prior to depositing the furnish on the foraminous support to form the nascent web.

14. The method of making absorbent cellulosic sheet according to claim 1, wherein the pulp-derived papermaking fiber is pretreated with debonder at a consistency of at greater than 2 percent.

15. The method of making absorbent cellulosic sheet according to claim 1, wherein the aqueous furnish is treated with debonder at a consistency of greater than 3 percent.

16. The method of making absorbent cellulosic sheet according to claim 1, wherein the pulp-derived papermaking fiber is treated with debonder at a consistency of greater than 4 percent.

17. The method of making absorbent cellulosic sheet according to claim 1, wherein the pulp-derived papermaking fiber is treated with debonder at a consistency between about 3 and about 8 percent.

18. The method of making absorbent cellulosic sheet according to claim 1, wherein the fibrillated regenerated cellulose microfiber has a CSF value of less than 100 ml, wherein the fibrillated regenerated cellulose microfibers have a weight average diameter of less than 1 micron, a weight average length of less than 400 microns and a fiber count of greater than 2 billion fibers/gram.

19. The method of making absorbent cellulosic sheet according to claim 1, wherein the fibrillated regenerated cellulose microfibers have a weight average diameter of less than 0.5 microns, a weight average length of less than 300 microns and a fiber count of greater than 10 billion fibers/gram.

20. The method of making absorbent cellulosic sheet according to claim 1, wherein the fibrillated regenerated cellulose microfibers have a weight average diameter of less than 0.25 microns, a weight average length of less than 200 microns and a fiber count of greater than 50 billion fibers/gram.

21. The method of making absorbent cellulosic sheet according to claim 1, wherein said fibrillated regenerated cellulose microfibers have a number average fibril width of less than about 4 μm, and wherein the number average fiber length of the fibrillated regenerated cellulose microfibers is less than about 250 micrometers.

22. The method of making absorbent cellulosic sheet according to claim 1, wherein the number average fiber length of the fibrillated regenerated cellulose microfibers is less than about 150 micrometers.

23. The method of making absorbent cellulosic sheet according to claim 1, wherein the number average fiber length of the fibrillated regenerated cellulose microfibers is less than about 100 micrometers.

24. The method of making absorbent cellulosic sheet according to claim 1, wherein the number average fiber length of the fibrillated regenerated cellulose microfibers is less than about 75 micrometers.

25. The method of making absorbent cellulosic sheet according to claim 1, wherein the fibrillated regenerated cellulose microfibers have a CSF value of less than 50 ml.

26. The method of making absorbent cellulosic sheet according to claim 1, wherein the fibrillated regenerated cellulose microfibers have a CSF value of less than 25 ml.

27. The method of making absorbent cellulosic sheet according to claim 1, wherein the fibrillated regenerated cellulose microfibers have a CSF value of 0 ml.

* * * * *